US007648031B2

(12) United States Patent
Kari

(10) Patent No.: US 7,648,031 B2
(45) Date of Patent: Jan. 19, 2010

(54) INSERT FOR PROTECTING A PRODUCT WITHIN A BOX

(75) Inventor: David F. Kari, Carol Stream, IL (US)

(73) Assignee: International Paper Company, Loveland, OH (US)

( * ) Notice: Subject to any disclaimer, the term of this patent is extended or adjusted under 35 U.S.C. 154(b) by 356 days.

(21) Appl. No.: 11/299,978

(22) Filed: Dec. 12, 2005

(65) Prior Publication Data

US 2006/0131207 A1 Jun. 22, 2006

Related U.S. Application Data

(60) Provisional application No. 60/636,808, filed on Dec. 16, 2004.

(51) Int. Cl.
*B65D 85/30* (2006.01)
*B65D 5/52* (2006.01)

(52) U.S. Cl. ..... 206/591; 206/45.2; 206/592; 206/594

(58) Field of Classification Search ..... 206/586–590, 206/594, 45.2, 45.21, 45.28, 4.29, 454, 320, 206/591, 529, 593
See application file for complete search history.

(56) References Cited

U.S. PATENT DOCUMENTS 1,039,026 A 9/1912 Carter
1,301,171 A * 4/1919 Richardson ..... 206/45.21
2,176,274 A * 10/1939 Parnin ..... 206/301

(Continued)

*Primary Examiner*—Ehud Gartenberg
*Assistant Examiner*—Jose S Stephens, III
(74) *Attorney, Agent, or Firm*—James A. O'Malley; Thomas W. Ryan, III

(57) ABSTRACT

The invention provides a symmetrical, corrugated fibreboard blank which can be folded into an insert configured to be received within a shipping container. A product can be protected and secured by the insert. The symmetrical design results in ease and speed of assembly regardless of the orientation of the blank along the end user's packaging assembly line. The 5-sided shape of the insert produces void spaces that the products cannot reach, thus creating natural air cells within the insert. The ends, tabs and panels of the insert also provide for minimal movement of the product within the insert and further provide layers of cushioning upon impact. The insert can secure a variety of different sized products, is environmentally friendly, inexpensive and space-saving.

10 Claims, 24 Drawing Sheets

U.S. PATENT DOCUMENTS 2,850,224 A * 9/1958 Meinhardt et al. ..... 229/120.21
3,240,417 A 3/1966 Andreini
3,291,365 A 12/1966 Koene
3,330,465 A 7/1967 Davidson et al.
3,764,004 A 10/1973 Forbes, Jr.
3,921,890 A 11/1975 Reihm
4,320,839 A 3/1982 Skaggs
5,040,696 A * 8/1991 Liebel ..... 229/122.32
5,121,838 A * 6/1992 Dickie ..... 206/454
5,145,070 A * 9/1992 Pallett et al. ..... 206/521
5,322,168 A 6/1994 Kataoka
5,322,212 A * 6/1994 Strasevicz et al. ..... 229/164
5,458,237 A 10/1995 Kataoka
5,467,875 A 11/1995 Sato
5,772,025 A 6/1998 Chen et al.
5,871,147 A 2/1999 Smith et al.
5,899,336 A * 5/1999 Kataoka ..... 206/592
5,971,265 A * 10/1999 Collins ..... 229/120.13
5,979,659 A 11/1999 Kataoka
6,199,700 B1 3/2001 Yamamoto et al.
6,247,589 B1 * 6/2001 Schonhardt et al. ..... 206/320
6,257,412 B1 7/2001 Yamamoto
6,289,655 B1 * 9/2001 Ridgeway et al. ..... 53/449
6,308,828 B1 10/2001 Jones
6,354,229 B1 * 3/2002 Heidtke ..... 108/51.3
6,685,025 B1 2/2004 Kari
6,685,026 B1 2/2004 Hanna
2003/0173249 A1 * 9/2003 Nemoto ..... 206/592
2004/0084349 A1 5/2004 Kari
2005/0224390 A1 * 10/2005 Auclair ..... 206/588

* cited by examiner 500
505
510
515
520
525
530
535
540
545
550
555
560
565
570
575
580
585
590
595
600
605
610
615
620
625
630
635
640
645
650
655
660
665
670
675
680
685
690
695
700

500
505
510
515
518
520
525
530
535
540
545
550
555
560
565
570
575
580
585
590
595
600
605
610
615
620
625
630
635
640
645
650
655
660
665
670
675
680
685
690
695
700
705
710
715

500
510
572
850
518
690
578
584
508
692
596
582
554
576
558
586
552
562
556
550
602
762
566
560
512
564
642
606
600
644
514
508
778
608
588

INSERT FOR PROTECTING A PRODUCT WITHIN A BOX

CROSS-REFERENCE AND INCORPORATION BY REFERENCE

This patent application claims the benefit of domestic priority of U.S. Provisional Application Ser. No. 60/636,808, filed Dec. 16, 2004, and entitled "Cartridge Insert". U.S. Provisional Application Ser. No. 60/636,808 is hereby incorporated by reference.

BACKGROUND OF THE INVENTION

This invention relates to corrugated fibreboard inserts which fit into a carton to receive and protect an elongated or generally rectangular product and more particularly—but not exclusively—to inserts which can accommodate toner or similar cartridges having any of a number of different configurations.

In general, the invention is directed to packaging elongated or generally rectangular products, such as a VCR cartridge, a glass ornament, a work of art, a portable radio, or the like. For convenience of description, all of these and other objects will hereinafter be included in the term "toner cartridge" for a computer printer.

Some fields of a product have parts which are very similar and yet are also different in detail. This means that the manufacturer of that product has often been required to inventory a different packaging system for each product in the field. This need not only increases costs for warehousing, handling, and the like, but also creates inefficiencies because the correct box may not always be available or may be in the wrong place at the wrong time.

A toner cartridge is an example of such a product. There are many manufacturers of printers which use toners in cartridges of its own design. Each manufacturer may also have a variety of toner cartridges which have evolved with improvements over the years. The same toner manufacturer may supply toner for most, if not all of these cartridges, for printers of different manufacturers. Therefore, that toner manufacturer will want to minimize the types and styles of packaging material which it must keep in inventory, despite the fact that each printer manufacturer has its own design. The problem is further complicated since a toner cartridge does not have the smooth configuration of a rectangular box, such as a VCR cartridge.

Another consideration is the type of packaging material insofar as its bulk, ease of use, disposition and the like. For example, one type of packaging material is either molded pulp or polystyrene foam that is molded in a shape which receives and cradles a toner cartridge. Also, this requires mold tooling. It is particularly inefficient since the molded shape may not receive essentially the same cartridge if this surface contour is changed without altering the overall outer dimensions. This type of molded packaging is bulky and is costly to store and transport since it amounts to storing and shipping air. Further, it creates bulky trash for the customer to discard. In the case of polystyrene, the material is not recyclable or environmentally friendly.

A desirable form of packaging is a corrugated fibreboard insert because it is inexpensive, and can be stored flat to take up a minimum amount of room. It is recyclable and environmentally friendly. Such an insert should be simple, easy to fold, and to interlock into place with a minimum amount of effort. Also, it should be easy for the customer to unfold and re-use. Further, it should be versatile and equally easy to form and use any blank for any of many types of cartridge that may be fitted therein.

When the corrugated fibreboard blank is designed, it should use as small an amount of fibreboard as possible considering the need to physically protect the product. It should have reliable interlocking parts or other means to keep it in an assembled condition.

SUMMARY OF THE INVENTION

Briefly, and in accordance with the foregoing, The invention provides a symmetrical, corrugated fibreboard blank which can be folded into an insert configured to be received within a shipping container. A product can be protected and secured by the insert. The symmetrical design results in ease and speed of assembly regardless of the orientation of the blank along the end user's packaging assembly line. The 5-sided shape of the insert produces void spaces that the products cannot reach, thus creating natural air cells within the insert. The ends, tabs and panels of the insert also provide for minimal movement of the product within the insert and further provide layers of cushioning upon impact. The insert can secure a variety of different sized products, is environmentally friendly, inexpensive and space-saving.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
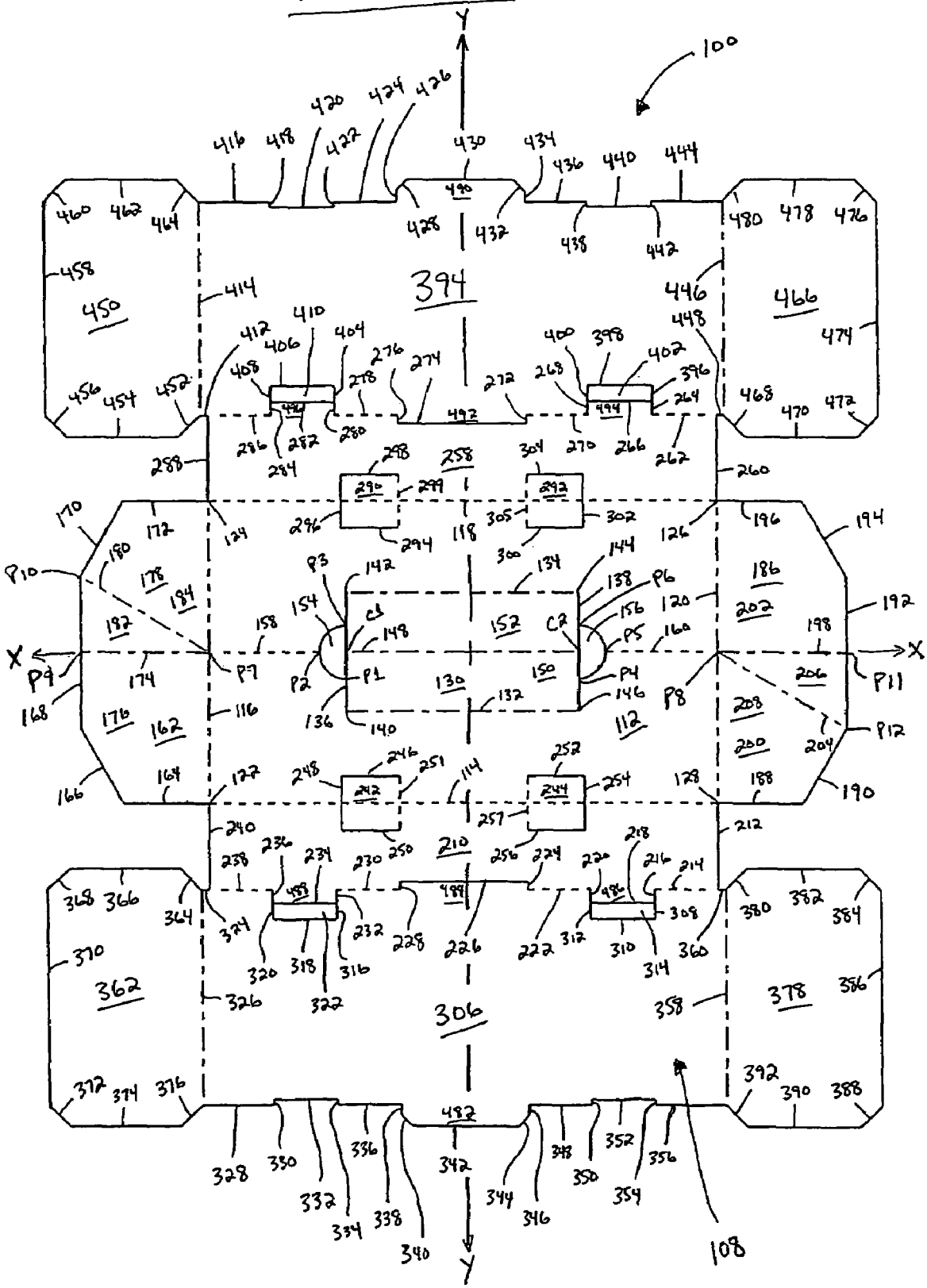
FIG. 1 is a top plan view of the blank used to form a first embodiment of the insert of the invention.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Attention is now directed to the two preferred embodiments of the blanks 100, 500 used in forming the novel inserts 102, 502. A first embodiment of the insert 102 and the blank 100 used to form the insert 102 is shown in FIGS. 1-12. A second embodiment of the blank 500 used to form the insert 502 is shown in FIGS. 13-24. Like elements are denoted with like reference numerals with the first embodiment being in the one, two, three and four hundreds, and the second embodiment being in the five, six, seven and eight hundreds.

It should be noted that while the blanks 100, 500 have been described hereinbelow as having certain dimensions, that these dimensions should be understood to be only one preferred embodiment of the blanks 100, 500 and are provided merely for reference purposes; the dimensions may be changed or adjusted as desired while keeping with the spirit of the invention such that the inserts 102, 502 formed from the blanks 100, 500 can receive and secure different size products 104, 504 and such that the inserts 102, 502 can be positioned within different size cartons or boxes 106, 506. It should further be noted that the drawings illustrating the blanks 100, 500 and the inserts 102, 502 are not necessarily drawn to scale.

It should further be noted that parts of the blanks 100, 500 are referenced as being parallel to, perpendicular to, co-planar with and/or bisected by other parts of the blanks 100, 500. These are the preferred manner in which these parts are configured relative to one another, but it is to be understood that they need not be exactly parallel, perpendicular, co-planar or bisected, just that they are generally parallel, perpendicular, co-planar or bisected.

In the drawings, fold lines are denoted by dashed lines while cut lines within the confines of the blanks 100, 500 are denoted by sold lines. It is also to be understood that the drawings do not generally illustrate the thickness of the blanks 100, 500 for clarity purposes. In the preferred embodiments, the blanks 100, 500 have a thickness of one-eighth (0.125) inches, but may also have other thicknesses, such as three-sixteenth (0.1875) inches, for example.

Figure 2:
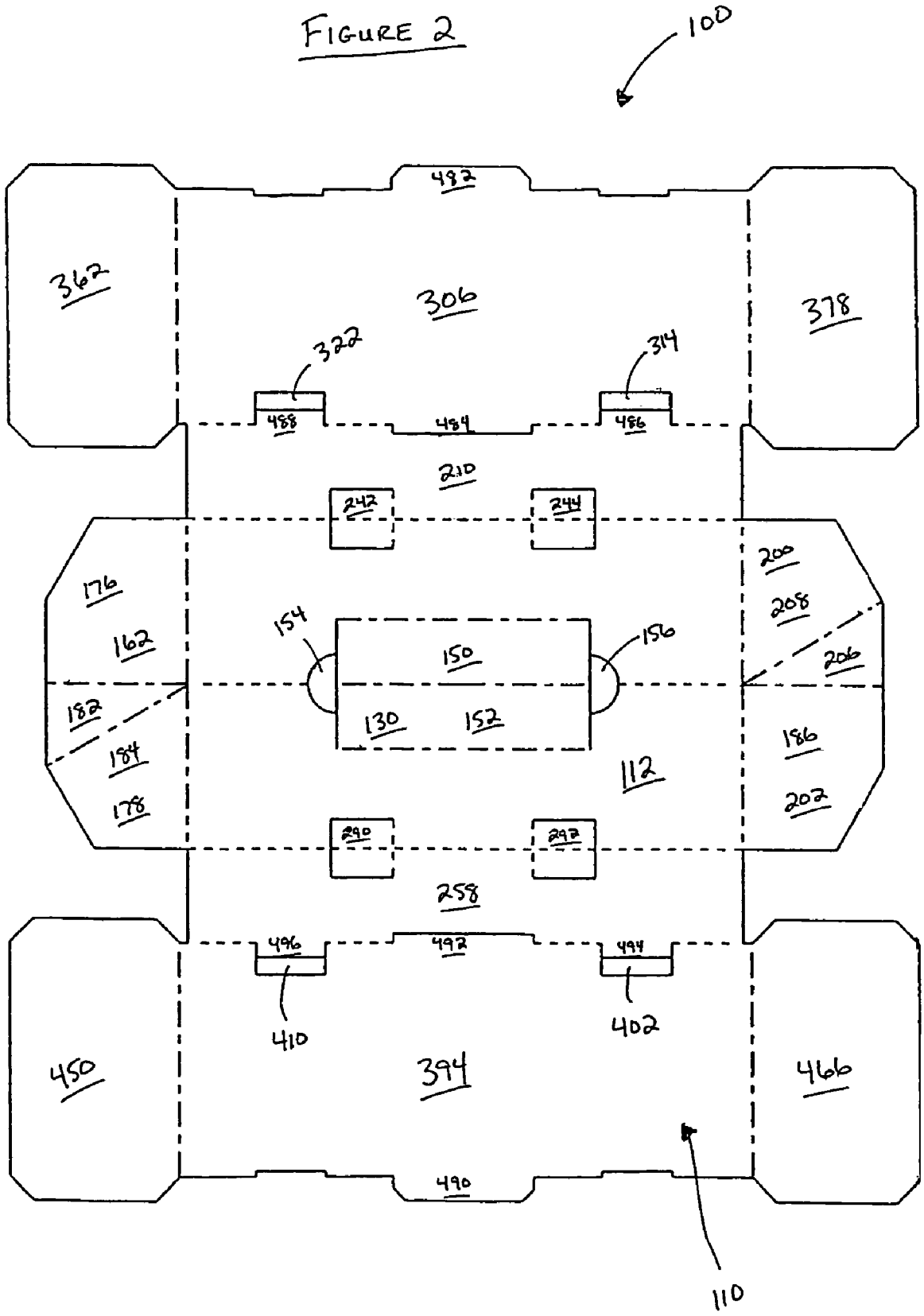
FIG. 2 is a bottom plan view of the blank used to form the first embodiment of the insert of the invention.

Attention is directed to the first embodiment where FIGS. 1 and 2 illustrate a blank 100 which may be folded to form an insert 102 for receiving, protecting and securing a product 104, such as a toner cartridge. The insert 102 with the product 104 secured therein, can then be inserted into a carton or box 106 for shipping and storage. The blank 100 is preferably formed of corrugated fibreboard. The blank 100 has a top surface 108, which is illustrated in FIG. 1, and a bottom surface 110, which is illustrated in FIG. 2.

A horizontal centerline X-X is provided in FIG. 1. It is to be understood that hereinafter in the description of the blank 100, which is provided below the horizontal centerline X-X as viewed in FIG. 1, that the terms "upward" and/or "upwardly" or similar will be used to describe elements, such as fold lines, cut lines and edges, which extend toward the horizontal centerline X-X, and that the terms "downward" and/or "downwardly" or similar will be used to describe elements, such as fold lines, cut lines and edges, which extend away from the horizontal centerline X-X. It is further to be understood that hereinafter in the description of the blank 100, which is provided above the horizontal centerline X-X as viewed in FIG. 1, that the terms "upward" and/or "upwardly" or similar will be used to describe elements, such as fold lines, cut lines and edges, which extend away from the horizontal centerline X-X, and that the terms "downward" and/or "downwardly" or similar will be used to describe elements, such as fold lines, cut lines and edges, which extend toward the horizontal centerline X-X.

A vertical centerline Y-Y is provided in FIG. 1. It is to be understood that hereinafter in the description of the blank 100 that the terms "outward" and/or "outwardly" or similar will be used to describe elements, such as fold lines, cut lines and edges, which extend away from the vertical centerline Y-Y. It is further to be understood that hereinafter in the description of the blank 100 that the terms "inward" and/or "inwardly" or similar will be used to describe elements, such as fold lines, cut lines and edges, which extend toward the vertical centerline Y-Y.

The blank 100 has a base panel 112 which is generally rectangular in configuration. The base panel 112 is defined by fold lines 114, 116, 118, 120. Fold line 114 extends a distance of twelve (12) inches. Fold line 116 extends a distance of seven (7) inches. Fold line 118 extends a distance of twelve (12) inches. Fold line 120 extends a distance of seven (7) inches.

Fold line 114 is perpendicular to fold line 116. Fold lines 114, 116 meet to define a first corner 122 of the base panel 112. Fold line 116 is perpendicular to fold line 118. Fold lines 116, 118 meet to define a second corner 124 of the base panel 112. Fold line 118 is perpendicular to fold line 120. Fold lines 118, 120 meet to define a third corner 126 of the base panel 112. Fold line 120 is perpendicular to fold line 114. Fold lines 120, 114 meet to define a fourth corner 128 of the base panel 112. Fold lines 114, 118 are opposite and parallel to one another. Fold lines 116, 120 are opposite and parallel to one another.

The base panel 112 has a V-panel 130 provided thereon. The V-panel 130 is generally rectangular in configuration. The V-panel 130 is defined by fold lines 132, 134 and cut lines 136, 138. Fold lines 132, 134 extend a distance of five and a half (5.5) inches. Cut lines 136, 138 extend a distance of two and three-fourths (2.75) inches.

Fold line 132 is perpendicular to cut line 136. Fold line 132 and cut line 136 meet to define a first corner 140 of the V-panel 130. Cut line 136 is perpendicular to fold line 134. Cut line 136 and fold line 134 meet to define a second corner 142 of the V-panel 130. Fold line 134 is perpendicular to cut line 138. Fold line 134 and cut line 138 meet to define a third corner 144 of the V-panel 130. Cut line 138 is perpendicular to fold line 132. Cut line 138 and fold line 132 meet to define a fourth corner 146 of the V-panel 130. Fold lines 132, 134 are opposite and parallel to one another. Cut lines 136, 138 are opposite and parallel to one another.

Fold line 132 is parallel to fold line 114. Fold line 132 is positioned two and one-eighth (2.125) inches from fold line 114. Fold line 134 is parallel to fold line 118. Fold line 134 is positioned two and one-eighth (2.125) inches from fold line 118. Cut line 136 is parallel to fold line 116. Cut line 136 is positioned three and one-fourth (3.25) inches from fold line 116. Cut line 138 is positioned three and one-fourth (3.25) inches from fold line 120.

V-panel 130 has a fold line 148 which extends from cut line 136 to cut line 138. Fold line 148 is parallel to fold lines 132, 134 and is positioned one and three-eighths (1.375) inches from fold line 132 and one and three-eighths (1.375) inches from fold line 134. The fold line 148 separates the V-panel 130 into a first portion 150 and a second portion 152. The first portion 150 of the V-panel 130 is defined by the fold line 132, the cut line 136, the fold line 148, and the cut line 138. The second portion 152 of the V-panel 130 is defined by the fold line 148, the cut line 136, the fold line 134, and the cut line 138.

The base panel 112 has a pair of apertures 154, 156 provided therethrough. The apertures 154, 156 are preferably in the shape of semi-circles, although the apertures 154, 156 could have other configurations if desired.

Semi-circular aperture 154 has a radius of five-eighths (0.625) inches with the center C1 being defined by the position where the fold line 148 meets the cut line 136. The semi-circular aperture 154 thus starts along the cut line 136, five-eighths (0.625) inches below the fold line 148, at a point P1, curves outwardly and upwardly toward the fold line 116 until it reaches point P2, which is planar with the fold line 148, and then curves inwardly and upwardly toward the cut line 136 until it reaches point P3, which is positioned five-eighths (0.625) inches above the fold line 148.

Semi-circular aperture 156 has a radius of five-eighths (0.625) inches with the center C2 being defined by the position where the fold line 148 meets the cut line 138. The semi-circular aperture 156 thus starts along the cut line 138, five-eighths (0.625) inches below the fold line 148, at a point P4, curves outwardly and upwardly toward the fold line 120 until it reaches point P5, which is planar with the fold line 148, and then curves inwardly and upwardly toward the cut line 138 until it reaches point P6, which is positioned five-eighths (0.625) inches above the fold line 148.

Base panel 112 has a fold line 158 which extends from point P2 to a point P7 on the fold line 116. Fold line 158 is parallel to fold lines 114, 118 and is co-planar with fold line 148. Fold line 158 is positioned three and a half (3.5) inches from fold line 114 and three and a half (3.5) inches from fold line 118, such that point P7 is positioned three and a half (3.5) inches from corner 122 and three and a half (3.5) inches from corner 124. A distance between point P2 and point P7 is two and five-eighths (2.625) inches.

Base panel 112 has a fold line 160 which extends from point P5 to a point P8 on the fold line 120. Fold line 160 is parallel to fold lines 114, 118 and is co-planar with fold line 148. Fold line 160 is positioned three and a half (3.5) inches from fold line 114 and three and a half (3.5) inches from fold line 118, such that point P8 is positioned three and a half (3.5) inches from corner 128 and three and a half (3.5) inches from corner 126. A distance between point P5 and point P8 is two and five-eighths (2.625) inches.

The blank 100 has a first side or bellows panel 162 which is generally hexagonal in configuration. The first side panel 162 is defined by edges 164, 166, 168, 170, 172 and fold line 116. Edge 164 extends a distance of two (2) inches. Edge 166 extends a distance of two (2) inches. Edge 168 extends a distance of three and a half (3.5) inches. Edge 170 extends a distance of two (2) inches. Edge 172 extends a distance of two (2) inches.

Edge 164 extends outwardly from corner 122 of the base panel 112 such that edge 164 is perpendicular to fold line 116 and co-planar with fold line 114. Edge 172 extends outwardly from corner 124 of the base panel 112 such that edge 172 is perpendicular to fold line 116 and co-planar with fold line 118. Edge 164 and edge 172 are parallel to one another and are positioned seven (7) inches apart from one another. Edge 166 extends angularly outwardly and upwardly from edge 164 to edge 168. Edge 170 extends angularly outwardly and downwardly from edge 172 to edge 168. Edge 168 is parallel to fold line 116 and is positioned three (3) inches from fold line 116.

First side panel 162 has a fold line 174 which extends from point P7 to a point P9 on edge 168, a distance of three (3) inches. Fold line 174 is parallel to edges 164, 172 and is co-planar with fold line 158. Fold line 174 is positioned three and a half (3.5) inches from edge 164 and three and a half (3.5) inches from edge 172. The fold line 174 separates the first side panel 162 into a first portion 176 and a second portion 178. The first portion 176 of the first side panel 162 is generally pentagonal and is defined by the edge 164, the edge 166, the edge 168, the fold line 174, and the fold line 116. The second portion 178 of the first side panel 162 is generally pentagonal and is defined by the edge 172, the edge 170, the edge 168, the fold line 174, and the fold line 116.

The second portion 178 of the first side panel 162 has a fold line 180, which is a bellows fold line, which extends angularly from point P7 to a point P10, which is the point where edge 168 and edge 170 meet, a distance of three and a half (3.5) inches. An angle between the fold line 174 and the bellows fold line 180 is thirty (30) degrees. The bellows fold line 180 separates the second portion 178 of the first side panel 162 into a first segment 182 and a second segment 184. The first segment 182 of the second portion 178 of the first side panel 162 is generally triangular and is defined by the fold line 174, the edge 168, and the bellows fold line 180. The second segment 184 of the second portion 178 of the first side panel 162 is generally quadrilateral and is defined by the bellows fold line 180, the edge 170, the edge 172, and the fold line 116.

The blank 100 has a second side or bellows panel 186 which is generally hexagonal in configuration. The second side panel 186 is defined by edges 188, 190, 192, 194, 196 and fold line 120. Edge 188 extends a distance of two (2) inches. Edge 190 extends a distance of two (2) inches. Edge 192 extends a distance of three and a half (3.5) inches. Edge 194 extends a distance of two (2) inches. Edge 196 extends a distance of two (2) inches.

Edge 188 extends outwardly from corner 128 of the base panel 112 such that edge 188 is perpendicular to fold line 120 and co-planar with fold line 114. Edge 196 extends outwardly from corner 126 of the base panel 112 such that edge 196 is perpendicular to fold line 120 and co-planar with fold line 118. Edge 188 and edge 196 are parallel to one another and are positioned seven (7) inches apart from one another. Edge 190 extends angularly outwardly and upwardly from edge 188 to edge 192. Edge 194 extends angularly outwardly and downwardly from edge 196 to edge 192. Edge 192 is parallel to fold line 120 and is positioned three (3) inches from fold line 120.

Second side panel 186 has a fold line 198 which extends from point P8 to a point P 11 on edge 192, a distance of three (3) inches. Fold line 198 is parallel to edges 188, 196 and is co-planar with fold line 160. Fold line 198 is positioned three and a half (3.5) inches from edge 188 and three and a half (3.5) inches from edge 196. The fold line 198 separates the second side panel 186 into a first portion 200 and a second portion 202. The first portion 200 of the second side panel 186 is generally pentagonal and is defined by the edge 188, the edge 190, the edge 192, the fold line 198, and the fold line 120. The second portion 202 of the second side panel 186 is generally pentagonal and is defined by the edge 196, the edge 194, the edge 192, the fold line 198, and the fold line 120.

The first portion 200 of the second side panel 186 has a fold line 204, which is a bellows fold line, which extends angularly from point P8 to a point P12, which is the point where edge 190 and edge 192 meet, a distance of three and a half (3.5) inches. An angle between fold line 198 and bellows fold line 204 is thirty (30) degrees. The bellows fold line 204 separates the first portion 200 of the second side panel 186 into a first segment 206 and a second segment 208. The first segment 206 of the first portion 200 of the second side panel 186 is generally triangular and is defined by the fold line 198, the edge 192, and the bellows fold line 204. The second segment 208 of the first portion 200 of the second side panel 186 is generally quadrilateral and is defined by the bellows fold line 204, the edge 190, the edge 188, and the fold line 120.

The blank 100 has a first intermediate panel 210 which is generally rectangular in configuration. The first intermediate panel 210 is defined by fold line 114, edge 212, fold line 214, cut lines 216, 218, 220, fold line 222, cut lines 224, 226, 228, fold line 230, cut lines 232, 234, 236, fold line 238, and edge 240.

Edge 212 extends downwardly from corner 128 of the base panel 112 to fold line 214 such that edge 212 is perpendicular to fold line 114 and co-planar with fold line 120. Edge 212 extends a distance of two (2) inches.

Fold line 214 extends inwardly from edge 212 to cut line 216. Fold line 214 is perpendicular to edge 212 and is parallel to fold line 114. Fold line 214 extends a distance of one and a half (1.5) inches.

Cut line 216 extends downwardly from fold line 214 to cut line 218. Cut line 216 is perpendicular to fold line 214 and is parallel to edge 212. Cut line 216 extends a distance of five-sixteenths (0.3125) inches.

Cut line 218 extends inwardly from cut line 216 to cut line 220. Cut line 218 is perpendicular to cut line 216 and is parallel to fold lines 114, 214. Cut line 218 extends a distance of one and a half (1.5) inches.

Cut line 220 extends upwardly from cut line 218 to fold line 222. Cut line 220 is perpendicular to cut line 218 and is parallel to cut line 216 and edge 212. Cut line 220 extends a distance of five-sixteenths (0.3125) inches.

Fold line 222 extends inwardly from cut line 220 to cut line 224. Fold line 222 is perpendicular to cut lines 216, 220 and edge 212, is parallel with fold line 114 and cut line 218, and is co-planar with fold line 214. Fold line 222 extends a distance of one and a half (1.5) inches.

Cut line 224 extends upwardly from fold line 222 to cut line 226. Cut line 224 is perpendicular to fold lines 114, 214, 222 and cut line 218, and is parallel to cut lines 216, 220 and edge 212. Cut line 224 extends a distance of three-sixteenths (0.1875) inches.

Cut line 226 extends from cut line 224 to cut line 228. Cut line 226 is perpendicular to cut lines 216, 220, 224 and edge 212, and is parallel to fold lines 114, 214, 222 and cut line 218. Cut line 226 extends a distance of three (3.0) inches.

Cut line 228 extends downwardly from cut line 226 to fold line 230. Cut line 228 is perpendicular to cut lines 218, 226 and fold lines 114, 214, 222, and is parallel to cut lines 216, 220, 224 and edge 212. Cut line 228 extends a distance of three-sixteenths (0.1875) inches.

Fold line 230 extends outwardly from cut line 228 to cut line 232. Cut line 230 is perpendicular to cut lines 216, 220, 224, 228 and edge 212, is parallel to fold line 114 and cut lines 218, 226, and is co-planar with fold lines 214, 222. Fold line 230 extends a distance of one and a half (1.5) inches.

Cut line 232 extends downwardly from fold line 230 to cut line 234. Cut line 232 is perpendicular to fold lines 114, 214, 222, 230 and cut lines 218, 226, and is parallel to cut lines 216, 220, 224, 228 and edge 212. Cut line 232 extends a distance of five-sixteenths (0.3125) inches.

Cut line 234 extends outwardly from cut line 232 to cut line 236. Cut line 234 is perpendicular to cut lines 216, 220, 224, 228, 232 and edge 212, is parallel to fold lines 114, 214, 222, 230 and cut line 226, and is co-planar with cut line 218. Cut line 234 extends a distance of one and a half (1.5) inches.

Cut line 236 extends upwardly from cut line 234 to fold line 238. Cut line 236 is perpendicular to fold lines 114, 214, 222, 230 and cut lines 218, 226, 234, and is parallel to cut lines 216, 220, 224, 228, 232 and edge 212. Cut line 236 extends a distance of five-sixteenths (0.3125) inches.

Fold line 238 extends outwardly from cut line 236 to edge 240. Fold line 238 is perpendicular to cut lines 216, 220, 224, 228, 232, 236 and edge 212, is parallel to fold line 114 and cut lines 218, 226, 234, and is co-planar with fold lines 214, 222, 230. Fold line 238 extends a distance of one and a half (1.5) inches.

Edge 240 extends upwardly from fold line 238 to fold line 114 at corner 122 of the base panel 112. Edge 240 is perpendicular to fold lines 114, 214, 222, 230, 238 and cut lines 218, 226, 234, is parallel to edge 212 and cut lines 216, 220, 224, 228, 232, 236, and is co-planar with fold line 116. Edge 240 extends a distance of two (2) inches. Edge 212 and edge 240 are positioned twelve (12.0) inches apart from one another.

The blank 100 has first and second flap panels 242, 244 which are generally rectangular in configuration. The first flap panel 242 is defined by cut lines 246, 248, 250 and fold line 251. Cut line 248 is perpendicular to, and bisected by, fold line 114 at a position which is three and one-eighth (3.125) inches from corner 122 and eight and seven-eighths (8.875) inches from corner 128. Cut line 248 extends a distance of one and one-quarter (1.25) inches and because cut line 248 is bisected by fold line 114, cut line 248 extends upwardly a distance of five-eighths (0.625) inches from fold line 114 into the base panel 112 and downwardly a distance of five-eighths (0.625) inches from fold line 114 into the first intermediate panel 210. Cut line 246 is provided in the base panel 112 and extends inwardly from cut line 248 to fold line 251 for a distance of one and three-eighths (1.375) inches. Cut line 246 is perpendicular to cut line 248. Cut line 250 is provided in the first intermediate panel 210 and extends inwardly from cut line 248 to fold line 251 for a distance of one and three-eighths (1.375) inches. Cut line 250 is perpendicular to cut line 248 and is parallel to cut line 246. Fold line 251 extends downwardly from cut line 246 to cut line 250. Fold line 251 is perpendicular to, and bisected by, fold line 114 at a position which is four and one-half (4.5) inches from corner 122 and seven and one-half (7.5) inches from corner 128. Fold line 251 is perpendicular to cut lines 246, 250 and is parallel to cut line 248. Fold line 251 extends a distance of one and one-quarter (1.25) inches and because fold line 251 is bisected by fold line 114, fold line 251 extends upwardly a distance of five-eighths (0.625) inches from fold line 114 into the base panel 112 and downwardly a distance of five-eighths (0.625) inches from fold line 114 into the first intermediate panel 210. The fold line 114 extends through the first flap panel 242.

The second flap panel 244 is defined by cut lines 252, 254, 256 and fold line 257. Cut line 254 is perpendicular to, and bisected by, fold line 114 at a position which is three and one-eighth (3.125) inches from corner 128 and eight and seven-eighths (8.875) inches from corner 122. Cut line 254 extends a distance of one and one-quarter (1.25) inches and because cut line 254 is bisected by fold line 114, cut line 254 extends upwardly a distance of five-eighths (0.625) inches from fold line 114 into the base panel 112 and downwardly a distance of five-eighths (0.625) inches from fold line 114 into the first intermediate panel 210. Cut line 252 is provided in the base panel 112 and extends inwardly from cut line 254 to fold line 257 for a distance of one and three-eighths (1.375) inches. Cut line 252 is perpendicular to cut line 254 and is co-planar with cut line 246. Cut line 256 is provided in the first intermediate panel 210 and extends inwardly from cut line 254 to fold line 257 for a distance of one and three-eighths (1.375) inches. Cut line 256 is perpendicular to cut line 254, parallel to cut line 252, and is co-planar with cut line 250. Fold line 257 extends downwardly from cut line 252 to cut line 256. Fold line 257 is perpendicular to, and bisected by, fold line 114 at a position which is four and one-half (4.5) inches from corner 128 and seven and one-half (7.5) inches from corner 122. Fold line 257 is perpendicular to cut lines 252, 256 and is parallel to cut line 254. Fold line 257 extends a distance of one and one-quarter (1.25) inches and because fold line 257 is bisected by fold line 114, fold line 257 extends upwardly a distance of five-eighths (0.625) inches from fold line 114 into the base panel 112 and downwardly a distance of five-eighths (0.625) inches from fold line 114 into the first intermediate panel 210. The fold line 114 extends through the second flap panel 244.

The blank 100 has a second intermediate panel 258 which is generally rectangular in configuration. The second intermediate panel 258 is defined by fold line 118, edge 260, fold line 262, cut lines 264, 266, 268, fold line 270, cut lines 272, 274, 276, fold line 278, cut lines 280, 282, 284, fold line 286, and edge 288.

Edge 260 extends upwardly from corner 126 of the base panel 112 to fold line 262 such that edge 260 is perpendicular to fold line 118 and co-planar with fold line 120. Edge 260 extends a distance of two (2) inches.

Fold line 262 extends inwardly from edge 260 to cut line 264. Fold line 262 is perpendicular to edge 260 and is parallel to fold line 118. Fold line 262 extends a distance of one and a half (1.5) inches.

Cut line 264 extends upwardly from fold line 262 to cut line 266. Cut line 264 is perpendicular to fold line 262 and is parallel to edge 260. Cut line 264 extends a distance of five-sixteenths (0.3125) inches.

Cut line 266 extends inwardly from cut line 264 to cut line 268. Cut line 266 is perpendicular to cut line 264 and is parallel to fold lines 118, 262. Cut line 266 extends a distance of one and a half (1.5) inches.

Cut line 268 extends downwardly from cut line 266 to fold line 270. Cut line 268 is perpendicular to cut line 266 and is parallel to cut line 264 and edge 260. Cut line 268 extends a distance of five-sixteenths (0.3125) inches.

Fold line 270 extends inwardly from cut line 268 to cut line 272. Fold line 270 is perpendicular to cut lines 264, 268 and edge 260, is parallel with fold line 118 and cut line 266, and is co-planar with fold line 262. Fold line 270 extends a distance of one and a half (1.5) inches.

Cut line 272 extends downwardly from fold line 270 to cut line 274. Cut line 272 is perpendicular to fold lines 118, 262, 270 and cut line 266, and is parallel to cut lines 264, 268 and edge 260. Cut line 272 extends a distance of three-sixteenths (0.1875) inches.

Cut line 274 extends from cut line 272 to cut line 276. Cut line 274 is perpendicular to cut lines 264, 268, 272 and edge 260, and is parallel to fold lines 118, 262, 270 and cut line 266. Cut line 274 extends a distance of three (3.0) inches.

Cut line 276 extends upwardly from cut line 274 to fold line 278. Cut line 276 is perpendicular to cut lines 266, 274 and fold lines 118, 262, 270, and is parallel to cut lines 264, 268, 272 and edge 260. Cut line 276 extends a distance of three-sixteenths (0.1875) inches.

Fold line 278 extends outwardly from cut line 276 to cut line 280. Cut line 278 is perpendicular to cut lines 264, 268, 272, 276 and edge 260, is parallel to fold line 118 and cut lines 266, 274, and is co-planar with fold lines 262, 270. Fold line 278 extends a distance of one and a half (1.5) inches.

Cut line 280 extends upwardly from fold line 278 to cut line 282. Cut line 280 is perpendicular to fold lines 118, 262, 270, 278 and cut lines 266, 274, and is parallel to cut lines 264, 268, 272, 276 and edge 260. Cut line 280 extends a distance of five-sixteenths (0.3125) inches.

Cut line 282 extends outwardly from cut line 280 to cut line 284. Cut line 282 is perpendicular to cut lines 264, 268, 272, 276, 280 and edge 260, is parallel to fold lines 118, 262, 270, 278 and cut line 274, and is co-planar with cut line 266. Cut line 282 extends a distance of one and a half (1.5) inches.

Cut line 284 extends downwardly from cut line 282 to fold line 286. Cut line 284 is perpendicular to fold lines 118, 262, 270, 278 and cut lines 266, 274, 282, and is parallel to cut lines 264, 268, 272, 276, 280 and edge 260. Cut line 284 extends a distance of five-sixteenths (0.3125) inches.

Fold line 286 extends outwardly from cut line 284 to edge 288. Fold line 286 is perpendicular to cut lines 264, 268, 272, 276, 280, 284 and edge 260, is parallel to fold line 118 and cut lines 266, 274, 282, and is co-planar with fold lines 262, 270, 278. Fold line 286 extends a distance of one and a half (1.5) inches.

Edge 288 extends downwardly from fold line 286 to fold line 118 at corner 124 of the base panel 112. Edge 288 is perpendicular to fold lines 118, 262, 270, 278, 286 and cut lines 266, 274, 282, is parallel to edge 260 and cut lines 264, 268, 272, 276, 280, 284, and is co-planar with fold line 116. Edge 288 extends a distance of two (2) inches. Edge 260 and edge 288 are positioned twelve (12.0) inches apart from one another.

The blank 100 has third and fourth flap panels 290, 292 which are generally rectangular in configuration. The third flap panel 290 is defined by cut lines 294, 296, 298 and fold line 299. Cut line 296 is perpendicular to, and bisected by, fold line 118 at a position which is three and one-eighth (3.125) inches from corner 124 and eight and seven-eighths (8.875) inches from corner 126. Cut line 296 is co-planar with cut line 248. Cut line 296 extends a distance of one and one-quarter (1.25) inches and because cut line 296 is bisected by fold line 118, cut line 296 extends downwardly a distance of five-eighths (0.625) inches from fold line 118 into the base panel 112 and upwardly a distance of five-eighths (0.625) inches from fold line 118 into the second intermediate panel 258. Cut line 294 is provided in the base panel 112 and extends inwardly from cut line 296 to fold line 299 for a distance of one and three-eighths (1.375) inches. Cut line 294 is perpendicular to cut line 296. Cut line 298 is provided in the second intermediate panel 258 and extends inwardly from cut line 296 to fold line 299 for a distance of one and three-eighths (1.375) inches. Cut line 298 is perpendicular to cut line 296 and is parallel to cut line 294. Fold line 299 extends upwardly from cut line 294 to cut line 298. Fold line 299 is perpendicular to, and bisected by, fold line 118 at a position which is four and one-half (4.5) inches from corner 124 and seven and one-half (7.5) inches from corner 126. Fold line 299 is perpendicular to cut lines 294, 298, parallel to cut line 296, and is co-planar with fold line 251. Fold line 299 extends a distance of one and one-quarter (1.25) inches and because fold line 299 is bisected by fold line 118, fold line 299 extends downwardly a distance of five-eighths (0.625) inches from fold line 118 into the base panel 112 and upwardly a distance of five-eighths (0.625) inches from fold line 118 into the second intermediate panel 258. The fold line 118 extends through the third flap panel 290.

The fourth flap panel 292 is defined by cut lines 300, 302, 304 and fold line 305. Cut line 302 is perpendicular to, and bisected by, fold line 118 at a position which is three and one-eighth (3.125) inches from corner 126 and eight and seven-eighths (8.875) inches from corner 124. Cut line 302 is co-planar with cut line 254. Cut line 302 extends a distance of one and one-quarter (1.25) inches and because cut line 302 is bisected by fold line 118, cut line 302 extends downwardly a distance of five-eighths (0.625) inches from fold line 118 into the base panel 112 and upwardly a distance of five-eighths (0.625) inches from fold line 118 into the second intermediate panel 258. Cut line 300 is provided in the base panel 112 and extends inwardly from cut line 302 to fold line 305 for a distance of one and three-eighths (1.375) inches. Cut line 300 is perpendicular to cut line 302 and is co-planar with cut line 294. Cut line 304 is provided in the second intermediate panel 258 and extends inwardly from cut line 302 to fold line 305 for a distance of one and three-eighths (1.375) inches. Cut line 304 is perpendicular to cut line 302, parallel to cut line 300, and is co-planar with cut line 298. Fold line 305 extends upwardly from cut line 300 to cut line 304. Fold line 305 is perpendicular to, and bisected by, fold line 118 at a position which is four and one-half (4.5) inches from corner 126 and seven and one-half (7.5) inches from corner 124. Fold line 305 is perpendicular to cut lines 300, 304, parallel to cut line 302, and is co-planar to fold line 257. Fold line 305 extends a distance of one and one-quarter (1.25) inches and because fold line 305 is bisected by fold line 118, fold line 305 extends downwardly a distance of five-eighths (0.625) inches from fold line 118 into the base panel 112 and upwardly a distance of five-eighths (0.625) inches from fold line 118 into the second intermediate panel 258. The fold line 118 extends through the fourth flap panel 292.

The blank 100 has a first top panel 306 which is generally rectangular in configuration. The first top panel 306 is defined by fold line 214, cut lines 216, 308, 310, 312, 220, fold line 222, cut lines 224, 226, 228, fold line 230, cut lines 232, 316, 318, 320, 236, fold line 238, edge 324, fold line 326, edges 328, 330, 332, 334, 336, 338, 340, 342, 344, 346, 348, 350, 352, 354, 356, fold line 358, and edge 360.

Cut line 308 extends, from the corner defined by cut lines 216, 218, downwardly to cut line 310 such that cut line 308 is perpendicular to cut line 218 and is co-planar with cut line 216. Cut line 308 extends a distance of three-eighths (0.375) inches.

Cut line 310 extends inwardly from cut line 308 to cut line 312. Cut line 310 is perpendicular to cut line 308 and is parallel to cut line 218. Cut line 310 extends a distance of one and a half (1.5) inches.

Cut line 312 extends upwardly from cut line 310 to cut line 220. Cut line 312 is perpendicular to cut lines 218, 310, parallel to cut line 308, and is co-planar with cut line 220. Cut line 312 extends a distance of three-eighths (0.375) inches.

Cut lines 218, 308, 310, 312 define an aperture 314, which is generally rectangular in configuration, provided through the first top panel 306.

Cut line 316 extends, from the corner defined by cut lines 232, 234, downwardly to cut line 318 such that cut line 316 is perpendicular to cut line 234 and is co-planar with cut line 232. Cut line 316 extends a distance of three-eighths (0.375) inches.

Cut line 318 extends outwardly from cut line 316 to cut line 320. Cut line 318 is perpendicular to cut line 316 and is parallel to cut line 234. Cut line 318 extends a distance of one and a half (1.5) inches.

Cut line 320 extends upwardly from cut line 318 to cut line 236. Cut line 320 is perpendicular to cut lines 234, 318, parallel to cut line 316, and is co-planar with cut line 236. Cut line 320 extends a distance of three-eighths (0.375) inches.

Cut lines 234, 316, 318, 320 define an aperture 322, which is generally rectangular in configuration, provided through the first top panel 306.

Edge 324 extends, from the corner defined by fold line 238 and edge 240, outwardly to fold line 326 such that edge 324 is perpendicular to edge 240 and is co-planar with fold line 238. Edge 324 extends a distance of three-sixteenths (0.1875) inches.

Fold line 326 extends downwardly from edge 324 to edge 328. Fold line 326 is perpendicular to edge 324 and is parallel to edge 240. Fold line 326 extends a distance of four and fifteen-sixteenths (4.9375) inches.

Edge 328 extends inwardly from fold line 326 to edge 330. Edge 328 is perpendicular to fold line 326 and is parallel to edge 324. Edge 328 extends a distance of one and eleven-sixteenths (1.6875) inches.

Edge 330 extends upwardly from edge 328 to edge 332. Edge 330 is perpendicular to edge 328 and is parallel to fold line 326. Edge 330 extends a distance of one-eighth (0.125) inches.

Edge 332 extends inwardly from edge 330 to edge 334. Edge 332 is perpendicular to edge 330 and is parallel to edge 328. Edge 332 extends a distance of one and one-half (1.5) inches.

Edge 334 extends downwardly from edge 332 to edge 336. Edge 334 is perpendicular to edge 332 and is parallel to edge 330. Edge 334 extends a distance of one-eighth (0.125) inches.

Edge 336 extends inwardly from edge 334 to edge 338. Edge 336 is perpendicular to edge 334, parallel to edge 332, and co-planar with edge 328. Edge 336 extends a distance of one and a half (1.5) inches.

Edge 338 extends downwardly from edge 336 to edge 340. Edge 338 is perpendicular to edge 336 and is parallel to edge 334. Edge 338 extends a distance of one-fourth (0.25) inches.

Edge 340 extends angularly inwardly and downwardly from edge 338 to edge 342 at a forty-five (45) degree angle. Edge 340 extends a distance of approximately one hundred-two hundred eighty-thirds (approx. 0.3534) inches.

Edge 342 extends from edge 340 to edge 344. Edge 342 is perpendicular to edge 338 and is parallel to edge 336. Edge 342 extends a distance of two and a half (2.5) inches.

Edge 344 extends angularly outwardly and upwardly from edge 342 to edge 346 at a forty-five (45) degree angle. Edge 344 is perpendicular to edge 340. Edge 344 extends a distance of approximately one hundred-two hundred eighty-thirds (approx. 0.3534) inches.

Edge 346 extends upwardly from edge 344 to edge 348. Edge 346 is perpendicular to edge 342 and is parallel to edge 338. Edge 346 extends a distance of one-fourth (0.25) inches.

Edge 348 extends outwardly from edge 346 to edge 350. Edge 348 is perpendicular to edge 346, parallel to edge 342, and co-planar with edge 336. Edge 348 extends a distance of one and a half (1.5) inches.

Edge 350 extends upwardly from edge 348 to edge 352. Edge 350 is perpendicular to edge 348 and parallel to edge 346. Edge 350 extends a distance of one-eighth (0.125) inches.

Edge 352 extends outwardly from edge 350 to edge 354. Edge 352 is perpendicular to edge 350, parallel to edge 348, and co-planar with edge 332. Edge 352 extends a distance of one and a half (1.5) inches.

Edge 354 extends downwardly from edge 352 to edge 356. Edge 354 is perpendicular to edge 352 and is parallel to edge 350. Edge 354 extends a distance of one-eighth (0.125) inches.

Edge 356 extends outwardly from edge 356 to fold line 358. Edge 356 is perpendicular to edge 354, parallel to edge 352, and co-planar with edge 348. Edge 356 extends a distance of one and eleven-sixteenths (1.6875) inches.

Fold line 358 extends upwardly from edge 356 to edge 360. Fold line 358 is perpendicular to edge 356 and parallel to edge 354 and fold line 326. Fold line 358 is positioned twelve and three-eighths (12.375) inches apart from fold line 326. Fold line 358 extends a distance of four and fifteen-sixteenths (4.9375) inches.

Edge 360 extends inwardly from fold line 358 to the corner defined by fold line 214 and edge 212, such that edge 360 is perpendicular to edge 212 and fold line 358, and is co-planar with fold line 214. Edge 360 extends a distance of three-sixteenths 0.1875) inches.

The blank 100 has a first end panel 362 which is generally octagonal in configuration. The first end panel 362 is defined by fold line 326 and edges 364, 366, 368, 370, 372, 374, 376.

Edge 364 extends, from the corner defined by edge 324 and fold line 326, angularly outwardly and upwardly to edge 366 at a forty-five (45) degree angle. Edge 364 is parallel to edge 340. Edge 364 extends a distance of approximately one-hundred-one-hundred forty-first (approx. 0.7092) inches.

Edge 366 extends outwardly from edge 364 to edge 368. Edge 366 is perpendicular to fold line 326 and is parallel to edge 324. Edge 366 extends a distance of two and five-eighths (2.625) inches.

Edge 368 extends angularly outwardly and downwardly from edge 366 to edge 370 at a forty-five (45) degree angle. Edge 368 is perpendicular to edge 364 and is parallel to edge 344. Edge 368 extends a distance of approximately one-hundred-one-hundred forty-first (approx. 0.7092) inches.

Edge 370 extends downwardly from edge 368 to edge 372. Edge 370 is perpendicular to edge 366 and is parallel to fold line 326. Edge 370 extends a distance of four and fifteen-sixteenths (4.9375) inches.

Edge 372 extends angularly inwardly and downwardly from edge 370 to edge 374 at a forty-five (45) degree angle. Edge 372 is perpendicular to edge 368 and is parallel to edge 364. Edge 372 extends a distance of approximately one-hundred-one-hundred forty-first (approx. 0.7092) inches.

Edge 374 extends inwardly from edge 372 to edge 376. Edge 374 is perpendicular to edge 370 and fold line 326, parallel to edge 366, and co-planar to edge 342. Edge 374 extends a distance of two and five-eighths (2.625) inches.

Edge 376 extends angularly upwardly and inwardly from edge 374 to the corner defined by fold line 326 and edge 328 at a forty-five (45) degree angle. Edge 376 is perpendicular to edges 364, 372 and is parallel to edge 368. Edge 376 extends a distance of approximately one-hundred-one-hundred forty-first (approx. 0.7092) inches.

The blank 100 has a second end panel 378 which is generally octagonal in configuration. The second end panel 378 is defined by fold line 358 and edges 380, 382, 384, 386, 388, 390,392.

Edge 380 extends, from the corner defined by edge 360 and fold line 358, angularly outwardly and upwardly to edge 382 at a forty-five (45) degree angle. Edge 380 is parallel to edge 344. Edge 380 extends a distance of approximately one-hundred-one-hundred forty-first (approx. 0.7092) inches.

Edge 382 extends outwardly from edge 380 to edge 384. Edge 382 is perpendicular to fold line 358 and is parallel to edge 360. Edge 382 extends a distance of two and five-eighths (2.625) inches.

Edge 384 extends angularly outwardly and downwardly from edge 382 to edge 386 at a forty-five (45) degree angle. Edge 384 is perpendicular to edge 380 and is parallel to edge 340. Edge 384 extends a distance of approximately one-hundred-one-hundred forty-first (approx. 0.7092) inches.

Edge 386 extends downwardly from edge 384 to edge 388. Edge 386 is perpendicular to edge 382 and is parallel to fold line 358. Edge 386 extends a distance of four and fifteen-sixteenths (4.9375) inches.

Edge 388 extends angularly inwardly and downwardly from edge 386 to edge 390 at a forty-five (45) degree angle. Edge 388 is perpendicular to edge 384 and is parallel to edge 380. Edge 388 extends a distance of approximately one-hundred-one-hundred forty-first (approx. 0.7092) inches.

Edge 390 extends inwardly from edge 388 to edge 392. Edge 390 is perpendicular to edge 386 and fold line 358, parallel to edge 382, and co-planar to edge 342. Edge 390 extends a distance of two and five-eighths (2.625) inches.

Edge 392 extends angularly upwardly and inwardly from edge 390 to the corner defined by fold line 358 and edge 356 at a forty-five (45) degree angle. Edge 392 is perpendicular to edges 380, 388 and is parallel to edge 384. Edge 392 extends a distance of approximately one-hundred-one-hundred forty-first (approx. 0.7092) inches.

The blank 100 has a second top panel 394 which is generally rectangular in configuration. The second top panel 394 is defined by fold line 262, cut lines 264, 396, 398, 400, 268, fold line 270, cut lines 272, 274, 276, fold line 278, cut lines 280, 404, 406, 408, 284, fold line 286, edge 412, fold line 414, edges 416, 418, 420, 422, 424, 426, 428, 430, 432, 434, 436, 438, 440, 442, 444, fold line 446, and edge 448.

Cut line 396 extends, from the corner defined by cut lines 264, 266, upwardly to cut line 398 such that cut line 396 is perpendicular to cut line 266 and is co-planar with cut line 264. Cut line 396 extends a distance of three-eighths (0.375) inches.

Cut line 398 extends inwardly from cut line 396 to cut line 400. Cut line 398 is perpendicular to cut line 396 and is parallel to cut line 266. Cut line 398 extends a distance of one and a half (1.5) inches.

Cut line 400 extends downwardly from cut line 398 to cut line 268. Cut line 400 is perpendicular to cut lines 266, 398, parallel to cut line 396, and is co-planar with cut line 268. Cut line 400 extends a distance of three-eighths (0.375) inches.

Cut lines 266, 396, 398, 400 define an aperture 402, which is generally rectangular in configuration, provided through the second top panel 394.

Cut line 404 extends, from the corner defined by cut lines 280, 282, upwardly to cut line 406 such that cut line 404 is perpendicular to cut line 282 and is co-planar with cut line 280. Cut line 404 extends a distance of three-eighths (0.375) inches.

Cut line 406 extends outwardly from cut line 404 to cut line 408. Cut line 406 is perpendicular to cut line 404 and is parallel to cut line 282. Cut line 406 extends a distance of one and a half (1.5) inches.

Cut line 408 extends downwardly from cut line 406 to cut line 284. Cut line 408 is perpendicular to cut lines 282, 406, parallel to cut line 404, and is co-planar with cut line 284. Cut line 408 extends a distance of three-eighths (0.375) inches.

Cut lines 282, 404, 406, 408 define an aperture 410, which is generally rectangular in configuration, provided through the second top panel 394.

Edge 412 extends, from the corner defined by fold line 286 and edge 288, outwardly to fold line 414 such that edge 412 is perpendicular to edge 288 and is co-planar with fold line 286. Edge 412 extends a distance of three-sixteenths (0.1875) inches.

Fold line 414 extends upwardly from edge 412 to edge 416. Fold line 414 is perpendicular to edge 412 and is parallel to edge 288. Fold line 414 extends a distance of four and fifteen-sixteenths (4.9375) inches.

Edge 416 extends inwardly from fold line 414 to edge 418. Edge 416 is perpendicular to fold line 414 and is parallel to edge 412. Edge 416 extends a distance of one and eleven-sixteenths (1.6875) inches.

Edge 418 extends downwardly from edge 416 to edge 420. Edge 418 is perpendicular to edge 416 and is parallel to fold line 414. Edge 418 extends a distance of one-eighth (0.125) inches.

Edge 420 extends inwardly from edge 418 to edge 422. Edge 420 is perpendicular to edge 418 and is parallel to edge 416. Edge 420 extends a distance of one and one-half (1.5) inches.

Edge 422 extends upwardly from edge 420 to edge 424. Edge 422 is perpendicular to edge 420 and is parallel to edge 418. Edge 422 extends a distance of one-eighth (0.125) inches.

Edge 424 extends inwardly from edge 422 to edge 426. Edge 424 is perpendicular to edge 422, parallel to edge 420, and co-planar with edge 416. Edge 424 extends a distance of one and a half (1.5) inches.

Edge 426 extends upwardly from edge 424 to edge 428. Edge 426 is perpendicular to edge 424 and is parallel to edge 422. Edge 426 extends a distance of one-fourth (0.25) inches.

Edge 428 extends angularly inwardly and upwardly from edge 426 to edge 430 at a forty-five (45) degree angle. Edge 428 extends a distance of approximately one hundred-two hundred eighty-thirds (approx. 0.3534) inches.

Edge 430 extends from edge 428 to edge 432. Edge 430 is perpendicular to edge 426 and is parallel to edge 424. Edge 430 extends a distance of two and a half (2.5) inches.

Edge 432 extends angularly outwardly and downwardly from edge 430 to edge 434 at a forty-five (45) degree angle. Edge 432 is perpendicular to edge 428. Edge 432 extends a distance of approximately one hundred-two hundred eighty-thirds (approx. 0.3534) inches.

Edge 434 extends downwardly from edge 432 to edge 436. Edge 434 is perpendicular to edge 430 and is parallel to edge 426. Edge 434 extends a distance of one-fourth (0.25) inches.

Edge 436 extends outwardly from edge 434 to edge 438. Edge 436 is perpendicular to edge 434, parallel to edge 430, and co-planar with edge 424. Edge 436 extends a distance of one and a half (1.5) inches.

Edge 438 extends upwardly from edge 436 to edge 440. Edge 438 is perpendicular to edge 436 and parallel to edge 434. Edge 438 extends a distance of one-eighth (0.125) inches.

Edge 440 extends outwardly from edge 438 to edge 442. Edge 440 is perpendicular to edge 438, parallel to edge 436, and co-planar with edge 420. Edge 440 extends a distance of one and a half (1.5) inches.

Edge 442 extends upwardly from edge 440 to edge 444. Edge 442 is perpendicular to edge 440 and is parallel to edge 438. Edge 442 extends a distance of one-eighth (0.125) inches.

Edge 444 extends outwardly from edge 442 to fold line 446. Edge 444 is perpendicular to edge 442, parallel to edge 440, and co-planar with edge 436. Edge 444 extends a distance of one and eleven-sixteenths (1.6875) inches.

Fold line 446 extends downwardly from edge 444 to edge 448. Fold line 446 is perpendicular to edge 444 and parallel to edge 442 and fold line 414. Fold line 446 is positioned twelve and three-eighths (12.375) inches apart from fold line 414. Fold line 446 extends a distance of four and fifteen-sixteenths (4.9375) inches.

Edge 448 extends inwardly from fold line 446 to the corner defined by fold line 262 and edge 260, such that edge 448 is perpendicular to edge 260 and fold line 446, and is co-planar with fold line 262. Edge 448 extends a distance of three-sixteenths 0.1875) inches.

The blank 100 has a third end panel 450 which is generally octagonal in configuration. The third end panel 450 is defined by fold line 414 and edges 452, 454, 456, 458, 460, 462, 464.

Edge 452 extends, from the corner defined by edge 412 and fold line 414, angularly outwardly and downwardly to edge 454 at a forty-five (45) degree angle. Edge 452 is parallel to edge 428. Edge 3452 extends a distance of approximately one-hundred-one-hundred forty-first (approx. 0.7092) inches.

Edge 454 extends outwardly from edge 452 to edge 456. Edge 454 is perpendicular to fold line 414 and is parallel to edge 412. Edge 454 extends a distance of two and five-eighths (2.625) inches.

Edge 456 extends angularly outwardly and upwardly from edge 454 to edge 458 at a forty-five (45) degree angle. Edge 456 is perpendicular to edge 452 and is parallel to edge 432. Edge 456 extends a distance of approximately one-hundred-one-hundred forty-first (approx. 0.7092) inches.

Edge 458 extends upwardly from edge 456 to edge 460. Edge 458 is perpendicular to edge 454 and is parallel to fold line 414. Edge 458 extends a distance of four and fifteen-sixteenths (4.9375) inches.

Edge 460 extends angularly inwardly and upwardly from edge 458 to edge 462 at a forty-five (45) degree angle. Edge 460 is perpendicular to edge 456 and is parallel to edge 452. Edge 460 extends a distance of approximately one-hundred-one-hundred forty-first (approx. 0.7092) inches.

Edge 462 extends inwardly from edge 460 to edge 464. Edge 462 is perpendicular to edge 458 and fold line 414, parallel to edge 454, and co-planar to edge 430. Edge 462 extends a distance of two and five-eighths (2.625) inches.

Edge 464 extends angularly downwardly and inwardly from edge 462 to the corner defined by fold line 414 and edge 416 at a forty-five (45) degree angle. Edge 464 is perpendicular to edges 452, 460 and is parallel to edge 456. Edge 464 extends a distance of approximately one-hundred-one-hundred forty-first (approx. 0.7092) inches.

The blank 100 has a fourth end panel 466 which is generally octagonal in configuration. The fourth end panel 466 is defined by fold line 446 and edges 468, 470, 472, 474, 476, 478, 480.

Edge 468 extends, from the corner defined by edge 448 and fold line 446, angularly outwardly and downwardly to edge 470 at a forty-five (45) degree angle. Edge 468 is parallel to edge 432. Edge 468 extends a distance of approximately one-hundred-one-hundred forty-first (approx. 0.7092) inches.

Edge 470 extends outwardly from edge 468 to edge 472. Edge 470 is perpendicular to fold line 446 and is parallel to edge 448. Edge 470 extends a distance of two and five-eighths (2.625) inches.

Edge 472 extends angularly outwardly and upwardly from edge 470 to edge 474 at a forty-five (45) degree angle. Edge 472 is perpendicular to edge 468 and is parallel to edge 428. Edge 472 extends a distance of approximately one-hundred-one-hundred forty-first (approx. 0.7092) inches.

Edge 474 extends upwardly from edge 472 to edge 476. Edge 474 is perpendicular to edge 470 and is parallel to fold line 446. Edge 474 extends a distance of four and fifteen-sixteenths (4.9375) inches.

Edge 476 extends angularly inwardly and upwardly from edge 474 to edge 478 at a forty-five (45) degree angle. Edge 476 is perpendicular to edge 472 and is parallel to edge 468. Edge 476 extends a distance of approximately one-hundred-one-hundred forty-first (approx. 0.7092) inches.

Edge 478 extends inwardly from edge 476 to edge 480. Edge 478 is perpendicular to edge 474 and fold line 446, parallel to edge 470, and co-planar to edge 430. Edge 478 extends a distance of two and five-eighths (2.625) inches.

Edge 480 extends angularly downwardly and inwardly from edge 478 to the corner defined by fold line 446 and edge 444 at a forty-five (45) degree angle. Edge 480 is perpendicular to edges 468, 476 and is parallel to edge 472. Edge 480 extends a distance of approximately one-hundred-one-hundred forty-first (approx. 0.7092) inches.

A first tab member 482 is defined on the first top panel 306 by edges 338, 340, 342, 344, 346. A second tab member 484 is defined on the first top panel 306 by cut lines 224, 226, 228. A third tab member 486 is defined on the first intermediate panel 210 by cut lines 216, 218, 220. A fourth tab member 488 is defined on the first intermediate panel 210 by cut lines 232, 234, 236.

A fifth tab member 490 is defined on the second top panel 394 by edges 426, 428, 430, 432, 434. A sixth tab member 492 is defined on the second top panel 394 by cut lines 272, 274, 276. A seventh tab member 494 is defined on the second intermediate panel 258 by cut lines 264, 266, 268. An eighth tab member 496 is defined on the second intermediate panel 258 by cut lines 280, 282, 284.

Attention is now directed to FIGS. 3-11 which illustrate the blank 100 being folded to form the insert 102 for receiving, protecting and securing the product 104, such as a toner cartridge.

Figure 3:
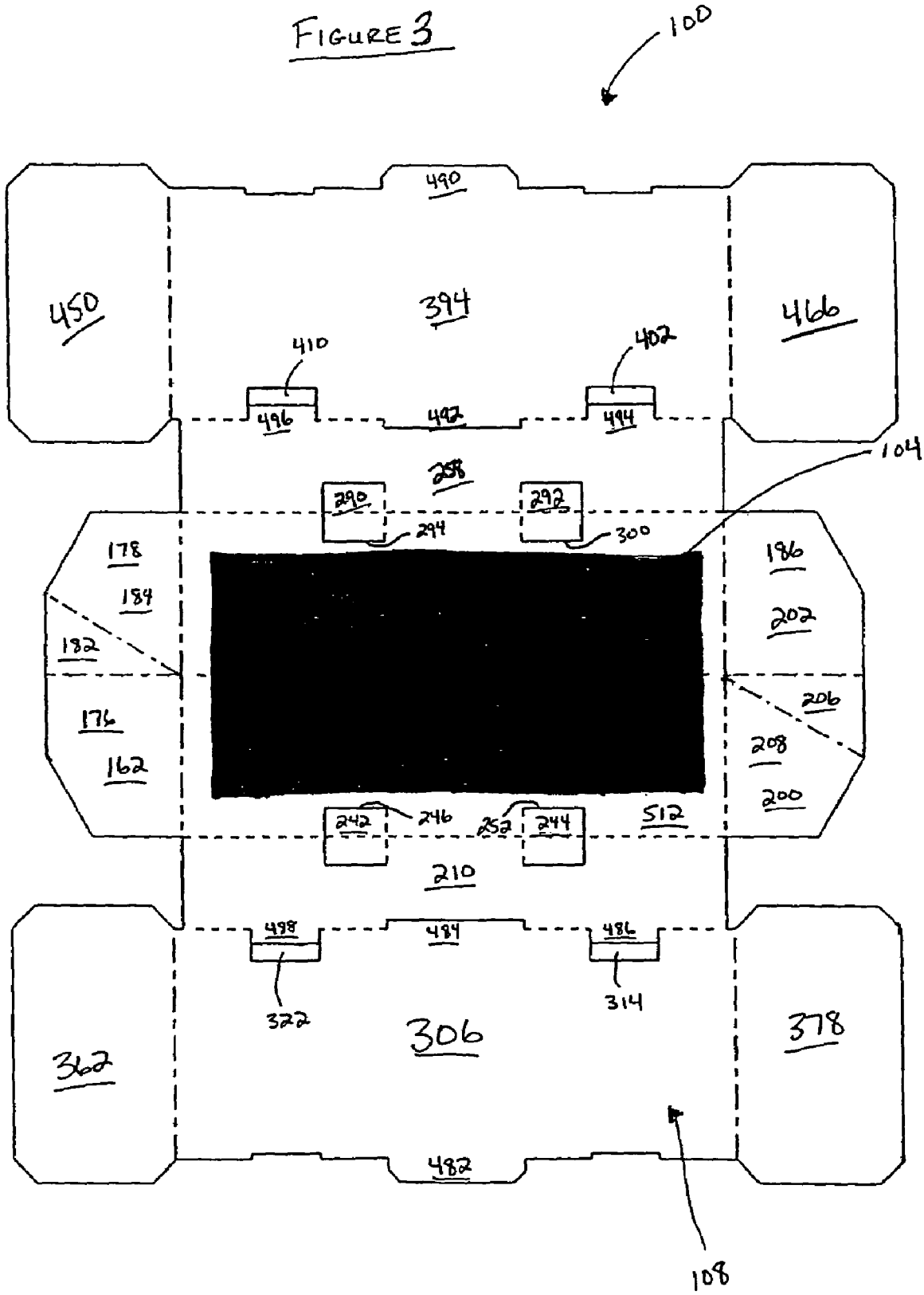
FIGS. 3-11 illustrate the method of folding the blank to form the first embodiment of the insert of the invention which secures a product therein.

As illustrated in FIG. 3, the product 104 is positioned on the top surface 108 of the base panel 112, preferably such that the product 104 covers the V-panel 130 and the apertures 154, 156, and preferably such that the product 104 is positioned between cut lines 246, 252 and cut lines 294, 300.

Figure 4:
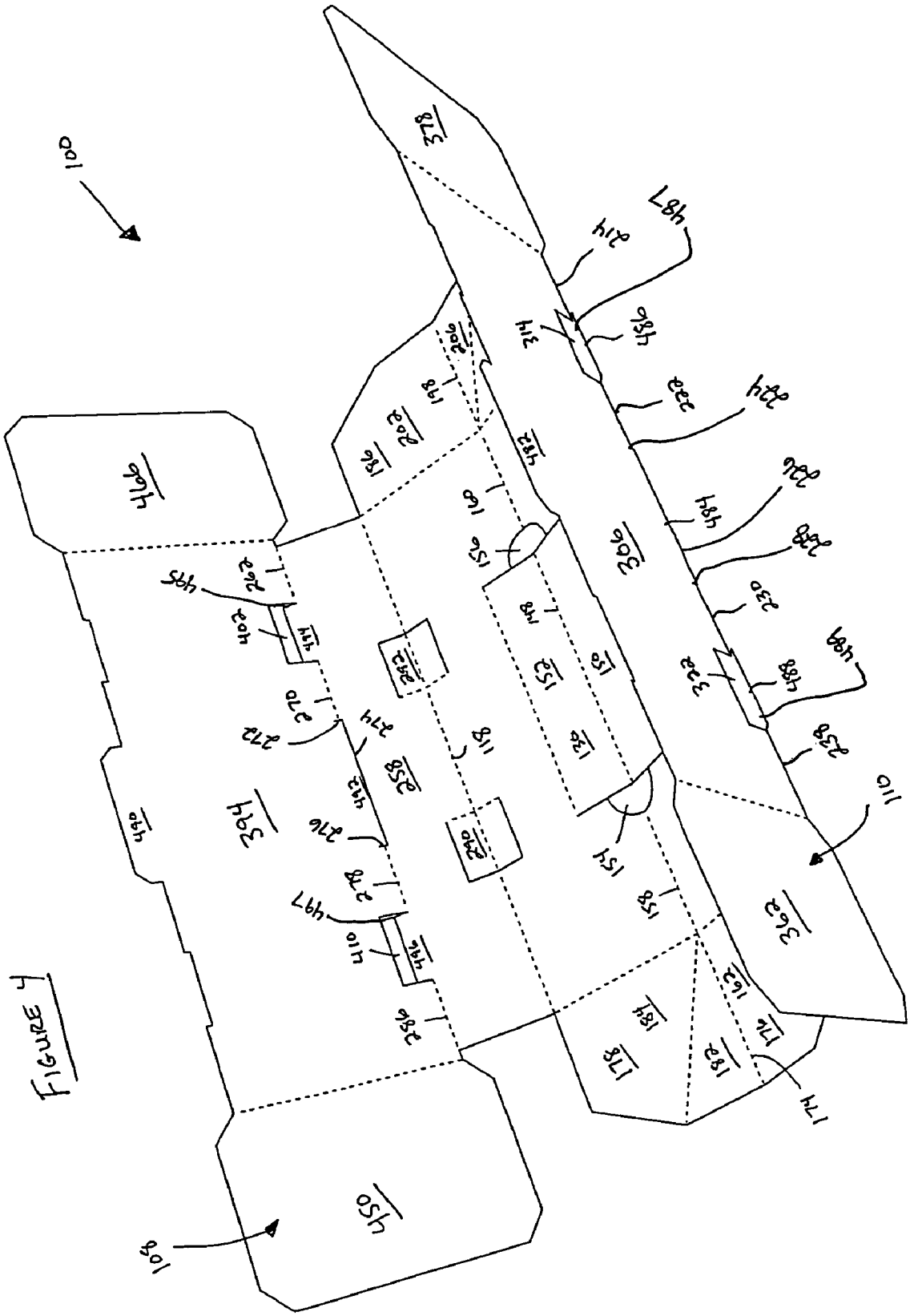

As illustrated in FIG. 4 (illustration of the product 104 in FIGS. 4-12 have been removed for clarity purposes, but it is to be understood that the product 104 is preferably in position as illustrated in FIG. 3 when the folding of the blank 100 occurs), the first intermediate panel 210 is folded upwardly relative to the base panel 112 along fold line 114 such that the first intermediate panel 210 is perpendicular to the base panel 112. The second intermediate panel 258 is folded upwardly relative to the base panel 112 along fold line 118 such that the second intermediate panel 258 is perpendicular to the base panel 112 and parallel to the first intermediate panel 210, with the top surface 108 of the second intermediate panel 258 facing the top surface 108 of the first intermediate panel 210.

Figure 5:
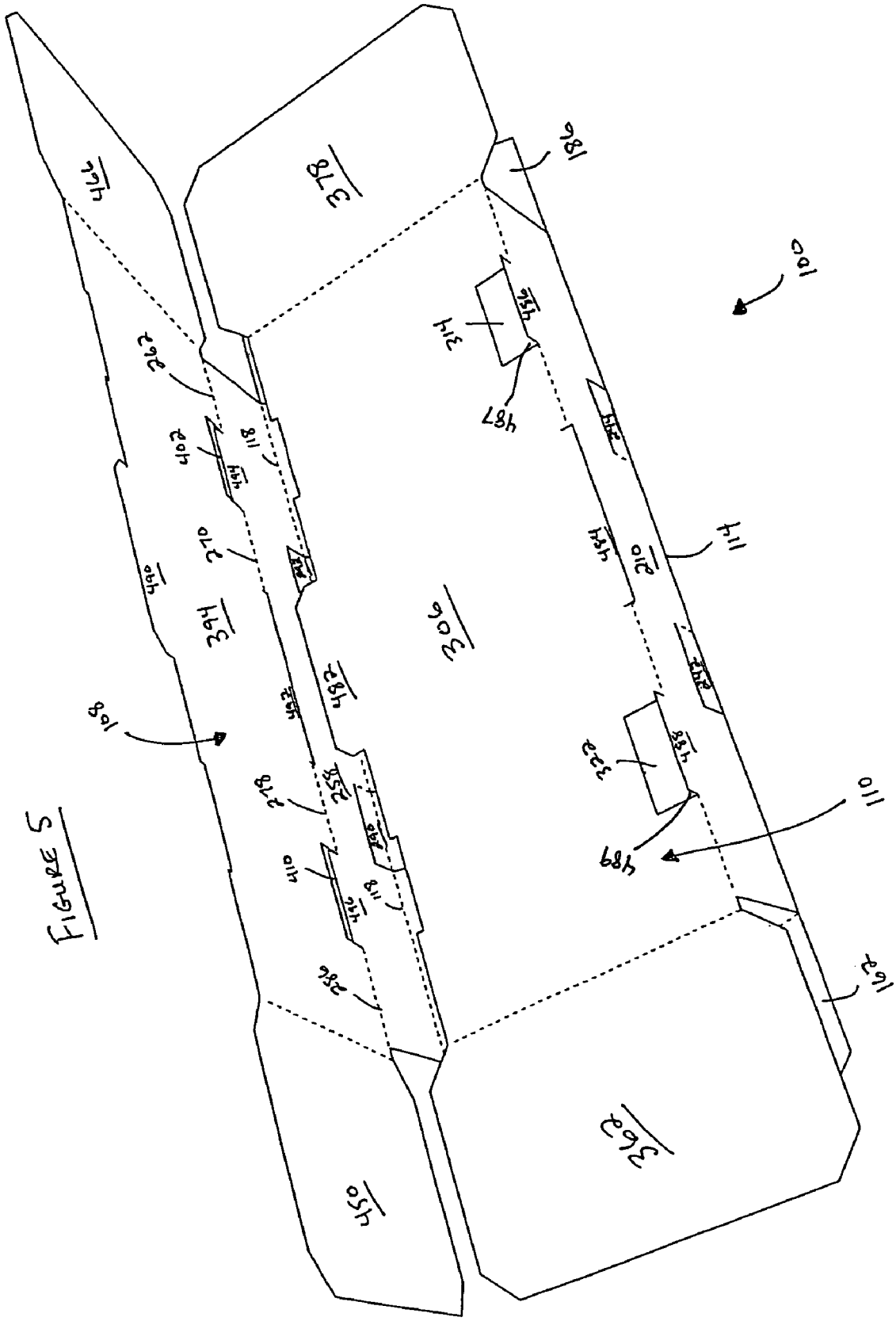

As illustrated in FIGS. 4 and 5, the first top panel 306 is folded downwardly relative to the first intermediate panel 210 along fold lines 214, 222, 230, 238 such that the first top panel 306 is perpendicular to the first intermediate panel 210 and parallel to the base panel 112, with the top surface 108 of the first top panel 306 facing the top surface 108 of the base panel 112. By folding the first top panel 306 relative to the first intermediate panel 210, the second tab member 484 is perpendicular to the first intermediate panel 210 and an aperture (not shown) is provided between the second tab member 484 and the cut lines 224, 226, 228. The aperture (not shown) is provided in the space where the second tab member 484 had previously been positioned in the blank 100. By folding the first top panel 306 relative to the first intermediate panel 210, the third and fourth tab members 486, 488 are perpendicular to the first top panel 306 and apertures 487, 489 are provided between the third and fourth tab members 486, 488 and the cut lines 216, 308, 310, 312, 220 and cut lines 232, 316, 318, 320, 236, respectively. The aperture 487 is provided in the space where the third tab member 486 had previously been positioned in the blank 100 and, is thus, in communication with aperture 314. The aperture 489 is provided in the space where the third tab member 488 had previously been positioned in the blank 100 and, is thus, in communication with aperture 322.

Figure 6:
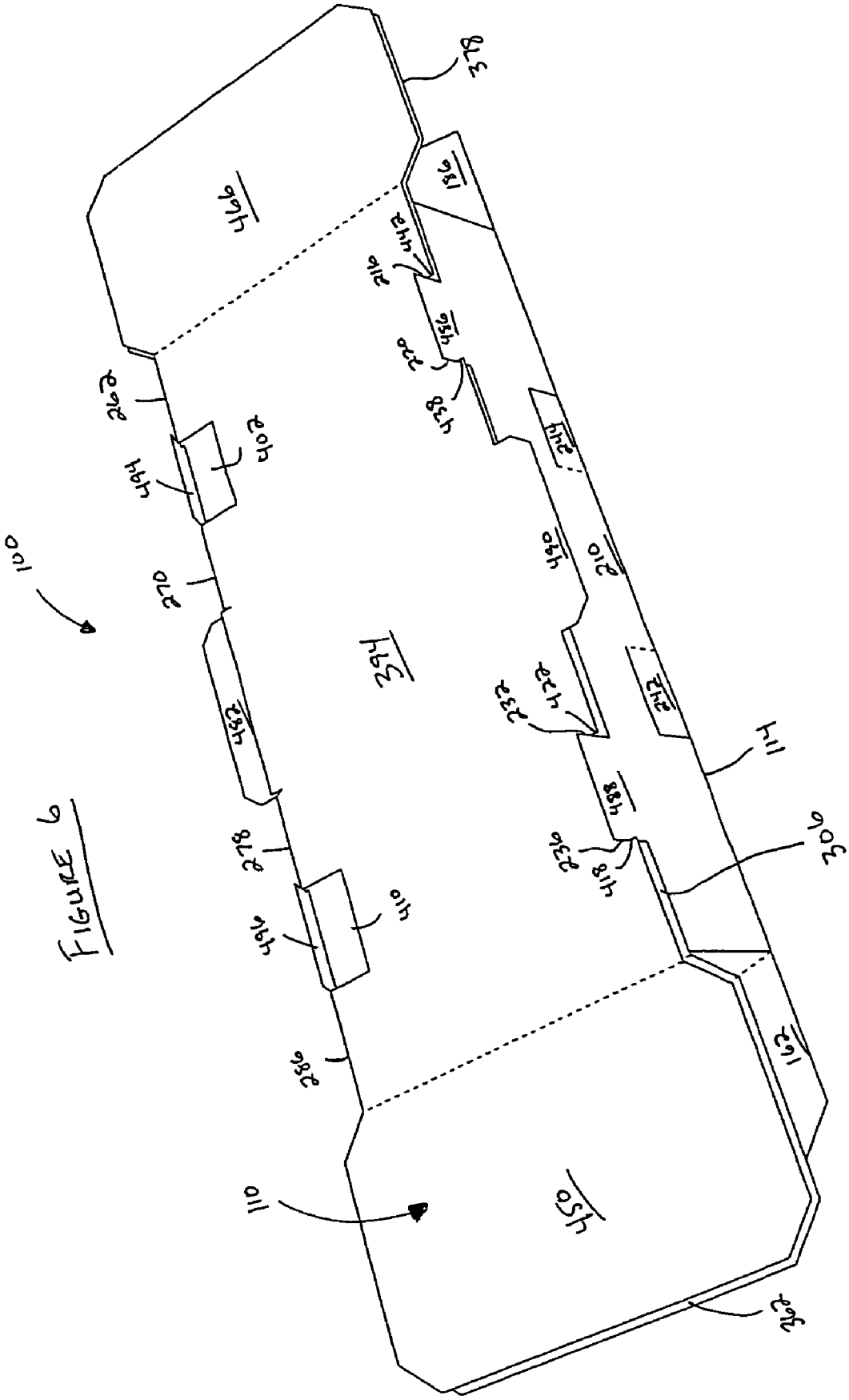

As illustrated in FIGS. 4-6, the second top panel 394 is folded downwardly relative to the second intermediate panel 258 along fold lines 262, 270, 278, 286 such that the second top panel 394 is perpendicular to the second intermediate panel 258 and parallel to the base panel 112 and the first top panel 306, with the top surface 108 of the second top panel 394 facing the bottom surface 110 of the first top panel 306. By folding the second top panel 394 relative to the second intermediate panel 258, the sixth tab member 492 is perpendicular to the second intermediate panel 258 and an aperture (not shown) is provided between the sixth tab member 492 and the cut lines 272, 274, 276. The aperture (not shown) is provided in the space where the sixth tab member 492 had previously been positioned in the blank 100. By folding the second top panel 394 relative to the second intermediate panel 258, the seventh and eighth tab members 494, 496 are perpendicular to the second top panel 394 and apertures 495, 497 are provided between the seventh and eighth tab members 494, 496 and the cut lines 264, 396, 398, 400, 268 and cut lines 280, 404, 406, 408, 284, respectively. The aperture 495 is provided in the space where the seventh tab member 494 had previously been positioned in the blank 100 and, is thus, in communication with aperture 402. The aperture 497 is provided in the space where the eighth tab member 496 had previously been positioned in the blank 100 and, is thus, in communication with aperture 410.

The first top panel 306 and the second top panel 394 are then moved in opposite directions, with the first top panel 306 moving toward the second intermediate panel 258 underneath the second top panel 394, and the second top panel 394 moving toward the first intermediate panel 210 above the first top panel 306. The first and second top panels 306, 394 are allowed to move in opposite directions because the base panel 112 is folded inwardly on itself along fold lines 148, 158, 160, the first side panel 162 is folded inwardly on itself along fold line 174, and the second side panel 186 is folded inwardly on itself along fold line 198.

As illustrated in FIG. 6, upon the first top panel 306 moving relative to the second top panel 394, the first tab member 482 is moved into and through the aperture (not shown—provided in the space where the sixth tab member 492 had previously been positioned in the blank 100) such that the first tab member 482 is generally secured within the aperture (not shown) by a friction fit. When the first tab member 482 is secured within the aperture (not shown), edge 338 generally engages cut line 276, edge 346 generally engages cut line 272, the top surface 108 of the first tab member 482 generally engages cut line 274, and the bottom surface 110 of the first tab member 482 generally engages the top surface 108 of the sixth tab member 492.

Also, as illustrated in FIG. 6, upon the first top panel 306 moving relative to the second top panel 394, the third tab member 486 is positioned perpendicular to the second top panel 394, with the cut line 216 generally engaging edge 442, the cut line 220 generally engaging edge 438, and the top surface 108 of the third tab member 486 generally engaging edge 440. Likewise, upon the first top panel 306 moving relative to the second top panel 394, the fourth tab member 488 is positioned perpendicular to the second top panel 394, with the cut line 232 generally engaging edge 422, the cut line 236 generally engaging edge 418, and the top surface 108 of the fourth tab member 488 generally engaging the edge 420. The third and fourth tab members 486, 488 also extend beyond the bottom surface 110 of the second top panel 394.

The seventh and eighth tab members 494, 496 are positioned perpendicular to the second top panel 394.

Further, as illustrated in FIG. 6, upon the first top panel 306 moving relative to the second top panel 394, the first end panel 362 is positioned below the third end panel 450 such that the bottom surface 110 of the first end panel 362 generally faces the top surface 108 of the third end panel 450. The first end panel 362 and the third end panel 450 are generally identical to one another such that the fold lines 326, 414 are co-planar, the edges 364, 452 are co-planar, the edges 366, 454 are co-planar, the edges 368, 456 are co-planar, the edges 370, 458 are co-planar, the edges 372, 460 are co-planar, the edges 374, 462 are co-planar, and the edges 376, 464 are co-planar. Likewise, upon the first top panel 306 moving relative to the second top panel 394, the second end panel 378 is positioned below the fourth end panel 466 such that the bottom surface 110 of the second end panel 378 faces the top surface 108 of the fourth end panel 466. The second end panel 378 and the fourth end panel 466 are generally identical to one another such that the fold lines 358, 446 are co-planar, the edges 380, 468 are co-planar, the edges 382, 470 are co-planar, the edges 384, 472 are co-planar, the edges 386, 474 are co-planar, the edges 388, 476 are co-planar, the edges 390, 478 are co-planar, and the edges 392, 480 are co-planar.

Figure 7:
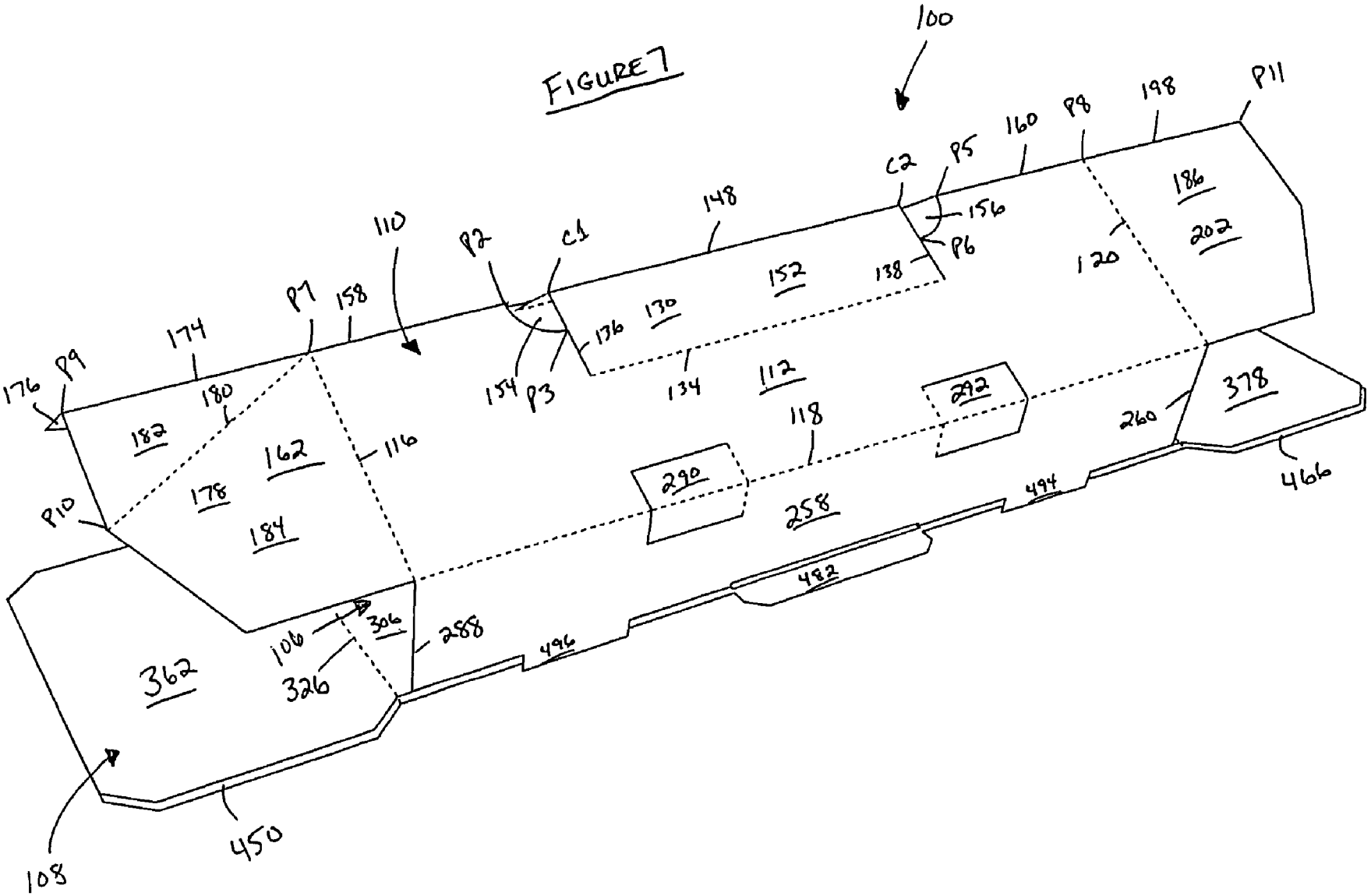

As illustrated in FIG. 7, if desired, the blank 100 can then be turned or flipped over such that the bottom surface 110 of the second top panel 394 and the third and fourth end panels 450, 466 face a working surface (not shown), such as a tabletop or the floor. The blank 100, as currently folded, generally has a cross-section which is five-sided or pentagonal in configuration. An opening 103 is thus provided through the folded blank 100, which is open at both ends of the opening 103 with the product 104 being positioned within the opening 103. It should be noted that, if desired, rather than placing the product 104 on the blank 100 prior to folding the blank 100, as illustrated in FIG. 3, the product 104 could conversely be inserted into the opening 103 from either end of the folded blank 100 at this point in time.

Figure 8:
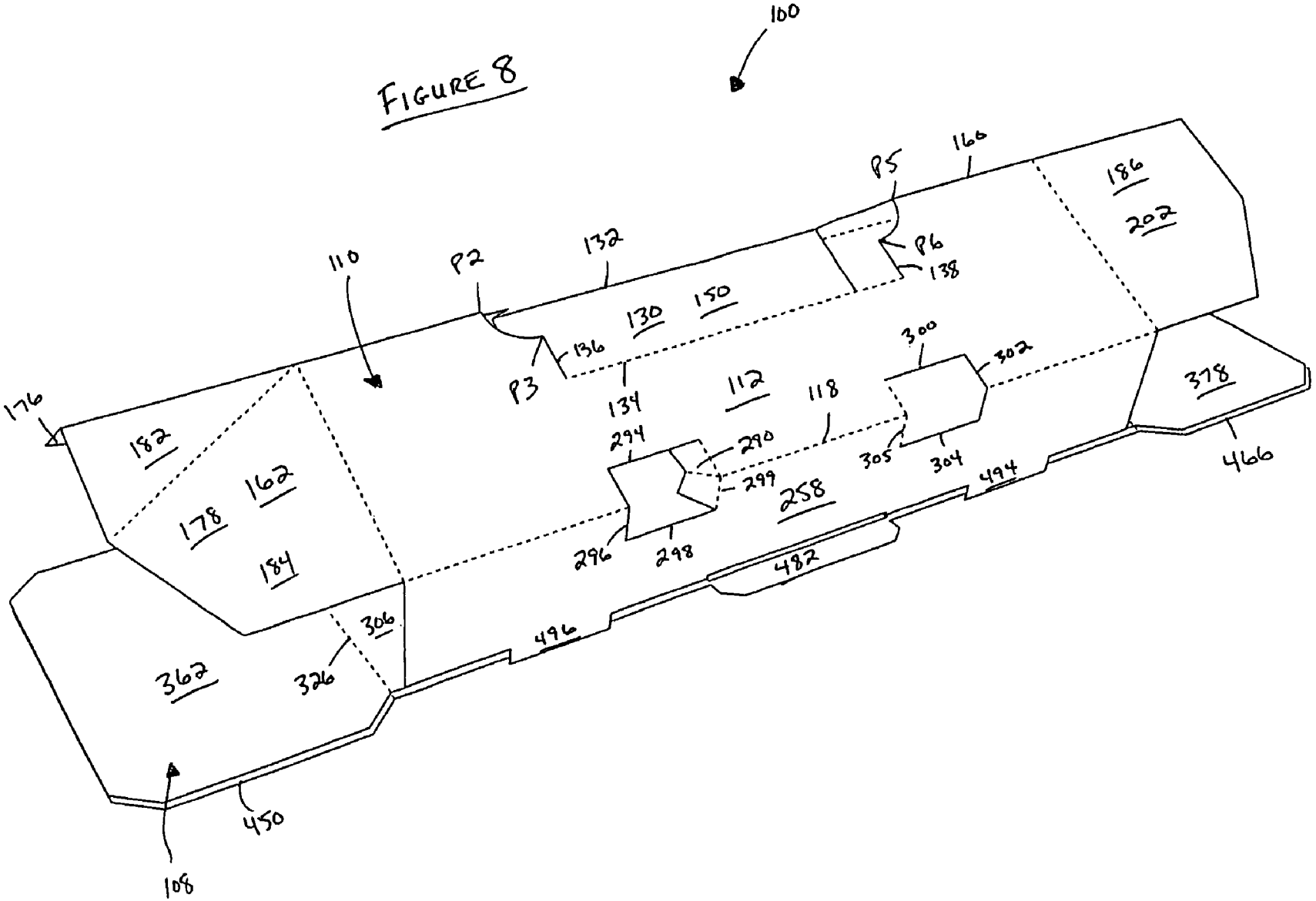

As illustrated in FIG. 8, if necessary, depending on the size and configuration of the product 104 wrapped and encapsulated within the blank 100, the first, second, third and fourth flap panels 242, 244, 290, 292 can be pushed and folded inwardly along fold lines 251, 257, 299, 305, respectively, toward the product 104 which is being wrapped and secured within the folded blank 100.

As illustrated in FIG. 8, if necessary, depending on the size and configuration of the product 104 wrapped within the blank 100, the V-panel 130 can be pushed and folded inwardly along fold lines 132, 134, 148 toward the product 104 which is being wrapped and secured within the folded blank 100 such that the bottom surface 110 of the first and second portions 150, 152 generally face one another.

Figure 9:
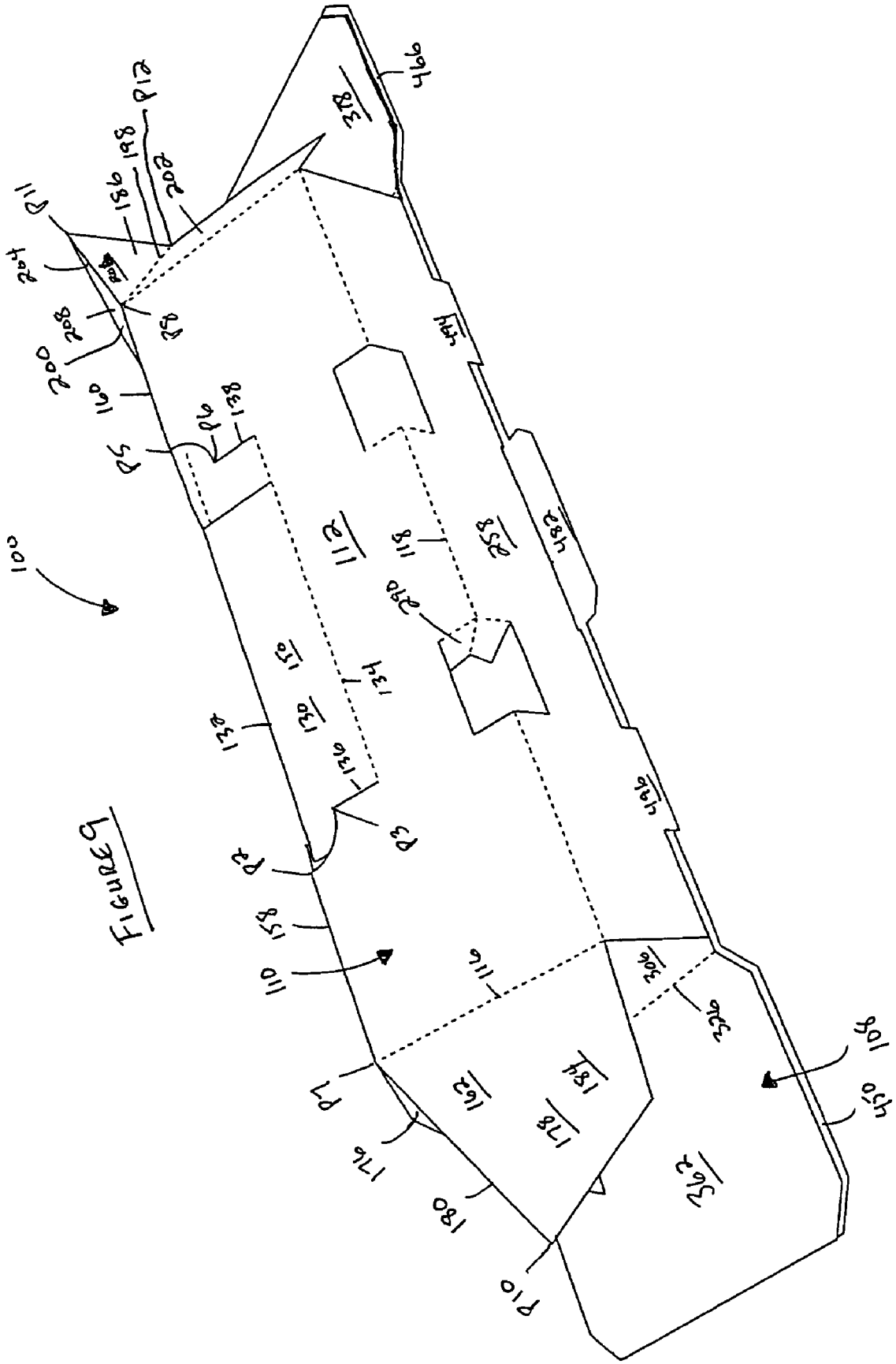

As illustrated in FIG. 9, the bellows panel 162 is folded into one end of the opening 103 in order to prevent the product 104 from moving out of the opening 103 through that end, and further to take up space between the end of the folded blank 100 and the product 104 positioned within the opening 103 of the folded blank 100. In order to fold the bellows panel 162, the bottom surface 110 of the first portion 176 of the bellows panel 162 is pushed such that the first portion 176 of the bellows panel 162 folds downwardly relative to the base panel 112 along fold line 116, and such that at least a portion of the edge 166 engages the top surface 108 of the first top panel 306. As the first portion 176 of the bellows panel 162 is folded downwardly, the first segment 182 of the second portion 178 of the bellows panel 162 is folded inwardly relative to the first portion 176 of the bellows panel 162 along fold line 174 and inwardly relative to the second segment 184 of the second portion 178 of the bellows panel 162 along bellows fold line 180. As the first segment 182 of the second portion 178 of the bellows panel 162 is folded inwardly, the second segment 184 of the second portion 178 of the bellows panel 162 is folded downwardly relative to the base panel 112 along fold line 116 until edge 170 engages the top surface 108 of the first top panel 306 proximate to edge 412 along fold line 414. The second segment 184 of the second portion 178 of the bellows panel 162 is thus positioned perpendicular to the first and second top panels 306, 394 and the first and third end panels 362, 450. As the second segment 184 is positioned perpendicular, the first portion 176 of the bellows panel 162 and the first segment 182 of the second portion 178 of the bellows panel 162 are thus folded further inwardly toward the product 104 within the folded blank 100. If desired, or if necessary to take up further space in the opening 103, the second segment 184 can be moved past perpendicular and into the opening 103, thus further moving the first segment 182 and the first portion 176 into the opening 103.

As illustrated in FIG. 9, the bellows panel 186 is folded into the other end of the opening 103 in order to prevent the product 104 from moving out of the opening 103 through that end, and further to take up space between the end of the folded blank 100 and the product 104 positioned within the opening 103 of the folded blank 100. In order to fold the bellows panel 186, the bottom surface 110 of the second portion 202 of the bellows panel 186 is pushed downwardly such that the second portion 202 of the bellows panel 186 folds downwardly relative to the base panel 112 along fold line 120, and such that at least a portion of the edge 194 engages the top surface 108 of the first top panel 306. As the second portion 202 of the bellows panel 186 is folded downwardly, the first segment 206 of the first portion 200 of the bellows panel 186 is folded inwardly relative to the second portion 202 of the bellows panel 186 along fold line 198 and inwardly relative to the second segment 208 of the first portion 200 of the bellows panel 186 along bellows fold line 204. As the first segment 206 of the first portion 200 of the bellows panel 186 is folded inwardly, the second segment 208 of the first portion 200 of the bellows panel 186 is folded downwardly relative to the base panel 112 along fold line 120 until edge 190 engages the top surface 108 of the first top panel 306 proximate to edge 444 along fold line 446. The second segment 208 of the first portion 200 of the bellows panel 186 is thus positioned perpendicular to the first and second top panels 306, 394 and the second and fourth end panels 378, 466. As the second segment 208 is positioned perpendicular, the second portion 202 of the bellows panel 186 and the first segment 206 of the first portion 200 of the bellows panel 186 are thus folded further inwardly toward the product 104 within the folded blank 100. If desired, or if necessary to take up further space in the opening 103, the second segment 208 can be moved past perpendicular and into the opening 103, thus further moving the first segment 206 and the second portion 202 into the opening 103.

It should be noted that the bellows panels 162, 186 could alternatively be folded into the opening 103 by first pushing on the second segments 184, 208 such that the second segments 184, 208 are positioned closer to the product 104 and the first portion 176 and the second portion 202 are positioned at the ends of the opening 103.

Figure 10:
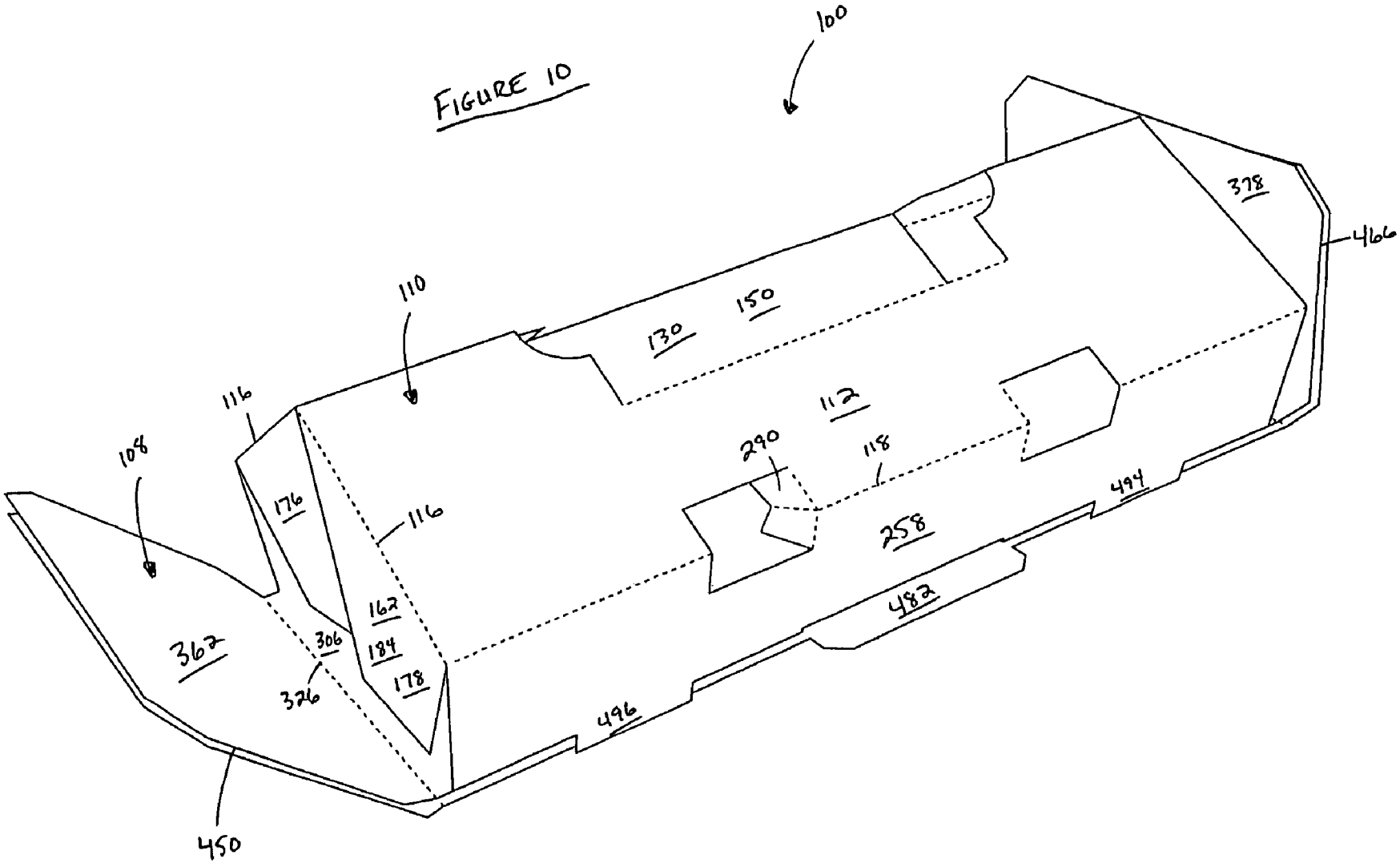

As illustrated in FIG. 10, the third end panel 450 is folded upwardly along fold line 414 such that the third end panel 450 is perpendicular to the second top panel 364. The edge 458 generally extends above where the fold line 158 is positioned on the base panel 112. By folding the third end panel 450 upwardly, the first end panel 362 is also folded upwardly along fold line 326 such that the first end panel 362 is perpendicular to the first top panel 306 and is parallel to the third end panel 450. The bottom surface 110 of the first end panel 362 faces the top surface 108 of the third end panel 450. The top surface 108 of the first end panel 362 faces the bottom surface 110 of the second segment 184 of the second portion 178 of the bellows panel 162. The edge 370 generally extends above where the fold line 158 is positioned on the base panel 112.

As illustrated in FIG. 10, the fourth end panel 466 is folded upwardly along fold line 446 such that the fourth end panel 466 is perpendicular to the second top panel 364. The edge 474 generally extends above where the fold line 160 is positioned on the base panel 112. By folding the fourth end panel 466 upwardly, the second end panel 378 is also folded upwardly along fold line 358 such that the second end panel 378 is perpendicular to the first top panel 306 and is parallel to the fourth end panel 466. The bottom surface 110 of the second end panel 378 faces the top surface 108 of the fourth end panel 466. The top surface 108 of the second end panel 378 faces the bottom surface 110 of the second segment 208 of the first portion 200 of the bellows panel 186. The edge 386 generally extends above where the fold line 160 is positioned on the base panel 112.

Figure 11:
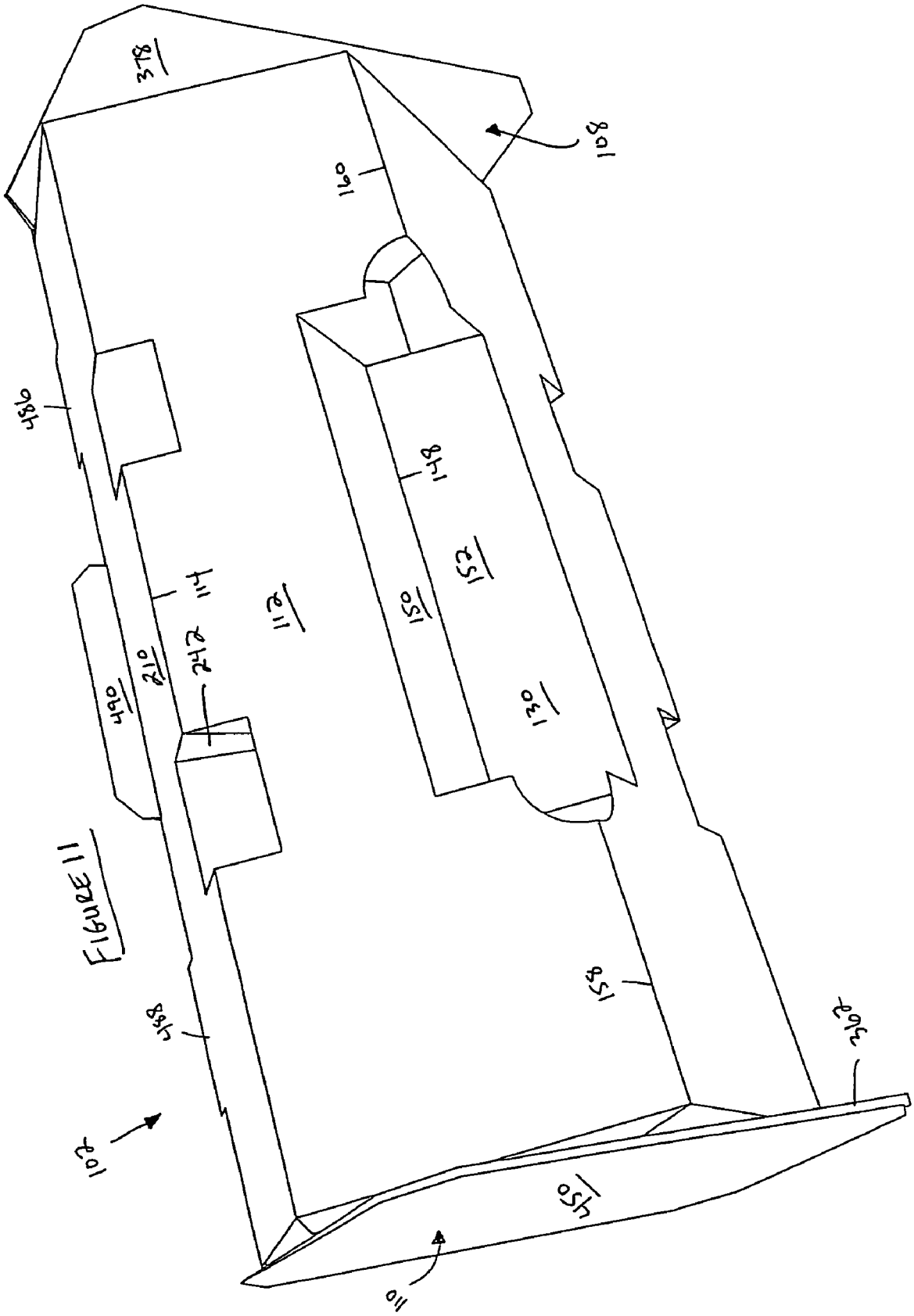
Figure 12:
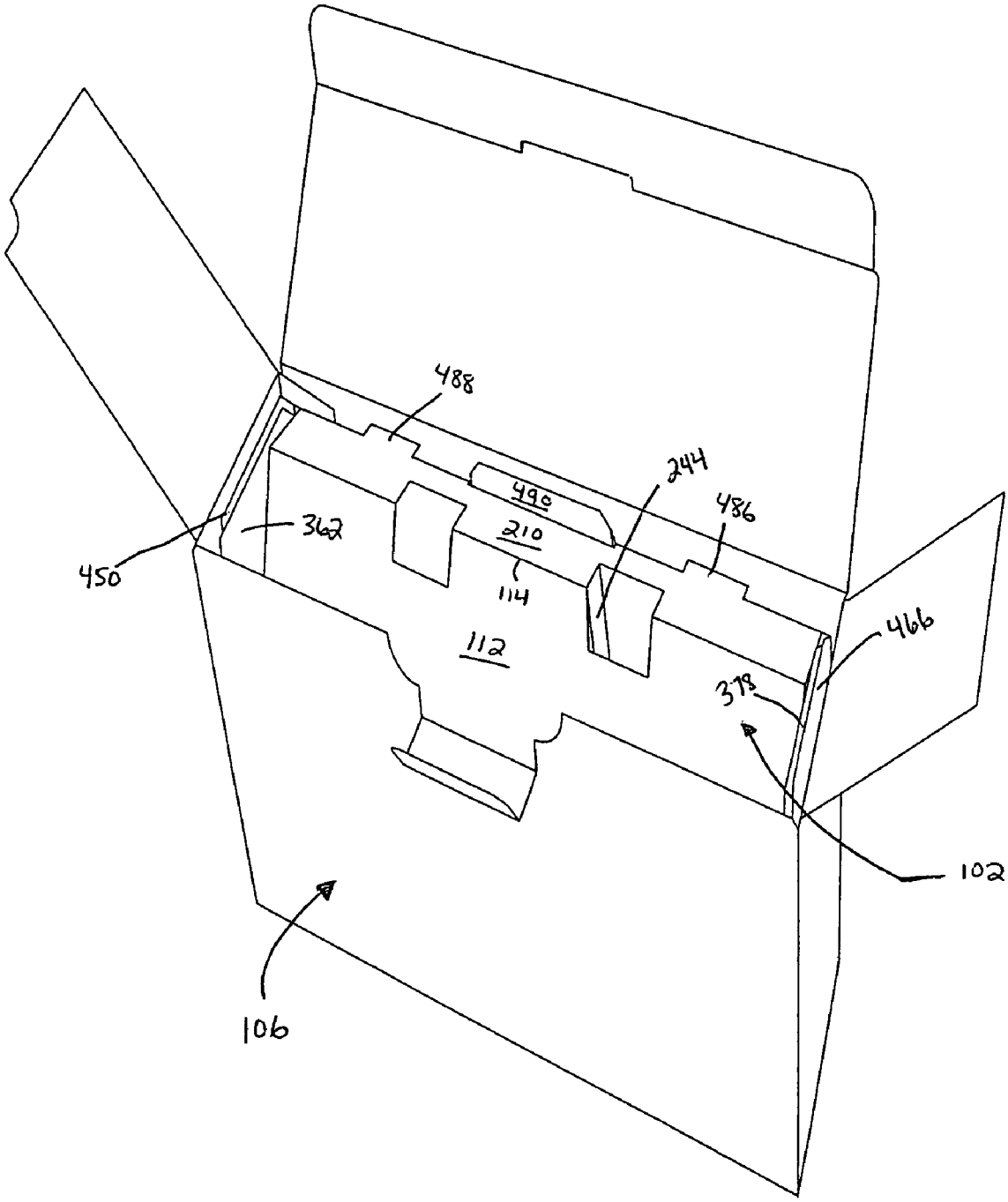
FIG. 12 is a perspective view of the first embodiment of the insert of the invention positioned within a shipping container.

The insert 102 is thus formed with the product 104 protected and secured therein. The insert 102 is best illustrated in FIG. 11. The insert 102 is rotated ninety (90) degrees to an upright position such that the edge 362 of the first end panel 362, the edge 382 of the second end panel 378, the edge 462 of the third end panel 450, and the edge 478 of the fourth end panel 466 are positioned against the working surface. Of course, it is to be understood that the insert 102 could also be rotated ninety (90) degrees to an upright position such that the edge 374 of the first end panel 362, the edge 390 of the second end panel 378, the edge 454 of the third end panel 450, and the edge 470 of the fourth end panel 466 are positioned against the working surface. The insert 102 is then inserted into the box or shipping container 106, as illustrated in FIG. 12, which is appropriately sized and configured to receive and secure the insert 102 therein, such that the bottom surface 110 of the first and second end panels 362, 378 face opposite sidewalls of the box 106.

When positioned within the box 106, the configuration of the insert 102 provides a number of air cells to further protect the product 104 within the insert 102. The edges 370, 386 of the first and second end panels 362, 378, respectively, create an air cell between the insert 102 and a side of the box 106. One or more of the tab member 490, the fold line 114, and the edges 366, 382, 462, 478 of the first, second, third and fourth end panels 362, 378, 450, 466, respectively, create an air cell between the insert 102 and either a top or bottom of the box 106. Likewise, one or more of the tab member 482, the fold line 118, and the edges 374, 390, 454, 470 of the first, second, third and fourth end panels 362, 378, 450, 466, respectively, create an air cell between the insert 102 and either a top or bottom of the box 106. The closing off of the ends of the opening 103 by the bellows panels 162, 186 and the first, second, third and fourth end panels 362, 378, 450, 466 further protect the product 104.

Figure 13:
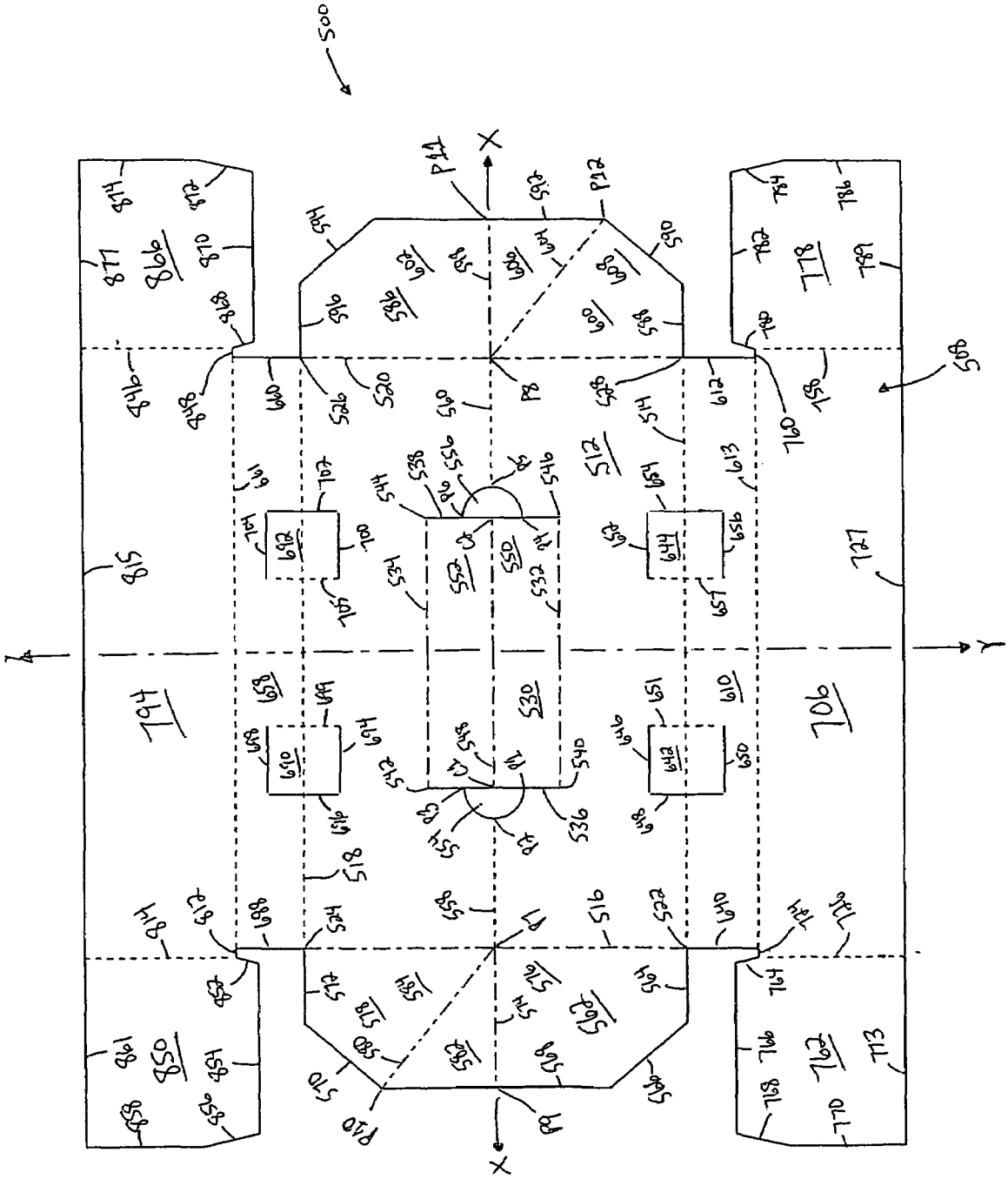
FIG. 13 is a top plan view of the blank used to form a second embodiment of the insert of the invention.
Figure 14:
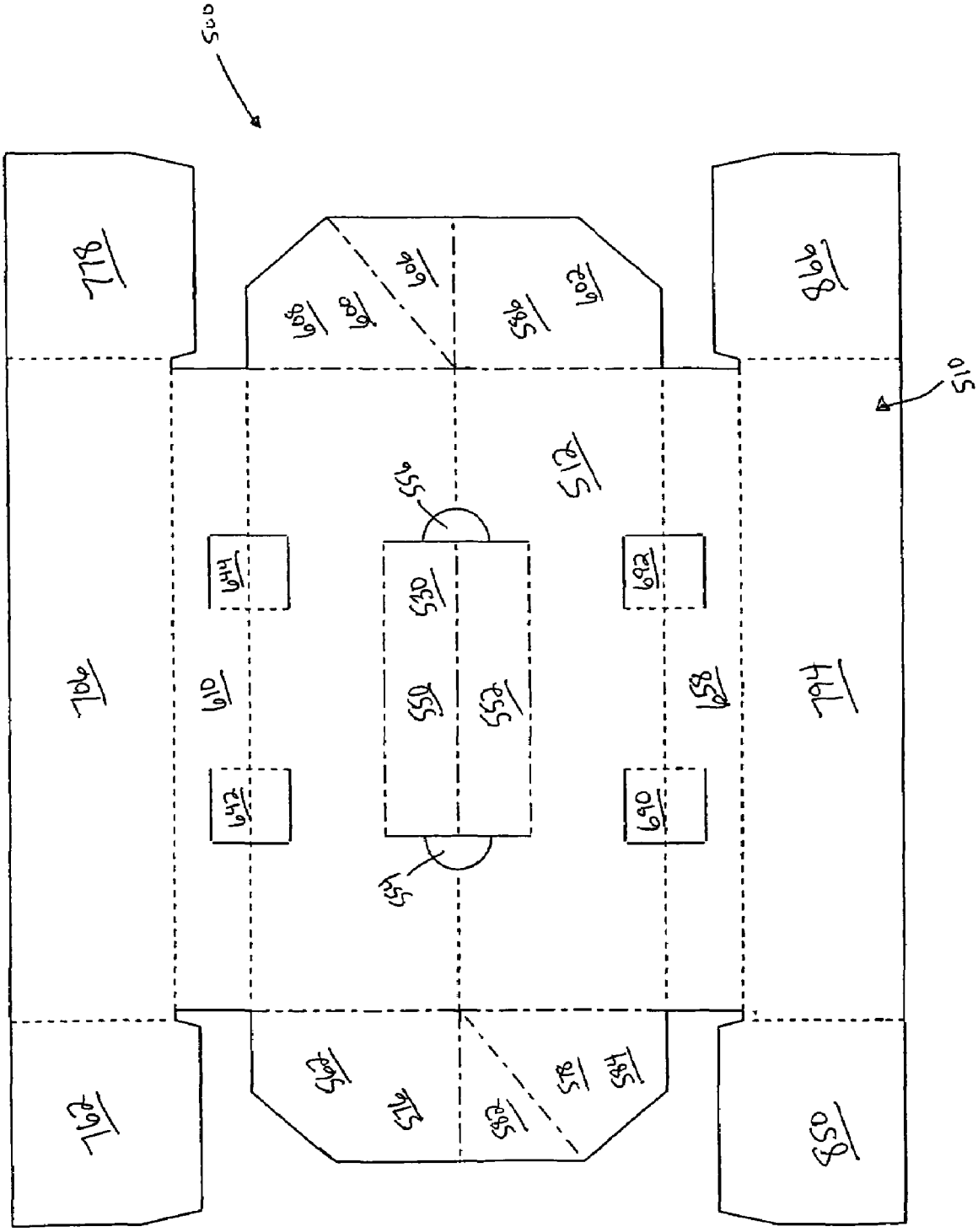
FIG. 14 is a bottom plan view of the blank used to form the second embodiment of the insert of the invention.

Attention is directed to the second embodiment of the insert 502 where FIGS. 13 and 14 illustrate a blank 500 which may be folded to form the insert 502 for receiving, protecting and securing a product 504, such as a toner cartridge. The insert 502 with the product 504 secured therein, can then be inserted into a shipping container, carton or box 506, such as the one illustrated in FIG. 23, for shipping and storage. The blank 500 is preferably formed of corrugated fibreboard. The blank 500 has a top surface 508, which is illustrated in FIG. 13, and a bottom surface 510, which is illustrated in FIG. 14.

A horizontal centerline X-X is provided in FIG. 13. It is to be understood that hereinafter in the description of the blank 500, which is provided below the horizontal centerline X-X as viewed in FIG. 13, that the terms "upward" and/or "upwardly" or similar will be used to describe elements, such as fold lines, cut lines and edges, which extend toward the horizontal centerline X-X, and that the terms "downward" and/or "downwardly" or similar will be used to describe elements, such as fold lines, cut lines or edges, which extend away from the horizontal centerline X-X. It is further to be understood that hereinafter in the description of the blank 500, which is provided above the horizontal centerline X-X as viewed in FIG. 13, that the terms "upward" and/or "upwardly" or similar will be used to describe elements, such as fold lines, cut lines and edges, which extend away from the horizontal centerline X-X, and that the terms "downward" and/or "downwardly" or similar will be used to describe elements, such as fold line, cut lines or edges, which extend toward the horizontal centerline X-X.

A vertical centerline Y-Y is provided in FIG. 13. It is to be understood that hereinafter in the description of the blank 500 that the terms "outward" and/or "outwardly" or similar will be used to describe elements, such as fold lines, cut lines and edges, which extend away from the vertical centerline Y-Y. It is further to be understood that hereinafter in the description of the blank 500 that the terms "inward" and/or "inwardly" or similar will be used to describe elements, such as fold lines, cut lines and edges, which extend toward the vertical centerline Y-Y.

The blank 500 has a base panel 512 which is generally rectangular in configuration. The base panel 512 is defined by fold lines 514, 516, 518, 520. Fold line 514 extends a distance of twelve (12) inches. Fold line 516 extends a distance of seven and seven-eighths (7.875) inches. Fold line 518 extends a distance of twelve (12) inches. Fold line 520 extends a distance of seven and seven-eighths (7.875) inches.

Fold line 514 is perpendicular to fold line 516. Fold lines 514, 516 meet to define a first corner 522 of the base panel 512. Fold line 516 is perpendicular to fold line 518. Fold lines 516, 518 meet to define a second corner 524 of the base panel 512. Fold line 518 is perpendicular to fold line 520. Fold lines 518, 520 meet to define a third corner 526 of the base panel 512. Fold line 520 is perpendicular to fold line 514. Fold lines 520, 514 meet to define a fourth corner 528 of the base panel 512. Fold lines 514, 518 are opposite and parallel to one another. Fold lines 516, 520 are opposite and parallel to one another.

The base panel 512 has a V-panel 530 provided thereon. The V-panel 530 is generally rectangular in configuration. The V-panel 530 is defined by fold lines 532, 534 and cut lines 536, 538. Fold lines 532, 534 extend a distance of five and a half (5.5) inches. Cut lines 536, 538 extend a distance of two and three-fourths (2.75) inches.

Fold line 532 is perpendicular to cut line 536. Fold line 532 and cut line 536 meet to define a first corner 540 of the V-panel 530. Cut line 536 is perpendicular to fold line 534. Cut line 536 and fold line 534 meet to define a second corner 542 of the V-panel 530. Fold line 534 is perpendicular to cut line 538. Fold line 534 and cut line 538 meet to define a third corner 544 of the V-panel 530. Cut line 538 is perpendicular to fold line 532. Cut line 538 and fold line 532 meet to define a fourth corner 546 of the V-panel 530. Fold lines 532, 534 are opposite and parallel to one another. Cut lines 536, 538 are opposite and parallel to one another.

Fold line 532 is parallel to fold line 514. Fold line 532 is positioned two and nine-sixteenths (2.5625) inches from fold line 514. Fold line 534 is parallel to fold line 518. Fold line 534 is positioned two and nine-sixteenths (2.5625) inches from fold line 518. Cut line 536 is parallel to fold line 516. Cut line 536 is positioned three and one-fourth (3.25) inches from fold line 516. Cut line 538 is parallel to fold line 520. Cut line 538 is positioned three and one-fourth (3.25) inches from fold line 520.

V-panel 530 has a fold line 548 which extends from cut line 536 to cut line 538. Fold line 548 is parallel to fold lines 532, 534 and is positioned one and three-eighths (1.375) inches from fold line 532 and one and three-eighths (1.375) inches from fold line 534. The fold line 548 separates the V-panel 530 into a first portion 550 and a second portion 552. The first portion 550 of the V-panel 530 is defined by the fold line 532, the cut line 536, the fold line 548, and the cut line 538. The second portion 552 of the V-panel 530 is defined by the fold line 548, the cut line 536, the fold line 534, and the cut line 538.

The base panel 512 has a pair of apertures 554, 556 provided therethrough. The apertures 554, 556 are preferably in the shape of semi-circles, although the apertures 554, 556 could have other configurations if desired.

Semi-circular aperture 554 has a radius of five-eighths (0.625) inches with the center C1 being defined by the position where the fold line 548 meets the cut line 536. The semi-circular aperture 554 thus starts along the cut line 536, five-eighths (0.625) inches below the fold line 548, at a point P1, curves outwardly and upwardly toward the fold line 516 until it reaches point P2, which is planar with the fold line 548, and then curves inwardly and upwardly toward the cut line 536, until it reaches point P3, which is positioned five-eighths (0.625) inches above the fold line 548.

Semi-circular aperture 556 has a radius of five-eighths (0.625) inches with the center C2 being defined by the position where the fold line 548 meets the cut line 538. The semi-circular aperture 556 thus starts along the cut line 538, five-eighths (0.625) inches below the fold line 548, at a point P4, curves outwardly and upwardly toward the fold line 520 until it reaches point P5, which is planar with the fold line 548, and then curves inwardly and upwardly toward the cut line 538 until it reaches point P6, which is positioned five-eighths (0.625) inches above the fold line 548.

Base panel 512 has a fold line 558 which extends from point P2 to a point P7 on the fold line 516. Fold line 558 is parallel to fold lines 514, 518 and is co-planar with fold line 548. Fold line 558 is positioned three and fifteen-sixteenths (3.9375) inches from fold line 514 and three and fifteen-sixteenths (3.9375) inches from fold line 518, such that point P7 is positioned three and fifteen-sixteenths (3.9375) inches from corner 522 and three and fifteen-sixteenths (3.9375) inches from corner 524. A distance between point P2 and point P7 is two and five-eighths (2.625) inches.

Base panel 512 has a fold line 560 which extends from point P5 to a point P8 on the fold line 520. Fold line 560 is parallel to fold lines 514, 518 and is co-planar with fold line 548. Fold line 560 is positioned three and fifteen-sixteenths (3.9375) inches from fold line 514 and three and fifteen-sixteenths (3.9375) inches from fold line 518, such that point P8 is positioned three and fifteen-sixteenths (3.9375) inches from corner 528 and three and fifteen-sixteenths (3.9375) inches from corner 526. A distance between point P5 and point P8 is two and five-eighths (2.625) inches.

The blank 512 has a first side or bellows panel 562 which is generally hexagonal in configuration. The first side panel 562 is defined by edges 564, 566, 568, 570, 572 and fold line 516.

Edge 564 extends outwardly from corner 522 of the base panel 512 such that edge 564 is perpendicular to fold line 516 and co-planar with fold line 514. Edge 572 extends outwardly from corner 524 of the base panel 512 such that edge 572 is perpendicular to fold line 516 and co-planar with fold line 518. Edge 564 and edge 572 are parallel to one another and are positioned seven and seven-eighths (7.875) inches apart from one another. Edge 566 extends angularly outwardly and upwardly from edge 564 to edge 568. Edge 570 extends angularly outwardly and downwardly from edge 572 to edge 568. Edge 568 is parallel to fold line 516.

First side panel 562 has a fold line 574 which extends from point P7 to a point P9 on edge 568. Fold line 574 is parallel to edges 564, 572 and is co-planar with fold line 568. Fold line 574 is positioned three and fifteen-sixteenths (3.9375) inches from edge 564 and three and fifteen-sixteenths (3.9375) inches from edge 572. The fold line 574 separates the first side panel 562 into a first portion 576 and a second portion 578. The first portion 576 of the first side panel 562 is generally pentagonal and is defined by the edge 564, the edge 566, the edge 568, the fold line 574, and the fold line 516. The second portion 578 of the first side panel 562 is generally pentagonal and is defined by the edge 572, the edge 570, the edge 568, the fold line 574, and the fold line 516.

The second portion 578 of the first side panel 562 has a fold line 580, which is a bellows fold line, which extends angularly from point P7 to a point P10, which is the point where edge 568 and edge 570 meet, a distance of three and eleven-sixteenths (3.6875) inches. An angle between the bellows fold line 580 and the edge 570 is ninety (90) degrees. An angle between the bellows fold line 580 and fold line 116 is fifty (50) degrees. The bellows fold line 580 separates the second portion 578 of the first side panel 562 into a first segment 582 and a second segment 584. The first segment 582 of the second portion 578 of the first side panel 562 is generally triangular and is defined by the fold line 574, the edge 568, and the bellows fold line 580. The second segment 584 of the second portion 578 of the first side panel 562 is generally quadrilateral and is defined by the bellows fold line 580, the edge 570, the edge 572, and the fold line 516.

The blank 500 has a second side or bellows panel 586 which is generally hexagonal in configuration. The second side panel 586 is defined by edges 588, 590, 592, 594, 596 and fold line 520.

Edge 588 extends outwardly from corner 528 of the base panel 512 such that edge 588 is perpendicular to fold line 520 and co-planar with fold line 514. Edge 596 extends outwardly from corner 526 of the base panel 512 such that edge 596 is perpendicular to fold line 520 and co-planar with fold line 518. Edge 588 and edge 596 are parallel to one another and are positioned seven and seven-eighths (7.875) inches apart from one another. Edge 590 extends angularly outwardly and downwardly from edge 596 to edge 592. Edge 594 extends angularly outwardly and downwardly from edge 596 to edge 592. Edge 592 is parallel to fold line 520.

Second side panel 586 has a fold line 598 which extends from point P8 to a point P11 on edge 592. Fold line 598 is parallel to edges 588, 596 and is co-planar with fold line 560. Fold line 598 is positioned three and fifteen-sixteenths (3.9375) inches from edge 588 and three and fifteen-sixteenths (3.9375) inches from edge 596. The fold line 598 separates the second side panel 586 into a first portion 600 and a second portion 602. The first portion 600 of the second side panel 586 is generally pentagonal and is defined by the edge 588, the edge 590, the edge 592, the fold line 598, and the fold line 520. The second portion 602 of the second side panel 586 is generally pentagonal and is defined by the edge 596, the edge 594, the edge 592, the fold line 598, and the fold line 520.

The first portion 600 of the second side panel 586 has a fold line 604, which is a bellows fold line, which extends angularly from point P8 to a point P12, which is the point where edge 590 and edge 592 meet, a distance of three and eleven-sixteenths (3.6875) inches. An angle between bellows fold line 604 and edge 590 is ninety (90) degrees. An angle between bellows fold line 604 and fold line 520 is fifty (50) degrees. The bellows fold line 604 separates the first portion 600 of the second side panel 586 into a first segment 606 and a second segment 608. The first segment 606 of the first portion 600 of the second side panel 686 is generally triangular and is defined by the fold line 598, the edge 592, and the bellows fold line 604. The second segment 608 of the first portion 600 of the second side panel 586 is generally quadrilateral and is defined by the bellows fold line 604, the edge 590, the edge 588, and the fold line 520.

The blank 500 has a first intermediate panel 610 which is generally rectangular in configuration. The first intermediate panel 610 is defined by fold line 514, edge 612, fold line 613, and edge 640.

Edge 612 extends downwardly from corner 528 of the base panel 512 to fold line 613 such that edge 612 is perpendicular to fold line 613 and co-planar with fold line 520. Edge 612 extends a distance of one and seven-sixteenths (1.4375) inches.

Fold line 613 extends inwardly from edge 612 toward the centerline Y-Y and then away from the centerline Y-Y to edge 640 such that fold line 613 is perpendicular to edge 612 and opposite and parallel to fold line 614. Fold line 613 extends a distance of twelve (12) inches.

Edge 640 extends upwardly from fold line 613 to corner 522 of the base panel 512 such that edge 640 is perpendicular to fold lines 514, 613, co-planar with fold line 516, and opposite and parallel to edge 612. Edge 640 extends a distance of one and seven-sixteenths (1.4375) inches.

The blank 500 has first and second flap panels 642, 644 which are generally rectangular in configuration. The first flap panel 642 is defined by cut lines 646, 648, 650 and fold line 651. Cut line 648 is perpendicular to, and bisected by, fold line 514 at a position which is three and one-eighth (3.125) inches from corner 522 and eight and seven-eighths (8.875) inches from corner 528. Cut line 648 extends a distance of one and one-half (1.5) inches and because cut line 648 is bisected by fold line 514, cut line 648 extends upwardly a distance of three-quarters (0.75) inches from fold line 514 into the base panel 512 and downwardly a distance of three-quarts (0.75) inches from fold line 514 into the first intermediate panel 610. Cut line 646 is provided in the base panel 512 and extends inwardly from cut line 648 to fold line 651 for a distance of one and three-eighths (1.375) inches. Cut line 646 is perpendicular to cut line 648. Cut line 650 is provided in the first intermediate panel 610 and extends inwardly from cut line 648 to fold line 651 for a distance of one and three-eighths (1.375) inches. Cut line 650 is perpendicular to cut line 648 and is parallel to cut line 646. Fold line 651 extends downwardly from cut line 646 to cut line 650. Fold line 651 is perpendicular to, and bisected by, fold line 514 at a position which is four and one-half (4.5) inches from corner 522 and seven and one-half (7.5) inches from corner 528. Fold line 651 is perpendicular to cut lines 646, 650 and is parallel to cut line 648. Fold line 651 extends a distance of one and one-half (1.5) inches and because fold line 651 is bisected by fold line 514, fold line 651 extends upwardly a distance of three-quarters (0.75) inches from fold line 514 into the base panel 512 and downwardly a distance of three-quarters (0.75) inches from fold line 514 into the first intermediate panel 610. The fold line 514 extends through the first flap panel 642.

The second flap panel 644 is defined by cut lines 652, 654, 656 and fold line 657. Cut line 654 is perpendicular to, and bisected by, fold line 514 at a position which is three and one-eighth (3.125) inches from corner 528 and eight and seven-eighths (8.875) inches from corner 522. Cut line 654 extends a distance of one and one-half (1.5) inches and because cut line 654 is bisected by fold line 514, cut line 654 extends upwardly a distance of three-quarters (0.75) inches from fold line 514 into the base panel 512 and downwardly a distance of three-quarters (0.75) inches from fold line 514 into the first intermediate panel 610. Cut line 652 is provided in the base panel 512 and extends inwardly from cut line 654 to fold line 657 for a distance of one and three-eighths (1.375) inches. Cut line 652 is perpendicular to cut line 654 and is co-planar with cut line 646. Cut line 656 is provided in the first intermediate panel 610 and extends inwardly from cut line 654 to fold line 657 for a distance of one and three-eighths (1.375) inches. Cut line 656 is perpendicular to cut line 654, parallel to cut line 652, and is co-planar with cut line 650. Fold line 657 extends downwardly from cut line 652 to cut line 656. Fold line 657 is perpendicular to, and bisected by, fold line 514 at a position which is four and one-half (4.5) inches from corner 528 and seven and one-half (7.5) inches from corner 522. Fold line 657 is perpendicular to cut lines 652, 656 and is parallel to cut line 654. Fold line 657 extends a distance of one and one-half (1.5) inches and because fold line 657 is bisected by fold line 514, fold line 657 extends upwardly a distance of three-quarters (0.75) inches from fold line 514 into the base panel 512 and downwardly a distance of three-quarters (0.75) inches from fold line 514 into the first intermediate panel 610. The fold line 514 extends through the second flap panel 644.

The blank 500 has a second intermediate panel 658 which is generally rectangular in configuration. The second intermediate panel 658 is defined by fold line 518, edge 660, fold line 661, and edge 688.

Edge 660 extends upwardly from corner 526 of the base panel 512 to fold line 661 such that edge 660 is perpendicular to fold line 518 and co-planar with fold line 520. Edge 660 extends a distance of one and seven-sixteenths (1.4375) inches.

Fold line 661 extends inwardly from edge 660 to edge 688. Fold line 661 is perpendicular to edge 660 and is opposite and parallel to fold line 518. Fold line 661 extends a distance of twelve (12) inches.

Edge 688 extends downwardly from fold line 661 to fold line 518 at corner 524 of the base panel 512. Edge 688 is perpendicular to fold lines 518, 661, is opposite and parallel to edge 660, and is co-planar with fold line 516. Edge 688 extends a distance of one and seven-sixteenths (1.4375) inches. Edge 660 and edge 688 are positioned twelve (12) inches apart from one another.

The blank 500 has third and fourth flap panels 690, 692 which are generally rectangular in configuration. The third flap panel 690 is defined by cut lines 694, 696, 698 and fold line 699. Cut line 696 is perpendicular to, and bisected by, fold line 518 at a position which is three and one-eighth (3.125) inches from corner 524 and eight and seven-eighths (8.875) inches from corner 526. Cut line 696 is co-planar with cut line 648. Cut line 696 extends a distance of one and one-half (1.5) inches and because cut line 696 is bisected by fold line 518, cut line 696 extends downwardly a distance of three-quarters (0.75) inches from fold line 518 into the base panel 512 and upwardly a distance of three-quarters (0.75)

inches from fold line 518 into the second intermediate panel 658. Cut line 694 is provided in the base panel 512 and extends inwardly from cut line 696 to fold line 699 for a distance of one and three-eighths (1.375) inches. Cut line 694 is perpendicular to cut line 696. Cut line 698 is provided in the second intermediate panel 658 and extends inwardly from cut line 696 to fold line 699 for a distance of one and three-eighths (1.375) inches. Cut line 698 is perpendicular to cut line 696 and is parallel to cut line 694. Fold line 699 extends upwardly from cut line 694 to cut line 698. Fold line 699 is perpendicular to, and bisected by, fold line 518 at a position which is four and one-half (4.5) inches from corner 524 and seven and one-half (7.5) inches from corner 526. Fold line 699 is perpendicular to cut lines 694, 698, parallel to cut line 696, and is co-planar with fold line 651. Fold line 699 extends a distance of one and one-quarter (1.5) inches and because fold line 699 is bisected by fold line 518, fold line 699 extends downwardly a distance of three-quarters (0.75) inches from fold line 518 into the base panel 512 and upwardly a distance of three-quarters (0.75) inches from fold line 518 into the second intermediate panel 658. The fold line 518 extends through the third flap panel 690.

The fourth flap panel 692 is defined by cut lines 700, 702, 704 and fold line 705. Cut line 702 is perpendicular to, and bisected by, fold line 518 at a position which is three and one-eighth (3.125) inches from corner 526 and eight and seven-eighths (8.875) inches from corner 524. Cut line 702 is co-planar with cut line 654. Cut line 702 extends a distance of one and one-half (1.5) inches and because cut line 702 is bisected by fold line 518, cut line 702 extends downwardly a distance of three-quarters (0.75) inches from fold line 518 into the base panel 512 and upwardly a distance of three-quarters (0.75) inches from fold line 518 into the second intermediate panel 658. Cut line 700 is provided in the base panel 512 and extends inwardly from cut line 702 to fold line 705 for a distance of one and three-eighths (1.375) inches. Cut line 700 is perpendicular to cut line 702 and is co-planar with cut line 694. Cut line 704 is provided in the second intermediate panel 758 and extends inwardly from cut line 702 to fold line 705 for a distance of one and three-eighths (1.375) inches. Cut line 704 is perpendicular to cut line 702, parallel to cut line 700, and is co-planar with cut line 698. Fold line 705 extends upwardly from cut line 700 to cut line 704. Fold line 705 is perpendicular to, and bisected by, fold line 518 at a position which is four and one-half (4.5) inches from corner 526 and seven and one-half (7.5) inches from corner 524. Fold line 705 is perpendicular to cut lines 700, 704, parallel to cut line 702, and is co-planar to fold line 657. Fold line 705 extends a distance of one and one-half (1.5) inches and because fold line 705 is bisected by fold line 518, fold line 705 extends downwardly a distance of three-quarters (0.75) inches from fold line 518 into the base panel 512 and upwardly a distance of three-quarters (0.75) inches from fold line 518 into the second intermediate panel 658. The fold line 518 extends through the fourth flap panel 692.

The blank 500 has a first top panel 706 which is generally rectangular in configuration. The first top panel 706 is defined by fold line 613, edge 724, fold line 726, edge 727, fold line 758, and edge 760.

Edge 724 extends, from the corner defined by fold line 613 and edge 640, outwardly to fold line 726 such that edge 724 is perpendicular to edge 640 and is co-planar with fold line 613. Edge 724 extends a distance of three-sixteenths (0.1875) inches.

Fold line 726 extends downwardly from edge 724 to edge 727. Fold line 726 is perpendicular to edge 724 and is parallel to edge 640. Fold line 726 extends a distance of three and one-eighth (3.125) inches.

Edge 727 extends inwardly from fold line 726 to the centerline Y-Y and onto the fold line 758. Edge 727 is perpendicular to fold line 726 and is parallel to fold line 613. Edge 727 extends a distance of twelve and three-eighths (12.375) inches.

Fold line 758 extends upwardly from edge 727 to edge 760. Fold line 758 is perpendicular to edge 727 and opposite and parallel to fold line 726. Fold line 758 is positioned twelve and three-eighths (12.375) inches apart from fold line 726. Fold line 758 extends a distance of three and one-eighth (3.125) inches.

Edge 760 extends inwardly from fold line 758 to the corner defined by fold line 613 and edge 612, such that edge 760 is perpendicular to edge 612 and fold line 758, and is co-planar with fold line 613. Edge 760 extends a distance of three-sixteenths (0.1875) inches.

The blank 500 has a first end panel 762 which is generally hexagonal in configuration. The first end panel 762 is defined by fold line 726 and edges 764, 766, 768, 770, 773.

Edge 764 extends, from the corner defined by edge 724 and fold line 726, angularly outwardly and upwardly to edge 766.

Edge 766 extends outwardly from edge 764 to edge 768. Edge 766 is perpendicular to fold line 726 and is parallel to edge 724. Edge 766 is provided at a distance of fifteen-thirty-seconds (0.46875) inches above edge 724. Edge 766 extends a distance of three and one-half (3.5) inches.

Edge 768 extends angularly outwardly and downwardly from edge 766 to edge 770.

Edge 770 extends downwardly from edge 768 to edge 773. Edge 770 is perpendicular to edge 766 and is parallel to fold line 726. Edge 770 is provided at a distance of three and thirteen-sixteenths (3.8125) inches to the left of fold line 726. Edge 770 extends a distance of two and nineteen-thirty-seconds (2.59375) inches.

Edge 773 extends inwardly from edge 770 to the corner defined by fold line 726 and edge 727. Edge 773 is perpendicular to edge 770 and fold line 726, opposite and parallel to edge 766, and co-planar to edge 727. Edge 773 extends a distance of three and thirteen-sixteenths (3.8125) inches.

The blank 500 has a second end panel 778 which is generally hexagonal in configuration. The second end panel 778 is defined by fold line 758 and edges 780, 782, 784, 786, 789.

Edge 780 extends, from the corner defined by edge 760 and fold line 758, angularly outwardly and upwardly to edge 782.

Edge 782 extends outwardly from edge 780 to edge 784. Edge 782 is perpendicular to fold line 758 and is parallel to edge 760. Edge 782 is provided at a distance of fifteen-thirty-seconds (0.46875) inches above edge 760. Edge 782 extends a distance of three and one-half (3.5) inches.

Edge 784 extends angularly outwardly and downwardly from edge 782 to edge 786.

Edge 786 extends downwardly from edge 784 to edge 789. Edge 786 is perpendicular to edge 782 and is parallel to fold line 758. Edge 786 is provided at a distance of three and thirteen-sixteenths (3.8125) inches to the right of fold line 758. Edge 786 extends a distance of two and nineteen-thirty-seconds (2.59375) inches.

Edge 789 extends inwardly from edge 786 to the corner defined by fold line 758 and edge 727. Edge 789 is perpendicular to edge 786 and fold line 758, opposite and parallel to edge 782, and co-planar to edge 727. Edge 789 extends a distance of three and thirteen-sixteenths (3.8125) inches.

The blank 500 has a second top panel 794 which is generally rectangular in configuration. The first top panel 794 is defined by fold line 661, edge 812, fold line 814, edge 815, fold line 846, and edge 848.

Edge 812 extends, from the corner defined by fold line 661 and edge 688, outwardly to fold line 814 such that edge 812 is perpendicular to edge 688 and is co-planar with fold line 661. Edge 812 extends a distance of three-sixteenths (0.1875) inches.

Fold line 814 extends upwardly from edge 812 to edge 815. Fold line 814 is perpendicular to edge 812 and is parallel to edge 688. Fold line 814 extends a distance of three and one-eighth (3.125) inches.

Edge 815 extends inwardly from fold line 814 to the centerline Y-Y and onto the fold line 846. Edge 815 is perpendicular to fold line 814 and is parallel to fold line 661. Edge 815 extends a distance of twelve and three-eighths (12.375) inches.

Fold line 846 extends downwardly from edge 815 to edge 848. Fold line 846 is perpendicular to edge 815 and opposite and parallel to fold line 814. Fold line 846 is positioned twelve and three-eighths (12.375) inches apart from fold line 814. Fold line. 846 extends a distance of three and one-eighth (3.125) inches.

Edge 848 extends inwardly from fold line 846 to the corner defined by fold line 661 and edge 660, such that edge 848 is perpendicular to edge 660 and fold line 846, and is co-planar with fold line 661. Edge 848 extends a distance of three-sixteenths (0.1875) inches.

The blank 500 has a third end panel 850 which is generally hexagonal in configuration. The third end panel 850 is defined by fold line 814 and edges 852, 854, 856, 858, 861.

Edge 852 extends, from the corner defined by edge 812 and fold line 814, angularly outwardly and downwardly to edge 854.

Edge 854 extends outwardly from edge 852 to edge 856. Edge 854 is perpendicular to fold line 814 and is parallel to edge 812. Edge 854 is provided at a distance of fifteen-thirty-seconds (0.46875) inches below edge 812. Edge 854 extends a distance of three and one-half (3.5) inches.

Edge 856 extends angularly outwardly and upwardly from edge 854 to edge 858.

Edge 858 extends upwardly from edge 856 to edge 861. Edge 858 is perpendicular to edge 854 and is parallel to fold line 814. Edge 858 is provided at a distance of three and thirteen-sixteenths (3.8125) inches to the left of fold line 814. Edge 858 extends a distance of two and nineteen-thirty-seconds (2.59375) inches.

Edge 861 extends inwardly from edge 858 to the corner defined by fold line 814 and edge 815. Edge 861 is perpendicular to edge 858 and fold line 814, opposite and parallel to edge 854, and co-planar to edge 815. Edge 861 extends a distance of three and thirteen-sixteenths (3.8125) inches.

The blank 500 has a fourth end panel 866 which is generally hexagonal in configuration. The fourth end panel 866 is defined by fold line 846 and edges 868, 870, 872, 874, 877.

Edge 868 extends, from the corner defined by edge 848 and fold line 846, angularly outwardly and downwardly to edge 870.

Edge 870 extends outwardly from edge 848 to edge 872. Edge 870 is perpendicular to fold line 846 and is parallel to edge 848. Edge 870 is provided at a distance of fifteen-thirty-seconds (0.46875) inches below edge 848. Edge 870 extends a distance of three and one-half (3.5) inches.

Edge 872 extends angularly outwardly and upwardly from edge 870 to edge 874.

Edge 874 extends upwardly from edge 872 to edge 877. Edge 874 is perpendicular to edge 870 and is parallel to fold line 846. Edge 874 is provided at a distance of three and thirteen-sixteenths (3.8125) inches to the right of fold line 846. Edge 874 extends a distance of two and nineteen-thirty-seconds (2.59375) inches.

Edge 877 extends inwardly from edge 874 to the corner defined by fold line 846 and edge 815. Edge 877 is perpendicular to edge 874 and fold line 846, opposite and parallel to edge 870, and co-planar to edge 815. Edge 877 extends a distance of three and thirteen-sixteenths (3.8125) inches.

Attention is now directed to FIGS. 15-22 which illustrate the blank 500 being folded to form the insert 502 for receiving, protecting and securing the product 504, such as a toner cartridge.

Figure 15:
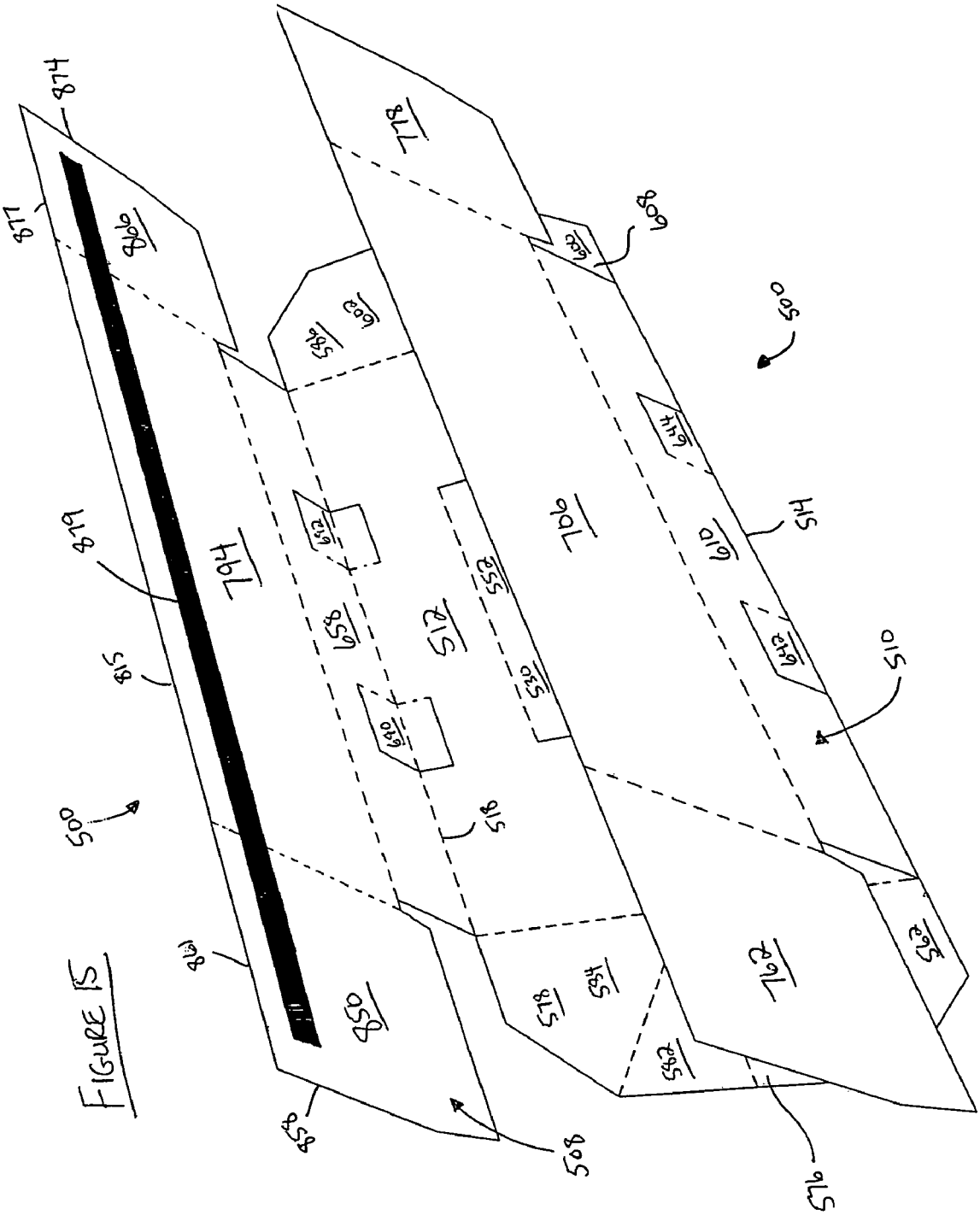
FIGS. 15-22 illustrate the method of folding the blank to form the second embodiment of the insert of the invention which secures a product therein.

As illustrated in FIG. 15, a strip of adhesive 879 is applied to the top surface 508 of the blank 500. The adhesive 879 is preferably glue, and could be applied in a manner other than as a strip, if desired, so long as the adhesive 879 applied is capable of performing the same function as the adhesive 879, as will be described herein. The adhesive 879 is applied on the top surface 508 of the blank 500 such that a first end of the adhesive 879 is provided proximate to the connection of the edges 858, 861 of the third end panel 850, and such that an opposite second end of the adhesive 879 is provided proximate to the connection of the edges 874, 877 of the fourth end panel 866. The adhesive 879 extends along the third end panel, the second top panel 794, and the fourth end panel 866 proximate to the edges 861, 815, 877, respectively.

As further illustrated in FIG. 15, the first intermediate panel 610 is folded upwardly relative to the base panel 512 along fold line 514 such that the first intermediate panel 610 is perpendicular to the base panel 512. The second intermediate panel 658 is folded upwardly relative to the base panel 512 along fold line 518 such that the second intermediate panel 658 is perpendicular to the base panel 512 and parallel to the first intermediate panel 610, with the top surface 608 and the strip of adhesive 879 facing the top surface 508 of the first intermediate panel 610.

Figure 16:
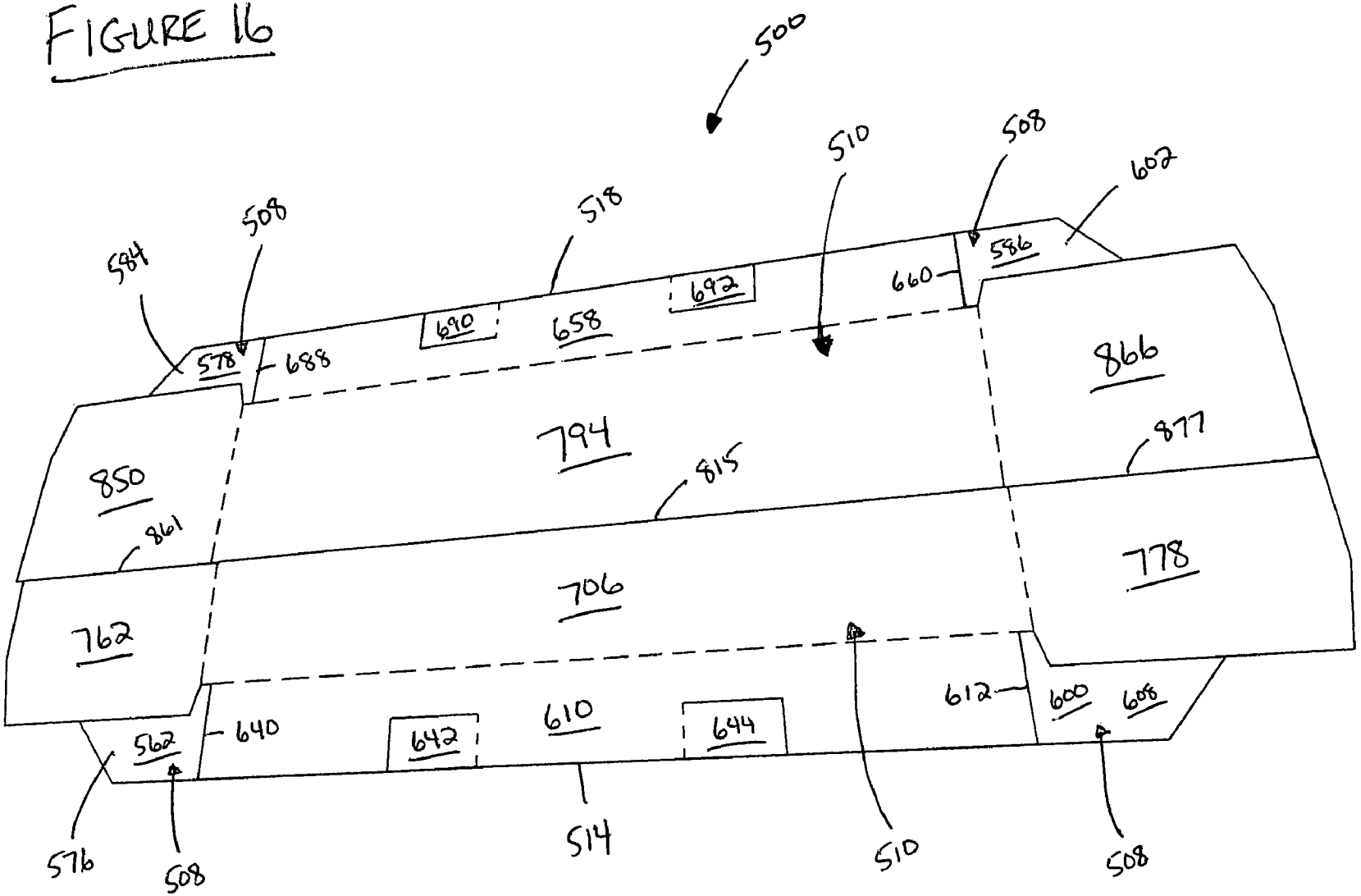

As illustrated in FIG. 16, the first intermediate panel 610 is folded downwardly from its perpendicular position along fold line 514 such that the first intermediate panel 610 and the first top panel 706 are parallel to, and overlapping, the base panel 512, with the top surfaces 508 of the first intermediate and top panels 610, 706 facing the top surface 508 of the base panel 512. As a part of this folding, the first end panel 762 is caused to be parallel to, and overlapping, parts of the first and second portions 576, 578 of the first side panel 562, with the top surface 508 of the first end panel 762 facing the top surfaces 508 of the first and second portions 576, 578 of the first side panel 562. Also, as a part of this folding, the second end panel 778 is caused to be parallel to, and overlapping, parts of the first and second portions 600, 602 of the second side panel 586, with the top surface 508 of the second end panel 778 facing the top surfaces 508 of the first and second portions 600, 602 of the second side panel 586.

As illustrated in FIG. 16, the second intermediate panel 658 is folded downwardly from its perpendicular position along fold line 518 such that the second intermediate panel 658 and the second top panel 794 are parallel to, and overlapping, the base panel 512 and the first top panel 706, with the top surface 508 of the second intermediate panel 658 facing the top surface 508 of the base panel 512, and with the top surface 508 of the second top panel 794 facing the top surface 508 of the base panel 512 and the bottom surface 510 of the first top panel 706. As a part of this folding, the third end panel 850 is caused to be parallel to, and overlapping, parts of the second portion 578 of the first side panel 562 and part of the first end panel 762, with the top surface 508 of the third end panel 850 facing the top surface 508 of the second portion 578 of the first side panel 562 and the bottom surface 510 of the first end panel 762. Also, as a part of this folding, the fourth end panel 866 is caused to be parallel to, and overlapping, parts of the second portion 602 of the second side panel 586 and part of the second end panel 778, with the top surface 508 of the fourth end panel 866 facing the top surface 508 of the second portion 602 of the second side panel 586 and the bottom surface 510 of the second end panel 778.

With the second top panel 794 overlapping the first top panel 706, the third end panel 850 overlapping the first end panel 762, and the fourth end panel 866 overlapping the second end panel 778, the strip of adhesive 879 secures the second top panel 794 to the first top panel 706, the third end panel 850 to the first end panel 762, and the fourth end panel 866 to the second end panel 778. Thus, the blank 500 is secured in the position as illustrated in FIG. 16 such that the blank 500 can be shipped or sold in this manner in order to provide increased cost savings to the end user of the blank 500 and insert 502 as the end user will have less steps to perform in securing a product 504 within the insert 502.

It should be noted that the strip of adhesive 879 could conversely be provided for on the top surfaces 508 of the first top panel 706 and the first and second end panels 762, 778 rather than on the top surfaces 508 of the second top panel 794 and the third and fourth end panels 850, 866. In this instance, the second top panel 794 and the third and fourth end panels 850, 866 would need to be folded down flat over the base panel 512 prior to the first top panel 706 and the first and second end panels 762, 778 being folded down flat over the second top panel 794 and the third and fourth end panels 850, 866. The remainder of the folding steps described hereinbelow would then be virtually identical and, therefore, will not be described in detail herein.

Figure 17:
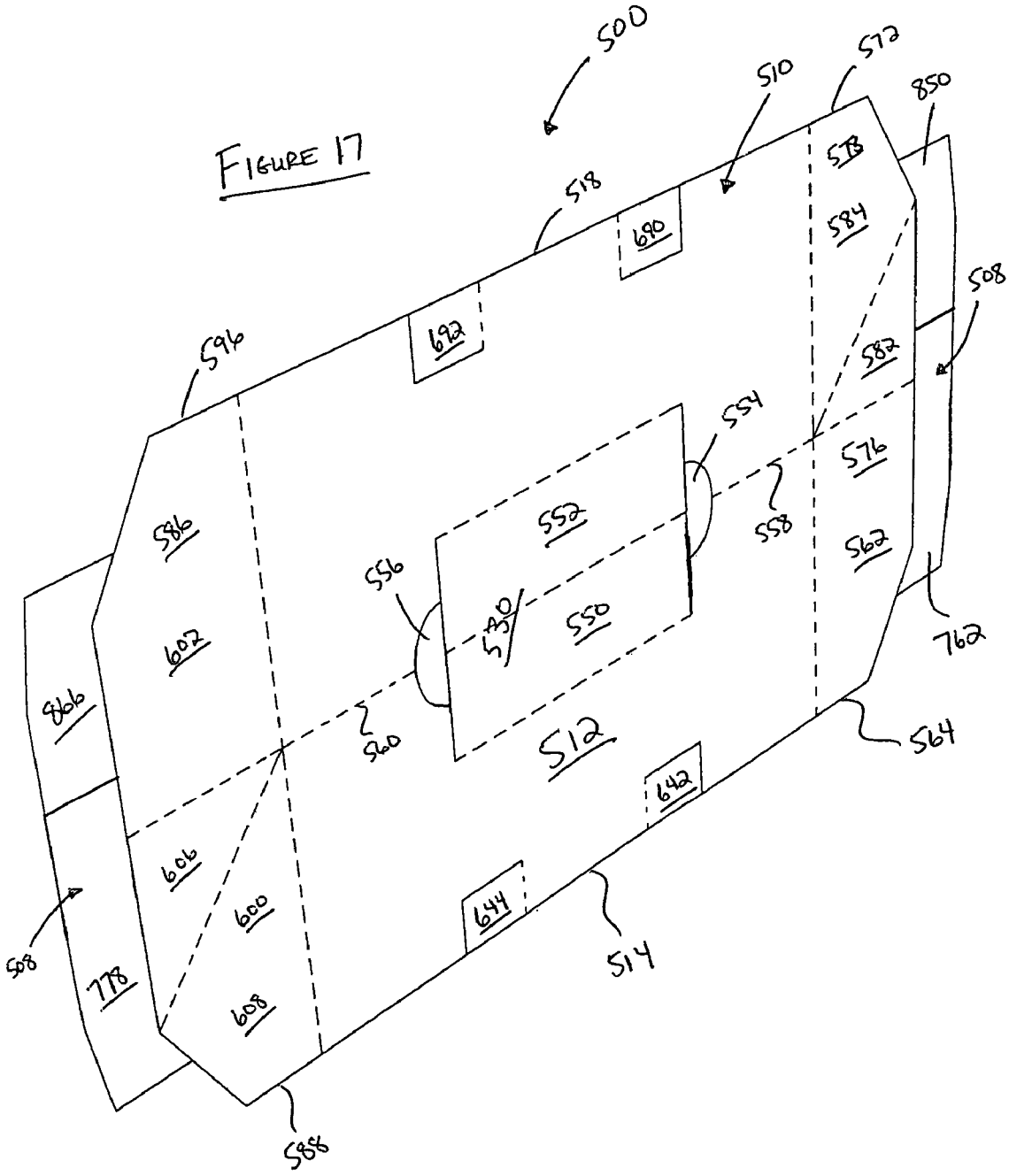

The blank 500 is then preferably stood upright, as illustrated in FIG. 17, such that fold line 514 and edges 564, 588 are positioned against a working surface (not shown), such as a tabletop or a floor. It should be noted that this is not a necessary step in the folding of the blank 500 into the insert 502, but that it has been found that this step makes the folding of the blank 500 into the insert 502 simpler in practice.

Figure 18:
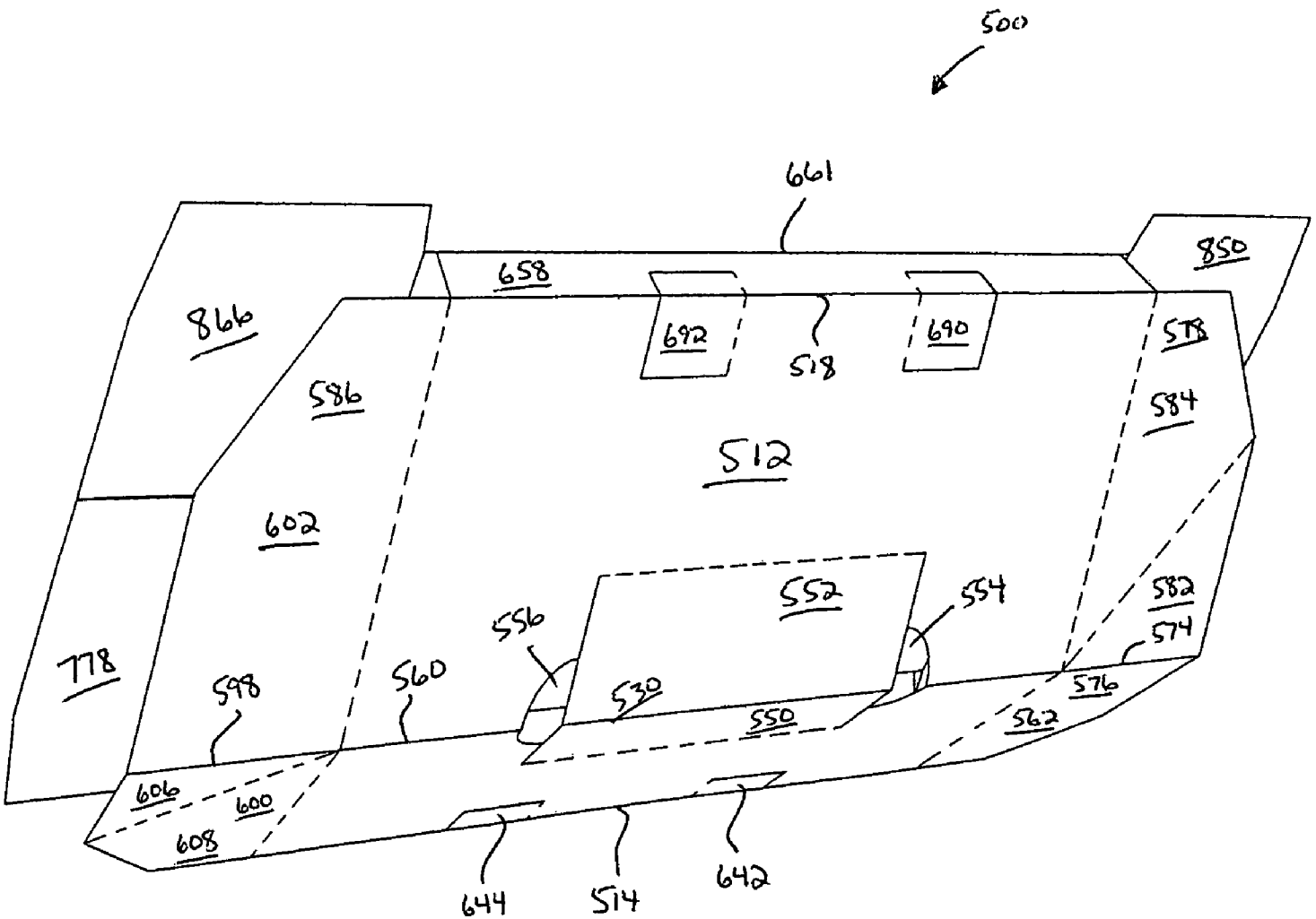

As illustrated in FIG. 18, pressure is applied to either fold line 514 or fold line 518, or both as desired. By this pressure being applied, the first intermediate panel 610 is folded relative to fold lines 514, 613 until the first intermediate panel 610 approaches or generally becomes perpendicular to the first top panel 706. Likewise, by this pressure being applied, the second intermediate panel 658 is folded relative to fold lines 518, 661 until the second intermediate panel 658 approaches or generally becomes perpendicular to the second top panel 794. Thus, the blank 500, as currently folded, generally has a cross-section which is five-sided or pentagonal in configuration. An opening 503 is thus provided through the folded blank 500, which is open at both ends of the opening 503.

Figure 19:
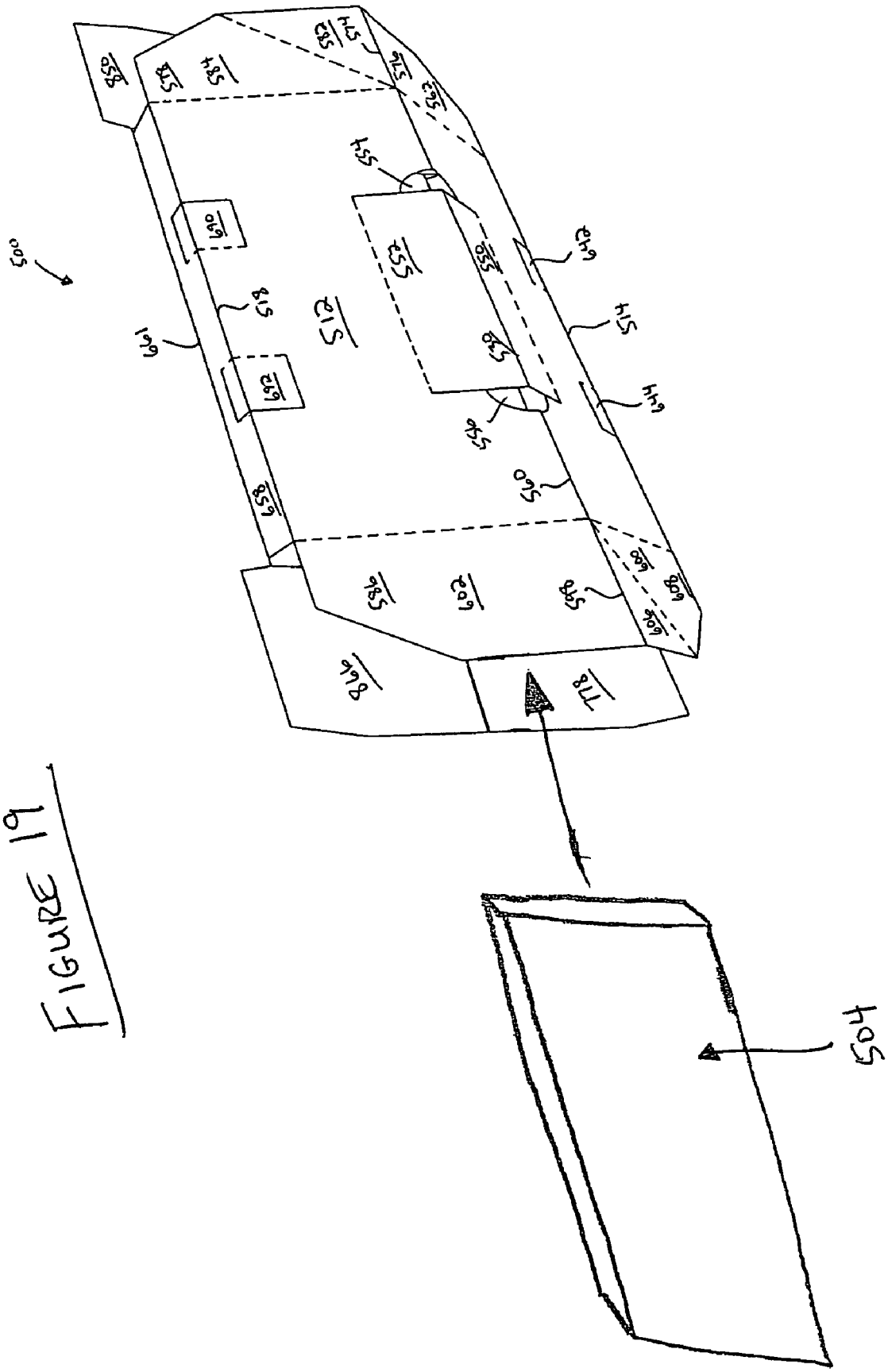

When the blank 500 is in the pentagonal cross-sectional configuration, the product 504 may then be inserted into the opening 503 of the blank 500, as illustrated in FIG. 19 (the product 504 is generally illustrated as a rectangular box, but it is to be understood that this is merely a generalization and that the product 504 can take on numerous different shapes), from either end, namely a first end defined by the first and third end panels 762, 850 and the bellows panel 562, or a second end defined by the second and fourth end panels 778, 866 and the bellows panel 586, such that the product 504 is generally encapsulated between the base panel 512, the first and second intermediate panels 610, 658 and the first and second top panels 706, 794.

Figure 20:
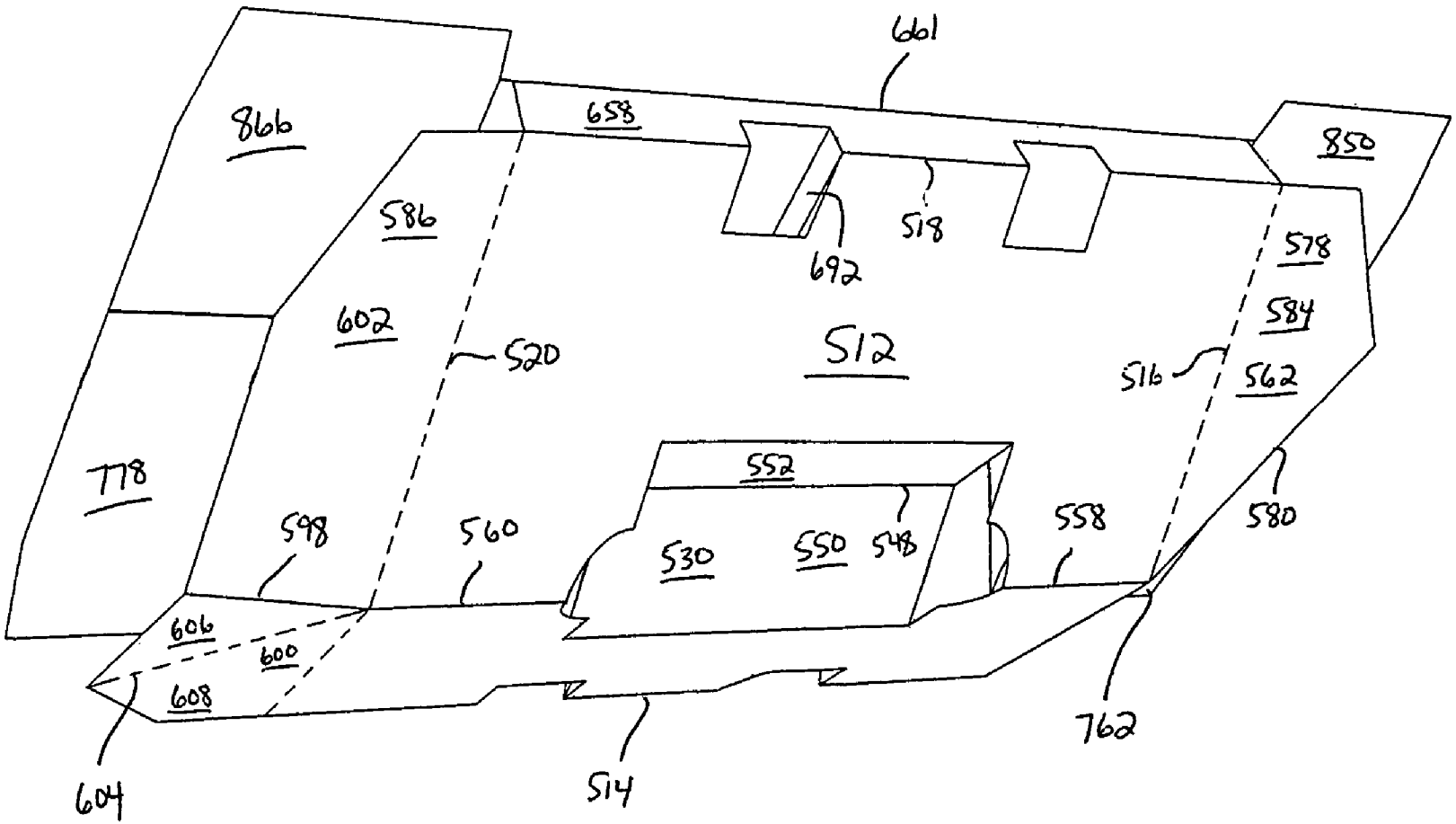

As illustrated in FIG. 20, if necessary, depending on the size and configuration of the product 504 wrapped and encapsulated within the blank 500, the first, second, third and fourth flap panels 642, 644, 690, 692 can be pushed and folded inwardly along fold lines 651, 657, 699, 705, respectively, toward the product 504 which is being wrapped and secured within the folded blank 500.

As illustrated in FIG. 20, if necessary, depending on the size and configuration of the product 504 wrapped and encapsulated within the blank 500, the V-panel 530 can be pushed and folded inwardly along fold lines 532, 534, 548 toward the product 504 which is being wrapped and secured within the folded blank 500 such that the bottom surface 510 of the first and second portions 550, 552 generally face one another.

Figure 21:
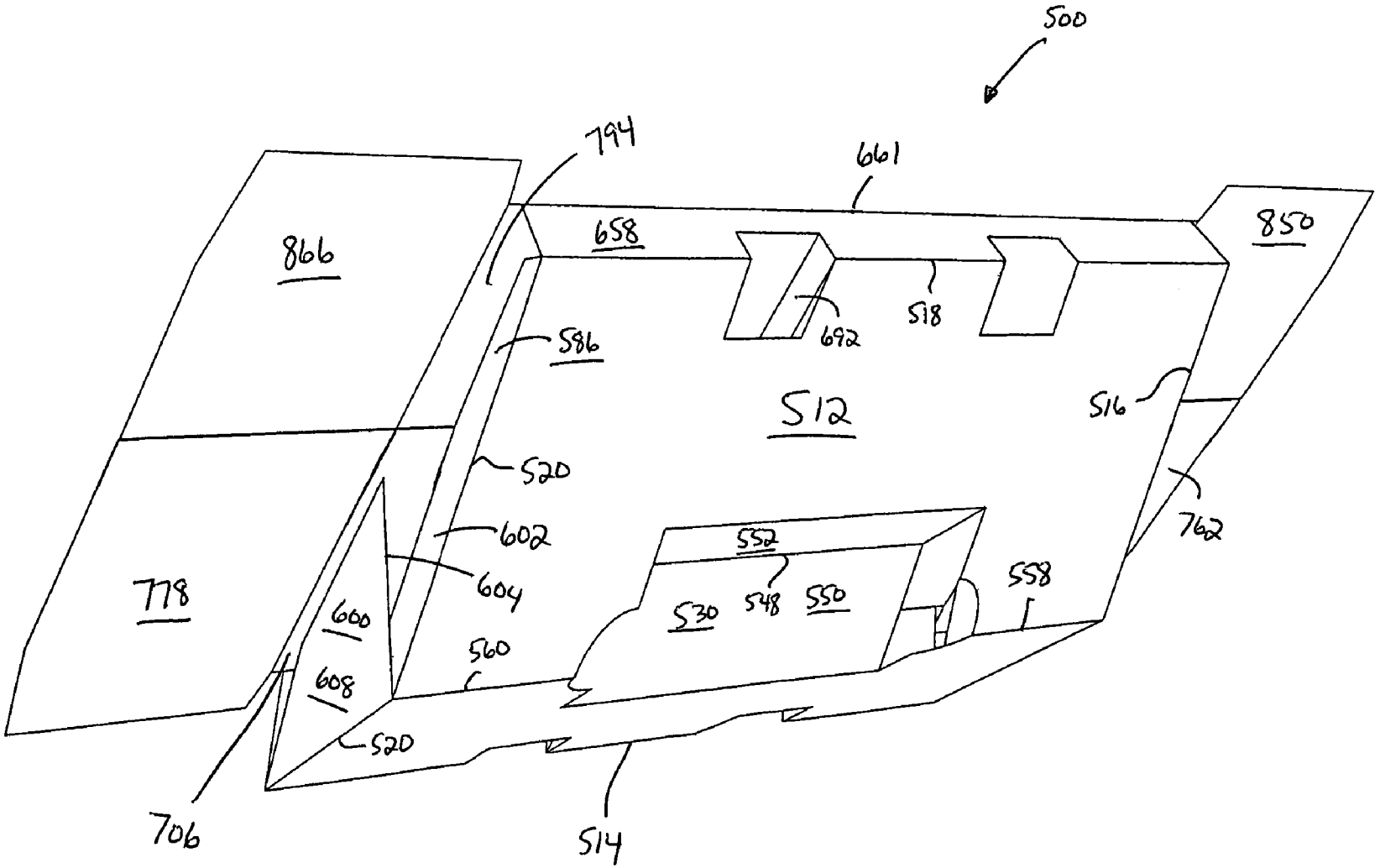

As illustrated in FIG. 21, the bellows panel 562 is folded into one end of the opening 503 in order to prevent the product 504 from moving out of the opening 503 through that end, and further to take up space between the end of the folded blank 500 and the product 504 positioned within the opening 503 of the folded blank 500. In order to fold the bellows panel 562, the bottom surface 510 of the first portion 576 of the bellows panel 562 is pushed such that the first portion 576 of the bellows panel 562 folds downwardly relative to the base panel 512 along fold line 516, and such that at least a portion of the edge 566 engages the top surface 508 of the first top panel 706. As the first portion 576 of the bellows panel 562 is folded downwardly, the first segment 582 of the second portion 578 of the bellows panel 562 is folded inwardly relative to the first portion 576 of the bellows panel 562 along fold line 574 and inwardly relative to the second segment 584 of the second portion 578 of the bellows panel 562 along bellows fold line 580. As the first segment 582 of the second portion 578 of the bellows panel 562 is folded inwardly, the second segment 584 of the second portion 578 of the bellows panel 562 is folded downwardly relative to the base panel 512 along fold line 516 until edge 570 engages the top surface 508 of the first top panel 706 proximate to edge 727 along fold line 726. The second segment 584 of the second portion 578 of the bellows panel 562 is thus positioned perpendicular to the first and second top panels 706, 794 and the first and third end panels 762, 850. As the second segment 584 is positioned perpendicular, the first portion 576 of the bellows panel 562 and the first segment 582 of the second portion 578 of the bellows panel 562 are thus folded further inwardly toward the product 504 within the folded blank 500. If desired, or if necessary to take up further space in the opening 503, the second segment 584 can be moved past perpendicular and into the opening 503, thus further moving the first segment 582 and the first portion 576 into the opening 503.

As illustrated in FIG. 9, the bellows panel 586 is folded into the other end of the opening 503 in order to prevent the product 504 from moving out of the opening 503 through that end, and further to take up space between the end of the folded blank 500 and the product 504 positioned within the opening 503 of the folded blank 500. In order to fold the bellows panel 586, the bottom surface 510 of the second portion 602 of the bellows panel 586 is pushed downwardly such that the second portion 602 of the bellows panel 586 folds downwardly relative to the base panel 512 along fold line 520, and such that at least a portion of the edge 594 engages the top surface 508 of the first top panel 706. As the second portion 602 of the bellows panel 586 is folded downwardly, the first segment 606 of the first portion 600 of the bellows panel 586 is folded inwardly relative to the second portion 602 of the bellows panel 586 along fold line 598 and inwardly relative to the second segment 608 of the first portion 600 of the bellows panel 586 along bellows fold line 604. As the first segment 606 of the first portion 600 of the bellows panel 586 is folded inwardly, the second segment 608 of the first portion 600 of the bellows panel 586 is folded downwardly relative to the base panel 512 along fold line 520 until edge 590 engages the top surface 508 of the first top panel 706 proximate to edge 815 along fold line 846. The second segment 608 of the first portion 600 of the bellows panel 586 is thus positioned perpendicular to the first and second top panels 706, 794 and the second and fourth end panels 778, 866. As the second segment 608 is positioned perpendicular, the second portion 602 of the bellows panel 586 and the first segment 606 of the first portion 600 of the bellows panel 586 are thus folded further inwardly toward the product 504 within the folded blank 500. If desired, or if necessary to take up further space in the opening 503, the second segment 608 can be moved past perpendicular and into the opening 503, thus further moving the first segment 606 and the second portion 602 into the opening 503.

It should be noted that the bellows panels 562, 586 could alternatively be folded into the opening 503 by first pushing on the second segments 584, 608 such that the second segments 584, 608 are positioned closer to the product 504 and the first portion 576 and the second portion 602 are positioned at the ends of the opening 503.

Figure 22:
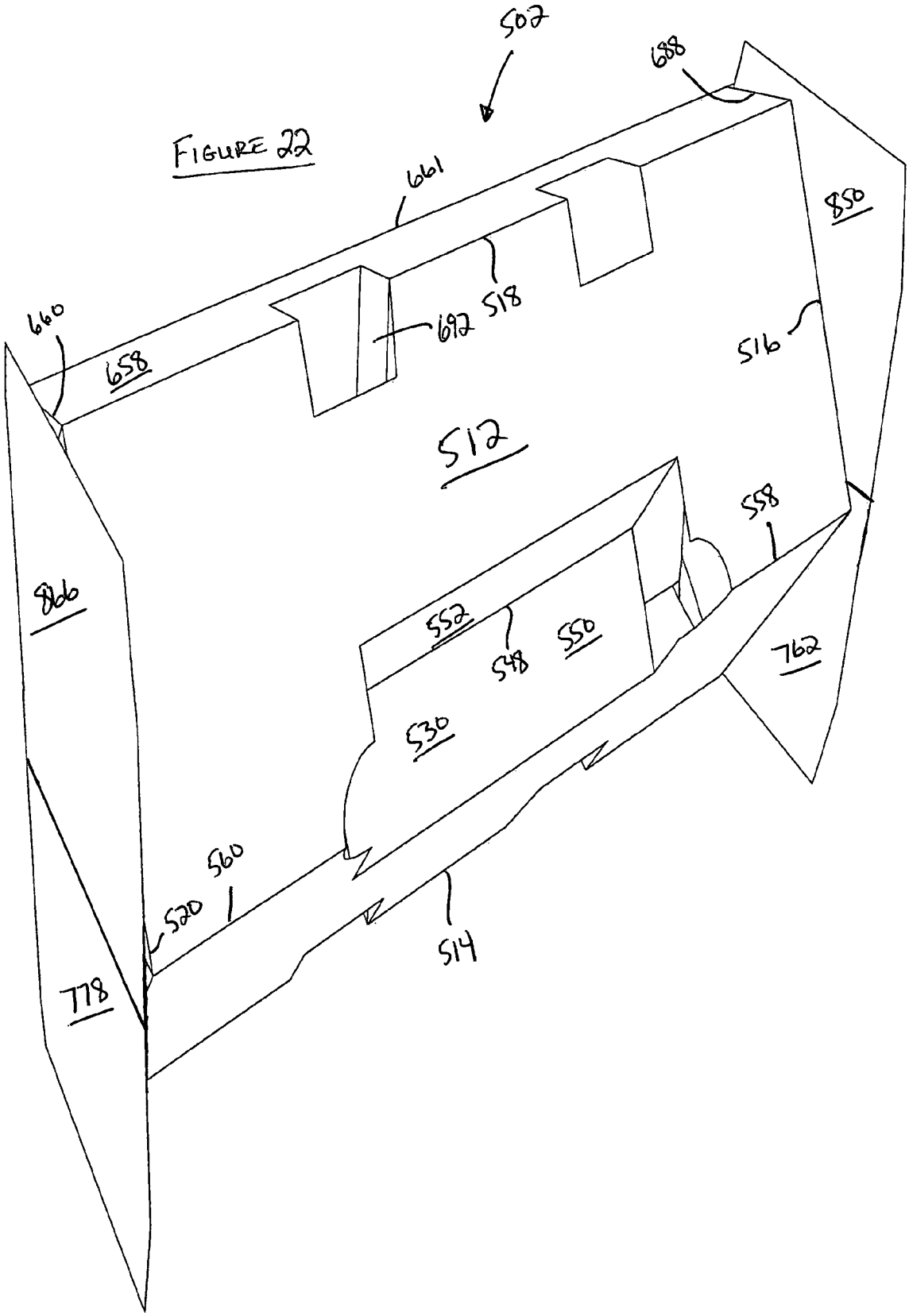
Figure 23:
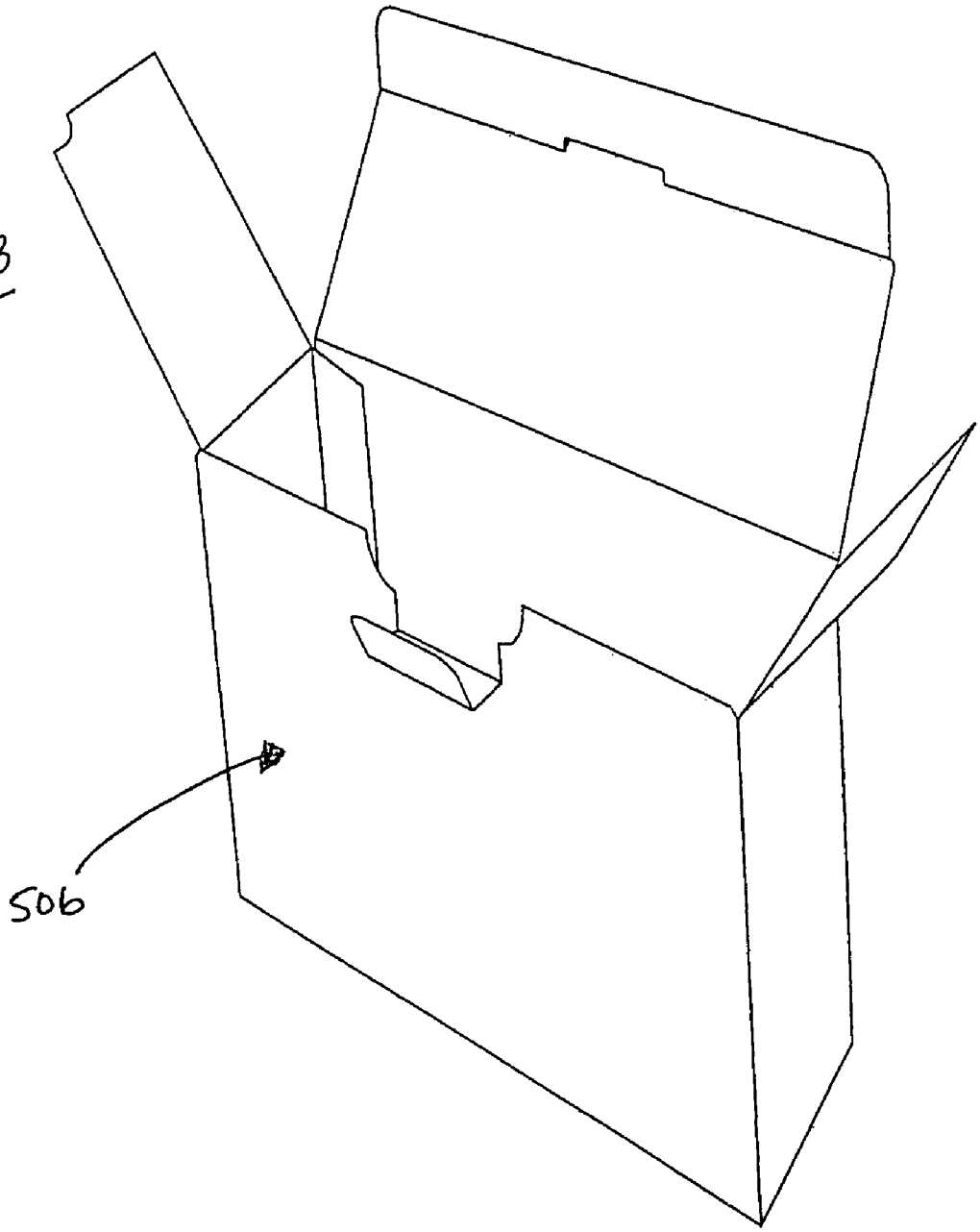
FIG. 23 is a perspective view of a shipping container into which the second embodiment of the insert is positioned within.

As illustrated in FIG. 22, the first and third end panels 762, 850 are folded along fold lines 726, 814, respectively, such that the first and third end panels 762, 850 are perpendicular to the first and second top panels 706, 794 and are parallel to and facing the bottom surface 510 of the second segment 584 of the second portion 578 of the bellows panel 562. The edges 770, 858 generally extend beyond where the fold line 558 is positioned on the base panel 512.

As illustrated in FIG. 22, the second and fourth end panels 778, 866 are folded along fold lines 758, 846, respectively, such that the second and fourth end panels 778, 866 are perpendicular to the first and second top panels 706, 794 and are parallel to and facing the bottom surface 510 of the second segment 608 of the first portion 600 of the bellows panel 586. The edges 786, 874 generally extend beyond where the fold line 560 is positioned on the base panel 512.

It should be noted that, if desired, the insertion of the product 504 and the folding performed as described hereinabove with regard to FIGS. 19-22 may be found to be easier for the user if the blank 500 is rotated such that the first and second top panels 706, 794 are generally positioned against a working surface.

Figure 24:
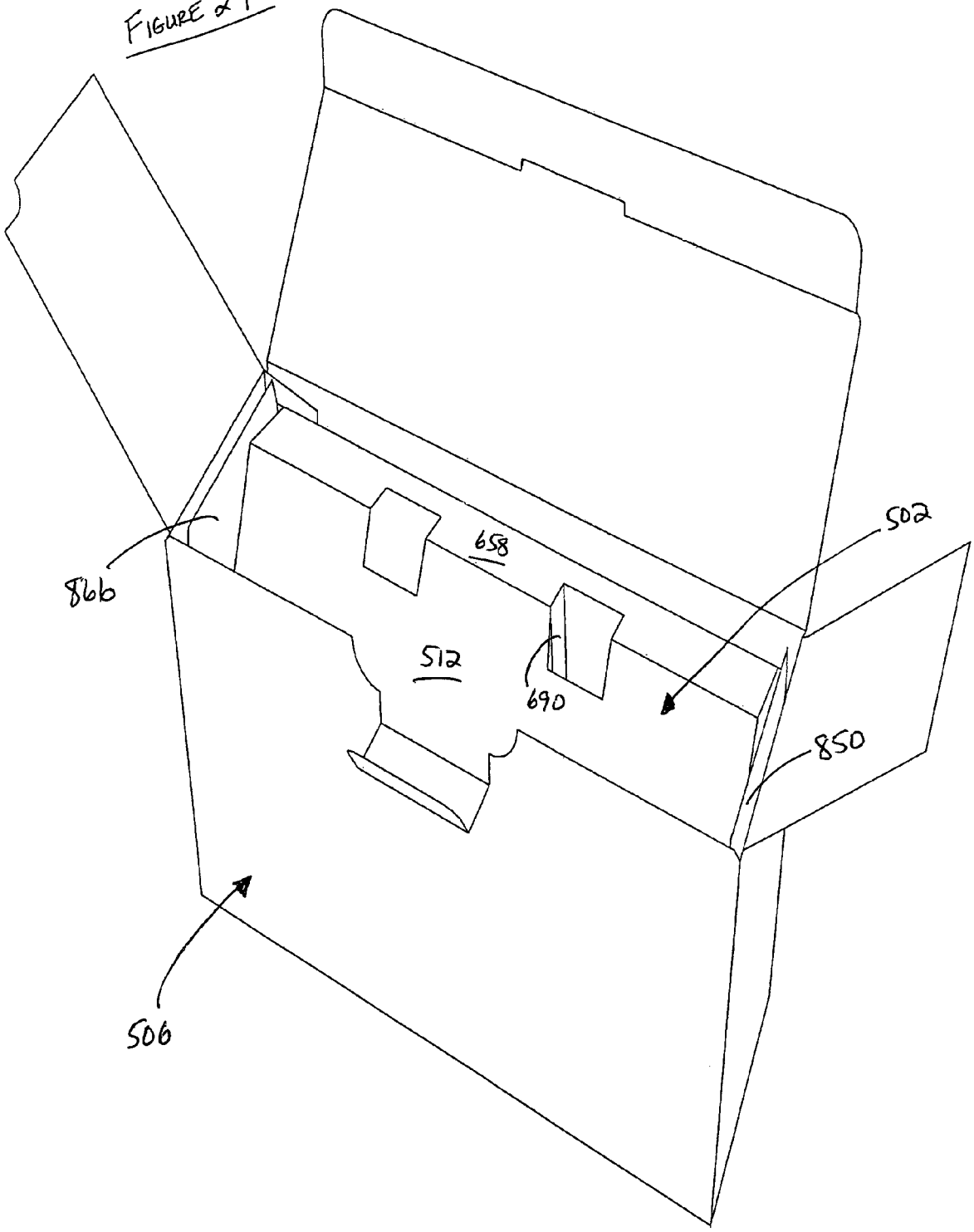
FIG. 24 is a perspective view of the second embodiment of the insert of the invention positioned within the shipping container.

The insert 502 is thus formed with the product 504 protected and secured therein. The insert 502 is best illustrated in FIG. 22. The insert 502 is then lifted and inserted into the box or shipping container 506, as illustrated in FIG. 24, which is appropriately sized and configured to receive and secure the insert 502 therein, such that the first and third end panels 762, 850 face a sidewall of the box 506, and such that the second and fourth end panels 778, 866 face an opposite sidewall of the box 506.

When positioned within the box 506, the configuration of the insert 502 provides a number of air cells to further protect the product 504 within the insert 502. The edges 770, 786, 858, 874 of the first, second, third and fourth end panels 762, 778, 850, 866, respectively, create an air cell between the insert 502 and a side of the box 506. One or more of the 514, and the edges 766, 782 of the first and second end panels 762, 778, respectively, create an air cell between the insert 502 and either a top or bottom of the box 506. Likewise, one or more of the fold line 518, and the edges 854, 870 of the third and fourth end panels 850, 866, respectively, create an air cell between the insert 502 and either a top or bottom of the box 506. The closing off of the ends of the opening 503 by the bellows panels 562, 586 and the first, second, third and fourth end panels 762, 778, 850, 866 further protect the product 504.

The blanks 100, 500 and the inserts 102, 502 formed from the blanks 100, 500 provide a number of benefits and advantages when compared to the prior art products used for storing, protecting and shipping products, such as toner cartridges. For instance, the blanks 100, 500 are formed to have a symmetrical design which results in the ease and speed of forming the inserts 102, 502 regardless of the orientation of the blanks 100, 500 along an end user's packaging assembly line, thus making the symmetrical design very labor efficient. As the blanks 100, 500 have a symmetrical design, it is to be understood that, if desired, the blanks 100, 500 can be folded as described hereinabove, or the blanks 100, 500 can be folded in the opposite manner, i.e., such that the second top panels 394, 794 are folded underneath the first top panels 306, 706 and, thus, folded accordingly in generally the same manner thereafter; obviously, for the insert 502, the adhesive 879 would be provided on the top surface 508 of the first top panel 706 and the first and second end panels 762, 778 as opposed to the top surface 508 of the second top panel 794 and the third and fourth end panels 850, 866. The use of the adhesive 879 on the blank 500 to form the insert 502 also allows for the blank 500 to be secured to itself and shipped flat to an end user prior to final formation of the insert 502 by the user, thus reducing the number of steps which the end user must perform in order to form the insert 502.

Also, as explained, the inserts 102, 502 have a generally pentagonal or 5-sided cross-section such that the inserts 102, 502 produce void spaces that the products 104, 504 secured therein cannot or do not reach all five sides of the inserts 102, 502, thus creating natural air cells within the inserts 102, 502.

The configuration of the first and second side or bellows panels 162, 186; 562, 586 serve two separate and beneficial functions. First, with regard to the first side or bellows panels 162, 562, the first segments 182, 582 of the second portions 178, 578 of the first side or bellows panels 162, 562 separate the first portions 176, 576 of the first side or bellows panels 162, 562 from the second segments 184, 584 of the second portions 178, 578 of the first side or bellows panels 162, 562, thus providing the first side or bellows panels 162, 562 with a spring-like quality which provides layers of cushioning upon impact. Likewise, with regard to the second side or bellows panels 186, 586, the first segments 206, 606 of the first portions 200, 600 of the second side or bellows panels 186, 586 separate the second portions 202, 602 of the second side or bellows panels 186, 586 from the second segments 208, 608 of the first portions 200, 600 of the second side or bellows panels 186, 586, thus providing the second side or bellows panels 186, 586 with a spring-like quality which provides layers of cushioning upon impact. Second, the first and second side panels 162, 186; 562, 586 fill out void space along the length of the inserts 102, 502 when the lengths of the products 104, 504 provided therein vary.

As explained hereinabove, the V-panels 130, 530 in the base panels 112, 512 can be popped/folded down to decrease the interior dimension of the inserts 102, 502, when necessary depending on the size and configuration of the products 104, 504 positioned within the inserts 102, 502, in order to allow multiple types of products 104, 504 of significantly different sizes to be secured in place with minimal movement. The semi-circular apertures 154, 156; 554, 556 are provided along the V-panels 130, 530 in order to provide relief for the popping/folding down of the V-panels 130, 530, thus making the popping/folding down of the V-panels 130, 530 easier to perform. The semi-circular apertures 154, 156; 554, 556 also allow for the V-panels 130, 530 to be popped/folded upwardly if necessary. As stated above, the apertures 154, 156; 554, 556 could have a configuration other than semi-circular if desired.

Also, as explained hereinabove, the first, second, third and fourth flap members 242, 244, 290, 292; 642, 644, 690, 692 can be popped/folded down to decrease the interior dimension of the inserts 102, 502, when necessary depending on the size and configuration of the products 104, 504 positioned within the inserts 102, 502, in order to allow multiple types of products 104, 504 of significantly different sizes to be secured in place with minimal movement. The flap panels 242, 244, 290, 292; 642, 644, 690, 692 also, after being popped/folded down, simultaneously function as finger holes for ease of loading and/or unloading of the inserts 102, 502.

The inserts 102, 502 thus are extremely versatile as they can secure a plethora of different types of products 104, 504 therein, for instance the inserts 102, 502 can secure at least forty (40) different known brands of toner and ink jet cartridges.

When the insert 102 is formed and then positioned within the shipping container 106, the first, second, third and fourth tab members 486, 488, 494, 496 keep the remainder of the insert 102 away from the walls of the shipping container 106, thus providing an air cell between the insert 102 and the shipping container 106 in order to provide further protection to the product 104 secured within the insert 102. The apertures 314, 322, 402, 410 are provided next to the tab members 486, 488, 494, 496 in order to provide relief for the tab members 486, 488, 494, 496.

Likewise, when the inserts 102, 502 are formed and then positioned within the shipping containers 106, 506, the first, second, third and fourth end panels 362, 378, 450, 466; 762, 778, 850, 866 keep the remainder of the inserts 102, 502 away from the walls of the shipping containers 106, 506, thus providing more air cells between the inserts 102, 502 and the shipping containers 106, 506 in order to provide further protection to the products 104, 504 secured within the inserts 102, 502.

The dimensions of the blanks 100, 500 can be changed as desired such that the inserts 102, 502 formed therefrom can fit into different sized and shaped boxes 106, 506, and such that the inserts 102, 502 can accommodate and secure and protect different sized and shaped products 104, 504.

The layers of corrugated fibreboard also provide cushioning to provide further protection to the products 104, 504 secured within the inserts 102, 502.

The inserts 102, 502 are also environmentally friendly as it is formed of corrugated fibreboard which is easily and readily recyclable. By forming the inserts 102, 502 of corrugated fibreboard, the inserts 102, 502 are also inexpensive to manufacture and, thus, is very cost effective.

Further, the inserts 102, 502 are space-saving as they are formed from the blanks 100, 500 which both ship and store flat.

While preferred embodiments of the invention is shown and described, it is envisioned that those skilled in the art may devise various modifications without departing from the spirit and scope of the foregoing description and the appended claims.

The invention is claimed as follows:

1. A blank configured to be folded into an insert for protecting a product, said blank comprising:

a base panel generally having first, second, third and fourth sides, said first and second sides being positioned opposite one another, said third and fourth sides being positioned opposite one another, said first and second sides being positioned generally perpendicular to said third and fourth sides;

first and second intermediate panels, said first intermediate panel being joined to said first side of said base panel, said second intermediate panel being joined to said second side of said base panel;

first and second bellows panels, said first bellows panel being joined to said third side of said base panel, said second bellows panel being joined to said fourth side of said base panel;

first and second top panels, said first top panel being joined to said first intermediate panel along a side of said first intermediate panel which is opposite said first side of said base panel, said second top panel being joined to said second intermediate panel along a side of said second intermediate panel which is opposite said second side of said base panel;

first, second, third and fourth end panels, said first and second end panels being joined to opposite sides of said first top panel, said opposite sides of said first top panel being generally perpendicular to said side of said first intermediate panel which is opposite said first side of said base panel, said third and fourth end panels being joined to opposite sides of said second top panel, said opposite sides of said second top panel being generally perpendicular to said side of said second intermediate panel which is opposite said second side of said base panel; wherein said base panel has a fold line which generally extends from said third side thereof to said fourth side thereof, generally equidistantly between said first side thereof and said second side thereof; and wherein each said bellows panel comprises first and second portions divided by a fold line, said second portions of said bellows panels comprising fist and second segments divided by a bellows fold line, said first segment being separated from said first portion by said fold line.

2. A blank as defined in claim 1, wherein said base panel has a V-panel which includes first and second elongated panels which are secured to one another along a portion of said fold line.

3. A blank as defined in claim 1, further comprising at least one flap member which is partially provided on said base panel and partially provided on said first intermediate panel.

4. A blank as defined in claim 1, further comprising at least one flap member which is partially provided on said base panel and partially provided on said second intermediate panel.

5. A blank as defined in claim 1, wherein said base panel, said first and second intermediate panels, and said first and second lop panels are configured to be folded to form a five-sided structure having an opening provided therethrough.

6. A blank as defined in claim 5, wherein said first bellows panel is configured to be folded to close off a first end of said opening, said second bellows panel configured to be folded to close off a second, opposite end of said opening, said first and second bellows panels further configured to be at least partially positioned within said opening in order to decrease an interior dimension of said five-sided structure such that the product may be secured within said opening of said five-sided structure with minimal movement.

7. A blank as defined in claim 6, wherein said first and third end panels arc configured to be folded such that said first and third end panels are positioned between said first bellows panel and a sidewall of a box when the insert is packed inside the box, and wherein said second and fourth end panels are configured to be folded such that said second and fourth end panels are positioned between said second bellows panels and an opposite sidewall of the box when the insert is packed inside the box.

8. A blank as defined in claim 5, wherein said first and second top panels are secured to one another by an adhesive in order to form said five-sided structure.

9. A blank as defined in claim 5, wherein said first and second top panels are secured to one another by a tab member provided on one of said first and second top panels being locked into an aperture formed during the folding of said blank.

10. A blank as defined in claim 1, wherein said blank is formed of corrugated fiberboard.

* * * * *